US006168215B1

(12) United States Patent
Kodama et al.

(10) Patent No.: US 6,168,215 B1
(45) Date of Patent: Jan. 2, 2001

(54) DOOR LOCK DEVICE FOR VEHICLE

(75) Inventors: Naoki Kodama; Takahiro Kumamoto; Takeshi Taniguchi; Toshihiko Sonoda; Yuichi Usuzaki; Tsutomu Kurita, all of Miyazaki (JP)

(73) Assignee: Kabushiki Kaisha Honda Lock, Miyazaki (JP)

( * ) Notice: Under 35 U.S.C. 154(b), the term of this patent shall be extended for 0 days.

(21) Appl. No.: 09/215,537

(22) Filed: Dec. 18, 1998

(30) Foreign Application Priority Data

Dec. 24, 1997 (JP) ..... 9-354675
Jun. 30, 1998 (JP) ..... 10-185113
Aug. 18, 1998 (JP) ..... 10-231473

(51) Int. Cl.[7] ..... E05C 3/06
(52) U.S. Cl. ..... 292/201; 292/216; 292/DIG. 23
(58) Field of Search ..... 292/216, DIG. 23, 292/201

(56) References Cited

U.S. PATENT DOCUMENTS 4,775,176 * 10/1988 Ikeda ..... 292/216
4,806,712 * 2/1989 Hoffman et al. ..... 292/216 X
4,913,477 * 4/1990 Watanuki et al. ..... 292/216
5,634,677 * 6/1997 Büscher et al. ..... 292/216
5,649,726 * 7/1997 Rogers, Jr. et al. ..... 292/216 X
5,678,869 * 10/1997 Yoshikuwa ..... 292/216
5,762,383 * 6/1998 Gomi ..... 292/216
5,833,282 * 11/1998 Ikeda ..... 292/216 X
5,984,384 * 11/1999 Hamaguchi et al. ..... 292/216

FOREIGN PATENT DOCUMENTS 5-51750 8/1993 (JP) .

* cited by examiner

*Primary Examiner*—Lloyd A. Gall
(74) *Attorney, Agent, or Firm*—Arent Fox Kintner Plotkin & Kahn, PLLC

(57) ABSTRACT

The vehicular door lock device includes a casing fixed to a door and having a bulged portion defining an ingress passage receiving a striker on a vehicle body. A latch is supported on the casing for engagement with the striker for turning movement. A ratchet on the casing is for engagement and disengagement with and from the latch. An open lever is turnable on the casing and receives an operating force for releasing a locking state having the ratchet engaged with the latch. An internal operating-force inputting device transmits to the open lever a door opening operation force depending on the door opening operation within the vehicle. A locked-state switch-over device has an open link connected at one end to the open lever and switches over to an unlocked state to operate the ratchet from the engaged position to the disengaged position in response to the open lever turning, and a locked state inhibiting the ratchet from going to the disengaged position, irrespective of the turning movement of the open lever. The open link extends along a plane perpendicular to a lengthwise direction of the ingress passage and, is disposed sideways of the bulged portion on an opposite side from an inlet of the passage. The space occupied by the door lock device in the direction to avoid interference with a glass sash, along the thickness of a door can be small, and the door internal structure and thickness can be designed as desired.

15 Claims, 46 Drawing Sheets

DOOR LOCK DEVICE FOR VEHICLE

BACKGROUND OF THE INVENTION

1. Field of the Invention

The present invention relates to a door lock device for a vehicle and particularly, to a door lock device for a vehicle, including a casing fixed to a door and having a bulged portion which defines an ingress passage, a latch adapted to be engaged with a striker entering the ingress passage for turning movement, a ratchet capable of being turned between an engaged position in which the ratchet is engaged with the latch and a disengaged position in which such engagement is released, an open link connected at one end thereof to an open lever, and a locking lever connected to the other end of the open link.

2. Description of the Related Art

Such a door lock device is conventionally known, for example, from Japanese Patent Publication No.5-51750 and the like.

Such a door lock device is mounted to one end of a door which is pivotally supported at the other end thereof to a vehicle body for turning movement, and the back of a bulged portion included in a casing is disposed to face toward a glass sash which is mounted within the door so as to guide the lifting and lowering movements of a glass pane. In the door lock device disclosed in the above Japanese Patent Publication No.5-51750, however, the open link capable of swinging movement within a plane parallel to the turning axes of the latch and the ratchet is disposed on the back of the bulged portion. For this reason, the space occupied in the thickness-wise direction of the door by the door lock device is relatively large, and the degree of freedom in setting the thickness of the door is decreased.

SUMMARY OF THE INVENTION

Accordingly, it is an object of the present invention to provide a door lock device for a vehicle, wherein the space occupied by the door lock device in a direction to avoid the interference with the glass sash and in the thickness-wise direction of the door can be set at an extremely small value, and the degree of freedom in setting the door internal structure and the thickness of the door can be increased.

To achieve the above object, according to a first aspect and feature of the present invention, there is provided a door lock device for a vehicle, comprising a casing fixed to a door and having a bulged portion which is bulged inwards of the door to define an ingress passage into which a striker on a vehicle body side enters; a latch turnably supported on the casing, to be brought into engagement with the striker entering into the ingress passage for turning movement; a ratchet supported on the casing for turning movement between an engaged position in which the ratchet is engaged with the latch and a disengaged position in which such engagement is released; an open lever turnably carried on the casing and capable of receiving an operating force for releasing a locking state in which the ratchet is in engagement with the latch; an internal operating-force inputting means connected to the open lever to transmit to the open lever a door opening operation force depending on the door opening operation within the vehicle; a locked-state switch-over means which includes an open link connected at one end thereof to the open lever and which is capable of switching over an unlocked state in which the ratchet can be operated from the engaged position to the disengaged position in response to the turning movement of the open lever following input of the door opening operation force, and a locked state in which the operation of the ratchet from the engaged position to the disengaged position is impossible irrespective of the turning movement of the open lever following the input of the door opening operation force, wherein the open link which extends along a plane perpendicular to a lengthwise direction of the ingress passage and which is capable of being operated within such plane, is disposed sideways of the bulged portion on an opposite side from an inlet of the ingress passage.

With the arrangement of the above first feature, the open link can be operably disposed by effectively utilizing a space occupied by the bulged portion included in the casing, and a relatively large unoccupied space can be ensured between the door lock device and a glass sash, because it is unnecessary to ensure a large space required for the operation of the open link on the side of a back of the bulged portion. In addition, since the open link extends along the plane perpendicular to the lengthwise direction of the ingress passage, the space for the open link disposed sideways of the bulged portion on the side opposite from the inlet of the ingress passage may be small and hence, the space occupied in the thickness-wise direction of the door by the door lock device may also be small.

According to a second aspect and feature of the present invention, in addition to the arrangement of the first feature, the locked-state switch-over means includes at least the open link, and a locking lever connected to the other end of the open link for operation between an unlocking position in which an operating force for operating the ratchet from the engaged position to the disengaged position in response to the operation of the open lever following the input of the opening operation force can be transmitted from the open link to the ratchet, and a locking position in which the transmission of the operating force from the open link to the ratchet is impossible, irrespective of the operation of the open lever, and wherein the cover mounted to the casing to cover the open link and the locking lever is provided with a guide groove for guiding the operation of the open link. With such arrangement, since the open link and the locking lever are covered with the cover an exclusive tool cannot be inserted into the door to be engaged with the open link or the locking lever. Thus, it is possible to prevent the open link or the locking lever from being operated as undesired by the exclusive tool and hence, the steal-preventing property can be enhanced. Moreover, the open link can reliably be operated by guiding the operation of the open link in the guide groove provided in the cover.

According to a third aspect and feature of the present invention, in addition to the arrangement of the second feature, a plurality of ribs are fixedly provided on an inner side of the guide groove to come into sliding contact with opposite sides of the open link. With such arrangement, the chattering of the open link can reliably be eliminated, thereby effectively preventing the generation of noise during traveling of the vehicle or during opening and closing of the door.

According to a fourth aspect and feature of the present invention, in addition to the arrangement of the second feature, a knob lever is connected to the locking lever to operate the locking lever between the unlocking position and the locking position, the knob lever being integrally provided with a shaft section having the same axis as a turning axis of the knob lever, and the locking lever is relatively non-turnably connected to the shaft section. With such arrangement, since the locking lever is relatively non-turnably connected to the shaft section integral with the knob lever, the locking lever and the knob lever can be supported commonly, and can be supported for turning movement by a small number of parts and in a small number of assembling steps. Moreover, the locking lever and the knob lever are turned in unison with each other about the same axis, leading to an excellent efficiency of transmission of the force between the knob lever and the locking lever.

According to a fifth aspect and feature of the present invention, in addition to the arrangement of the fourth feature, a cylinder lever connected to a key cylinder lock is connected to the shaft section for turning movement in unison with each other about the same axis as the shaft section. With such arrangement, the cylinder lever, in addition to the knob lever and the locking lever, can be turned about the same axis, and the knob lever, the locking lever and the cylinder lever can be supported for turning movement by a small number of parts and in a small number of assembling steps, while the efficiency of transmission of the force between the cylinder lever and the locking lever can also be enhanced.

According to a sixth aspect and feature of the present invention, in addition to the arrangement of the fourth feature, the shaft section of the knob lever is turnably supported on the cover. With such arrangement, the number of parts can be reduced by supporting the shaft section of the knob lever on the cover for enhancing the steal-preventing property. More specifically, if the open link and the locking lever are disposed in an exposed manner within the door, the exclusive tool inserted into the door can be brought into engagement with either one of the open link and the locking lever to operate the open link or the locking lever as undesired and hence, there is a possibility that the vehicle may be stolen. According to the present invention, however, it is impossible to bring the exclusive tool into engagement with the open link or the locking lever by the cover, whereby the steal-preventing property can be enhanced. Since the shaft section integral with the knob lever is supported on the cover for enhancing the steal-preventing property, any exclusive component for supporting the shaft section is not required other than the cover, which can contribute to a reduction in the number of parts.

According to a seventh aspect and feature of the present invention, in addition to the arrangement of the first feature, a ratchet lever connected to the ratchet so as to be capable of transmitting the operating force from the open link to the ratchet is disposed in a coaxially superposed manner on the ratchet against turning movement relative to the ratchet. With such arrangement, since the ratchet lever is disposed in the coaxially superposed manner on the ratchet and moreover, the ratchet lever is non-turnable relative to the ratchet, the ratchet and ratchet lever can be supported commonly for turning movement, thereby reducing the number of parts and enhancing the efficiency of transmission of the force between the ratchet lever and the ratchet. Moreover, the ratchet and the ratchet lever can be connected to each other in a compact arrangement, thereby making the door lock device compact.

According to an eighth aspect and feature of the present invention, in addition to the arrangement of the seventh feature, the ratchet comprises a ratchet body made of a metal, the ratchet body being covered at most thereof with a covering member made of a synthetic resin, the covering member having a resilient stopper integrally formed thereon to protrude from the ratchet in a direction parallel to the turning axis of the ratchet, the stopper being operable to abut against a casing to define an end of turning movement of the ratchet in a direction to be engaged with the latch. With such arrangement, since the end of turning movement of the ratchet in the direction to be engaged with the latch is defined by the abutment of the resilient stopper against the casing, a shock sound generated upon abutment of the resilient stopper against the casing to define the end of turning movement can be absorbed by the resilient action of the resilient stopper to prevent the generation of noise. Moreover, since the resilient stopper protrudes from the ratchet in the direction parallel to the turning axis of the ratchet, the space occupied by the ratchet within a plane perpendicular to such turning axis can be reduced, as compared with a case where the stopper protrudes radially from the turning axis, thereby providing a reduction in size of the ratchet and in turn, a reduction in size of the casing.

According to a ninth aspect and feature of the present invention, in addition to the arrangement of the eighth feature, the resilient stopper is disposed on the ratchet at a location in which the stopper is sandwiched between the casing and the ratchet lever when the stopper is in abutment against the casing. With such arrangement, the durability of the resilient stopper can be enhanced by supporting the resilient stopper on the ratchet lever.

According to a tenth aspect and feature of the present invention, in addition to the arrangement of the first feature, the locked-state switch-over means includes at least the open link, and a locking lever connected to the other end of the open link for operation between an unlocking position in which an operating force for operating the ratchet from the engaged position to the disengaged position in response to the operation of the open lever following the input of the opening operation force can be transmitted from the open link to the ratchet, and a locking position in which the transmission of the operating force from the open link to the ratchet is impossible, irrespective of the operation of the open lever, and an actuator is fixedly supported on the casing so as to be capable of turning the locking lever, and includes an output shaft coaxially connected to the locking lever. With such arrangement, since the output shaft of the actuator is coaxially connected to the locking lever, it is not required that a connecting member is mounted between the output shaft of the actuator and the locking lever. Thus, it is possible not only to reduce the number of the parts and enhance the assemblability, but also to enhance the efficiency of transmission of the power between the actuator and the locking lever.

According to an eleventh aspect and feature of the present invention, in addition to the arrangement of the second feature, the cover is resiliently engaged with the casing, in a manner to be attachable and detachable in an operating direction parallel to the turning axes of the latch and the ratchet; an actuator is connected to the locking lever and brought into resilient engagement with the cover from the side of the casing, so that the position thereof relative to the cover in a plane perpendicular to the operating direction is invariable; and the casing is provided with a limiting plate portion which is opposed to the actuator to inhibit leaving of the actuator from the cover. With such arrangement, the actuator is clamped and fixed between the limiting plate portion of the casing and the cover by bringing the cover into resilient engagement with the casing in a state in which the actuator has been brought into resilient engagement with the cover from the side of the casing. Thus, the actuator can easily be assembled without use of a fastening part such as a machine screw, and the assembling operability can be enhanced.

According to a twelfth aspect and feature of the present invention, in addition to the arrangement of the second feature, the cover mounted to the casing to cover at least a knob lever coaxially connected to the locking lever, the open link, and the locking lever, is provided with a support bore, and the door lock device further includes a connecting lever which is disposed inwardly of the cover, turnably carried on the cover and connected to the knob lever to transmit to the knob lever an operating force depending on the operation of a locking knob, the connecting lever being integrally provided with a shaft section which is inserted into the support bore for turning movement about an axis of the shaft portion and which has a plurality of engage claws resiliently engaged with a periphery of the support bore on the side of an outer surface of the cover, the outer surface of the cover being provided with a covering portion which covers at least an upper portion and an outer end of the shaft section. With such arrangement, by inserting the shaft section integrally connected to the connecting lever into the support bore in the cover, the shaft section, namely, the connecting lever is attached to the cover for turning movement about the axis but against axial movement and hence, it is easy to assemble the connecting lever to the cover. Moreover, since at least the upper portion and the outer end of the shaft section are covered with the covering portion provided on the cover, wrong access from the outside to the shaft section is impossible. Moreover, an external force is prevented from being applied to the shaft section of the connecting lever in a direction to permit the shaft section to leave the support bore at an assembling step or at a transporting stage, and hence, the connecting lever cannot be disconnected out of the cover.

According to a thirteenth aspect and feature of the present invention, in addition to the arrangement of the first feature, the internal operating-force inputting means and the locked-state switch-over means are formed in different constructions for a front side door and a rear side door in the vehicle, wherein a common unit is comprised of the casing as a common casing capable of being mounted to either of the front side door and the rear side door, and a plurality of common parts including the latch, the ratchet and the open lever mounted to the casing as common to the front side door and the rear side door, and wherein the cover is formed into a shape common to the front side door and the rear side door and mounted to the casing while covering the common unit, so that any of the internal operating-force inputting means and the locked-state switch-over means for the front side door and the internal operating-force inputting means and the locked-state switch-over means for the rear side door can selectively be mounted to the cover. With such arrangement, since the common unit is formed of the casing and the plurality of common parts mounted to the casing, a portion of the door lock device can be assembled without distinction between the use in the front side door and the use in the rear side door. In addition, since any of the internal operating-force inputting means and the locked-state switch-over means for the front side door and the internal operating-force inputting means and the locked-state switch-over means for the rear side door can be selectively mounted to the cover common to the front side door and the rear side door, the assemblability of the door lock device can be enhanced, and the large number of parts can be used commonly in the door lock devices for the front side door and the rear side door, thereby providing a reduction in cost, while facilitating the management of the parts.

According to a fourteenth aspect and feature of the present invention, in addition to the arrangement of the first feature, the cover mounted to the casing to cover the locked-state switch-over means comprises a cover body made of a synthetic resin and a support plate coupled to the cover body, and the internal operating-force inputting means includes an input lever which is turnably supported on a support shaft integrally provided on the cover body with a tip end of the support shaft supported on the support plate. With such arrangement, since the input lever of the internal operating-force inputting means is turnably supported on the support shaft integrally provided on the cover body made of the synthetic resin, the number of parts can be reduced and the assembling operation can be facilitated, as compared with a case where the input lever is supported using a rivet or rivets. Moreover, since the tip end of the support shaft integral with the cover body is supported on the support plate coupled to the cover body, the support shaft is dual-supported, or supported at two locations, whereby the strength of supporting of the input lever can be enhanced.

According to a fifteenth aspect and feature of the present invention, in addition to the arrangement of the fourteenth feature, the internal operating-force inputting means for a front side door comprises a single input lever turnably supported on the support shaft for turning the open lever in response to inputting of a door opening operation force; the internal operating-force inputting means for a rear side door includes a first input lever turnably supported on the support shaft so as to be capable of receiving the door opening operation force, and a second input lever connected to the open lever and turnably supported on the support shaft, such that the connection and disconnection of the second input lever to and from the first input lever can be switched over from one to another; and the support shaft is formed into a stepped fashion and includes a large-diameter support portion on which the second input lever included in the internal operating-force inputting means for the rear side door can be turnably supported, and a small-diameter support portion which is coaxially connected to the large-diameter support portion and which selectively and turnably supports the single input lever included in the internal operating-force inputting means for the front side door and the first input lever included in the internal operating-force inputting means for the rear side. With such arrangement, the input lever of the internal operating-force inputting means can be supported on the support shaft, even when it is used for the front side door or for the rear side door. Therefore, the cover can be used commonly for the front side door and for the rear side door, thereby simplifying the management of the parts or components.

The above and other objects, features and advantages of the invention will become apparent from the following description of the preferred embodiment taken in conjunction with the accompanying drawings.

BRIEF DESCRIPTION OF THE DRAWINGS

FIGS. 1 to 13 show a first embodiment of the present invention, wherein

FIG. 1 is a side view of a vehicle;

FIG. 2 is an enlarged sectional view taken along a line 2—2 in FIG. 1;

FIG. 3 is a sectional view taken along a line 3—3 in FIG. 2;

FIG. 4 is an enlarged sectional view taken along a line 4—4 in FIG. 2;

FIG. 5 is a view of a door lock device taken in the direction of an arrow 5 in FIG. 4;

FIG. 6 is a view showing a state with a surface plate of a casing removed from FIG. 5;

FIG. 7 is a partially cutaway view of the door lock device taken in the direction of an arrow 7 in FIG. 4;

FIG. 8 is a view showing a state with a cover removed from FIG. 7;

FIG. 9 is a view showing the casing, taken in the direction of an arrow 9 in FIG. 8;

FIG. 10 is a sectional view showing an open lever, an open link and a locking lever in connected states, taken along a line 10—10 in FIG. 7 with the locking lever being in an unlocking position;

FIG. 11 is a view similar to FIG. 10, but in a state in which the locking lever is in a locking position;

FIG. 12 is a view similar to FIG. 10, but when the open link has been stroked in the state in which the locking lever is in the unlocking position;

FIG. 13 is a view similar to FIG. 10, but when the locking lever has been operated by mistake toward the locking position in opening a door;

FIGS. 14 to 26 show a second embodiment of the present invention, wherein FIG. 14 is a sectional view similar to FIG. 2 showing the first embodiment, but according to the second embodiment;

FIG. 15 is a sectional view taken along a line 15—15 in FIG. 14;

FIG. 16 is an enlarged sectional view taken along a line 16—16 in FIG. 14;

FIG. 17 is a view of a door lock device as taken in the direction of an arrow 17 in FIG. 16;

FIG. 18 is a view showing a state with the surface plate of the casing removed from FIG. 17;

FIG. 19 is a view of the door lock device taken in the direction of an arrow 19 in FIG. 16;

FIG. 20 is a view showing a state with the cover removed from FIG. 19

FIG. 21 is a view showing the casing, taken in the direction of an arrow 21 in FIG. 20;

FIG. 22 is an enlarged sectional view taken along a line 22—22 in FIG. 19;

FIG. 23 is an enlarged sectional view taken along a line 23—23 in FIG. 19;

FIG. 24 is a sectional view taken along a line 24—24 in FIG. 19;

FIG. 25 is an enlarged sectional view taken along a line 25—25 in FIG. 16;

FIG. 26 is an enlarged sectional view taken along a line 26—26 in FIG. 16;

FIGS. 27 to 49 show a third embodiment of the present invention, wherein FIG. 27 is a view similar to FIG. 2 in the first embodiment, but showing a door lock device for a front side door according to the third embodiment;

FIG. 28 is a sectional view taken along a line 28—28 in FIG. 27;

FIG. 29 is an enlarged sectional view taken along a line 29—29 in FIG. 27;

FIG. 30 is a view of the door lock device for the front side door, taken in the direction of an arrow 30 in FIG. 29;

FIG. 31 is a view showing a state in which the surface plate of the casing has been removed from FIG. 30;

FIG. 32 is a partially cutaway view of the door lock device for the front side door, taken in the direction of an arrow 32 in FIG. 29;

FIG. 33 is a view showing a state in which the cover has been removed from FIG. 32;

FIG. 34 is a view of the casing taken in the direction of an arrow 34 in FIG. 33;

FIG. 35 is an enlarged sectional view taken along a line 35—35 in FIG. 32;

FIG. 36 is an enlarged sectional view taken along a line 36—36 in FIG. 3;

FIG. 37 is an enlarged sectional view taken along a line 37—37 in FIG. 32;

FIG. 38 is an enlarged sectional view taken along a line 38—38 in FIG. 28;

FIG. 39 is a sectional view taken along a line 39—39 in FIG. 32;

FIG. 40 is an enlarged sectional view similar to FIG. 27, but showing a door lock device for a rear side door;

FIG. 41 is a sectional view taken along a line 41—41 in FIG. 40;

FIG. 42 is an enlarged sectional view taken along a line 42—42 in FIG. 40;

FIG. 43 is a partially cutaway view of the door lock device for the rear side door, taken in the direction of an arrow 43 in FIG. 42;

FIG. 44 is an enlarged sectional view taken along a line 44—44 in FIG. 41;

FIG. 45 is a view showing an internal operating-force inputting means when a child lock mechanism is in an unlocked state;

FIG. 46 is a view similar to FIG. 45, but in a state in which an operating force has been inputted;

FIG. 47 is a view showing an internal operating-force inputting means when the child lock mechanism is in a locked state;

FIG. 48 is a view similar to FIG. 47, but in a state in which the operating force has been inputted; and FIG. 49 is an enlarged sectional view taken along a line 49—49 in FIG. 41.

DETAILED DESCRIPTION OF THE PREFERRED EMBODIMENTS

A first embodiment of the present invention will now be described by way of an embodiment with reference to FIGS. 1 to 13.

Figure 1:
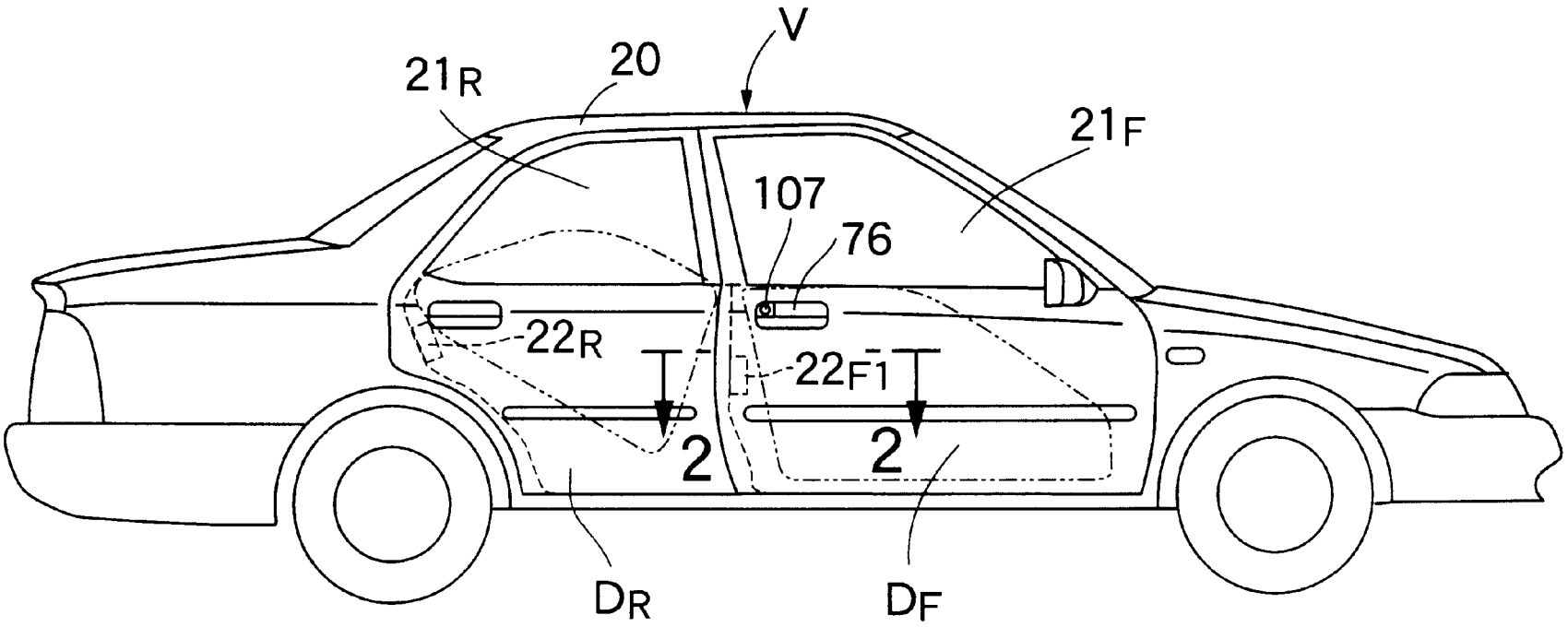

Referring first to FIG. 1, a pair of left and right front side doors $D_F$ having liftable window glass panes $\mathbf{21}_F$ are turnably pivoted at one ends thereof at front portions of opposite sides of a vehicle body 20 in an automobile vehicle V, and a pair of left and right rear side doors $D_R$ having liftable window glass panes $\mathbf{21}_R$ are turnably pivoted at one ends thereof at an intermediate portion (a pillar which is not shown) of the vehicle body 20 in a traveling direction. Door lock devices $\mathbf{22}_{F1}$ for maintaining closed states of the front side doors $D_F$ are mounted at the other ends of the front side doors $D_F$, respectively, and door lock devices $\mathbf{22}_R$ for maintaining closed states of the rear side doors $D_R$ are mounted at the other ends of the rear side doors $D_R$.

The door lock devices $\mathbf{22}_{F1}$ and $\mathbf{22}_R$ have basically the same construction, and the door lock device $\mathbf{22}_{F1}$ mounted on the front side door $D_F$ will be described below.

Figure 2:
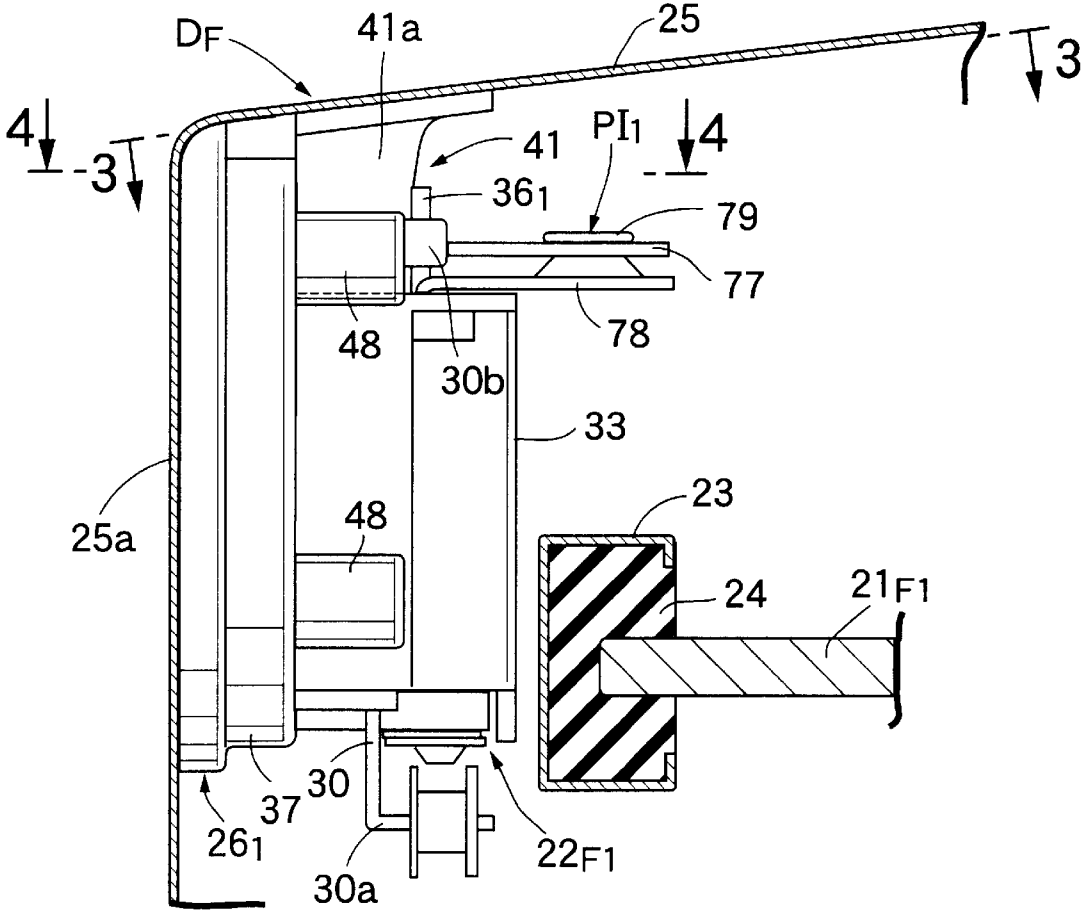
Figure 3:
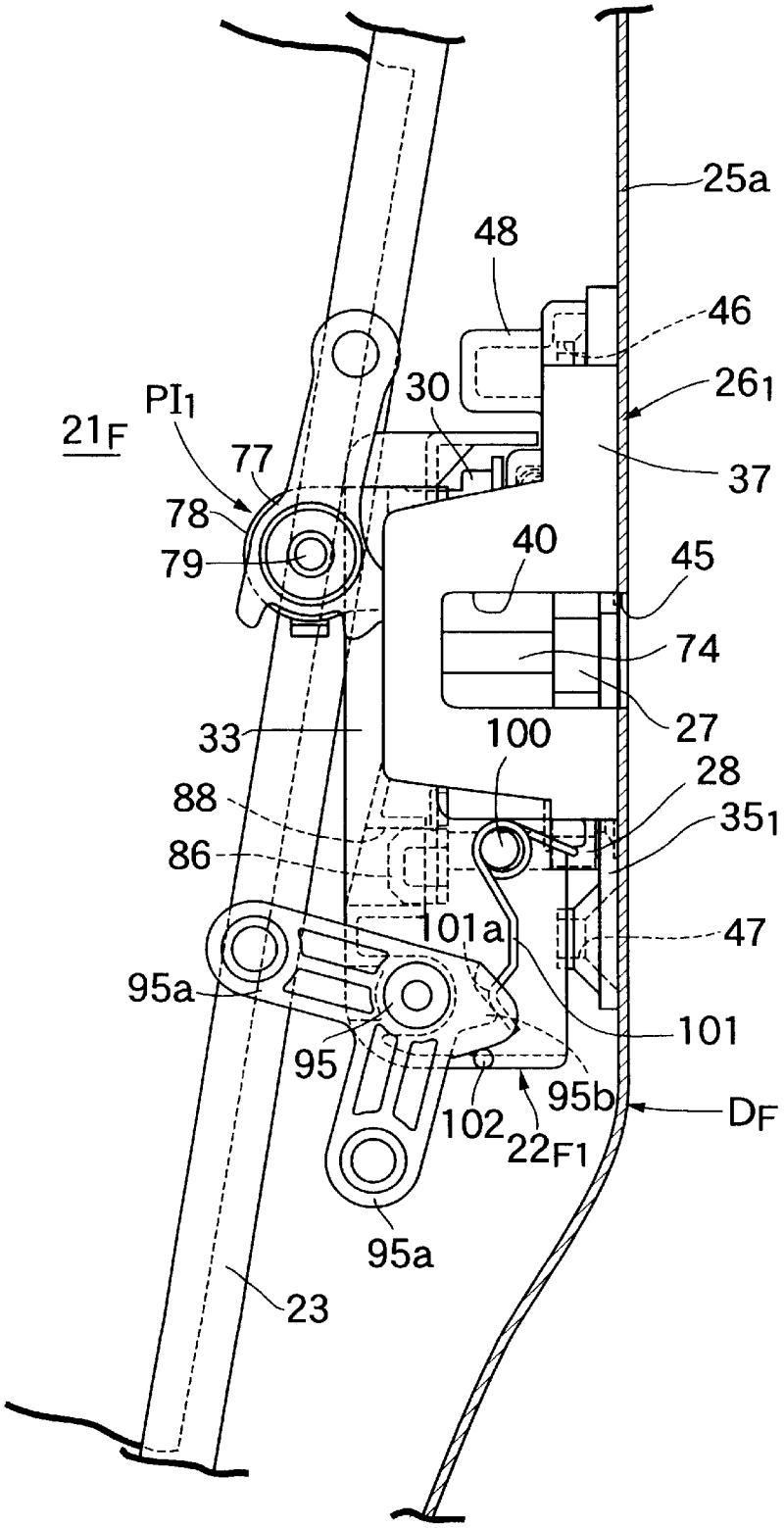
Figure 4:
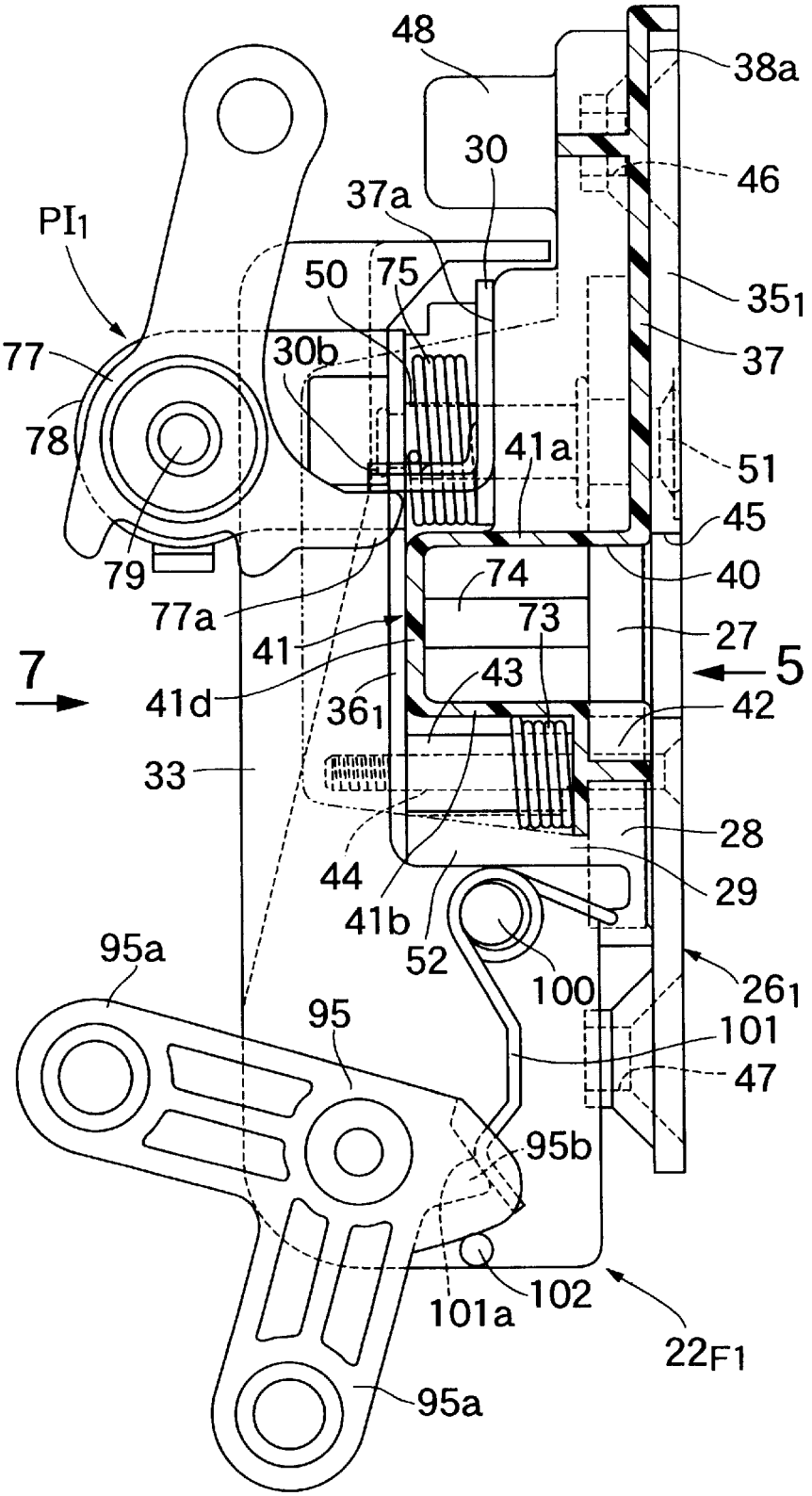
Figure 5:
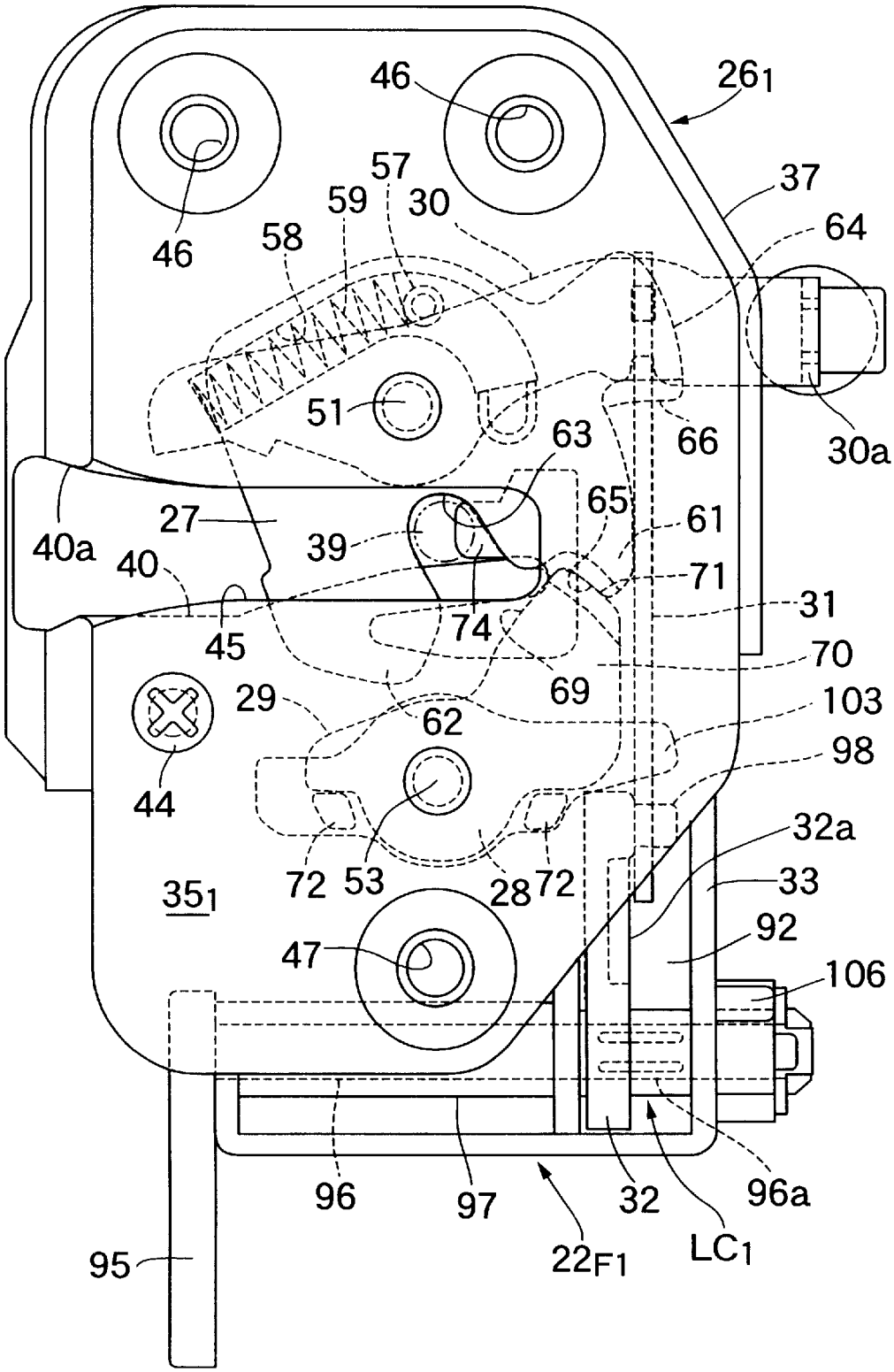

Referring also to FIGS. 2 and 3, a glass sash 23 is mounted within the front side door $D_F$, and the lifting and lowering movements of the window glass pane $\mathbf{21}_F$ are guided by a door glass run 24 made of an elastomer material such as a rubber retained in the glass sash 23.

An end wall 25*a* opposed to a pillar (not shown) during closing of the front side door $D_F$ is integrally formed on an inner panel 25 of the front side door $D_F$, and the door lock device $\mathbf{22}_{F1}$ is coupled to an inner surface of the end wall 25*a* in such a manner that the interference with the glass sash 23 is avoided.

Referring also to FIGS. 4 to 8, the door lock device $\mathbf{22}_{F1}$ includes a casing $\mathbf{26}_1$ fastened to the end wall 25*a*, a latch 27 turnably supported on the casing $\mathbf{26}_1$, a ratchet 28 turnably supported on the casing $\mathbf{26}_1$ for engagement with the latch 27, a ratchet lever 29 engaged with and connected to the ratchet 28 for turning movement in unison with the ratchet 28, and an open lever 30 turnably carried on the casing 26 so as to be capable of receiving an operating force for releasing the locked state in which the ratchet 28 has been engaged with the latch 27. The door lock device $\mathbf{22}_{F1}$ further includes an internal operating force inputting means $PI_1$ connected to the open lever 30, so that it can transmit a door opening operation force depending on a door opening operation in the inside of the vehicle to the open lever 30, a locked-state switch-over means $LC_1$ which is capable of switching-over an unlocked state in which the ratchet lever 29 and the ratchet 28 can be operated from their engaged positions to their disengaged positions in response to the turning movement of the open lever 30 following the input of the door opening operation force, and a locked state in which the operations of the ratchet lever 29 and the ratchet 28 from the engaged state to the disengaged state cannot be conducted, irrespective of the turning movement of the open lever 30 following the input of the door opening operation force, and a cover 33 mounted to the casing $\mathbf{26}_1$ to cover the ratchet 28, the ratchet lever 29 and most of the open lever 30 and the locked-state switch-over means $LC_1$.

Figure 9:
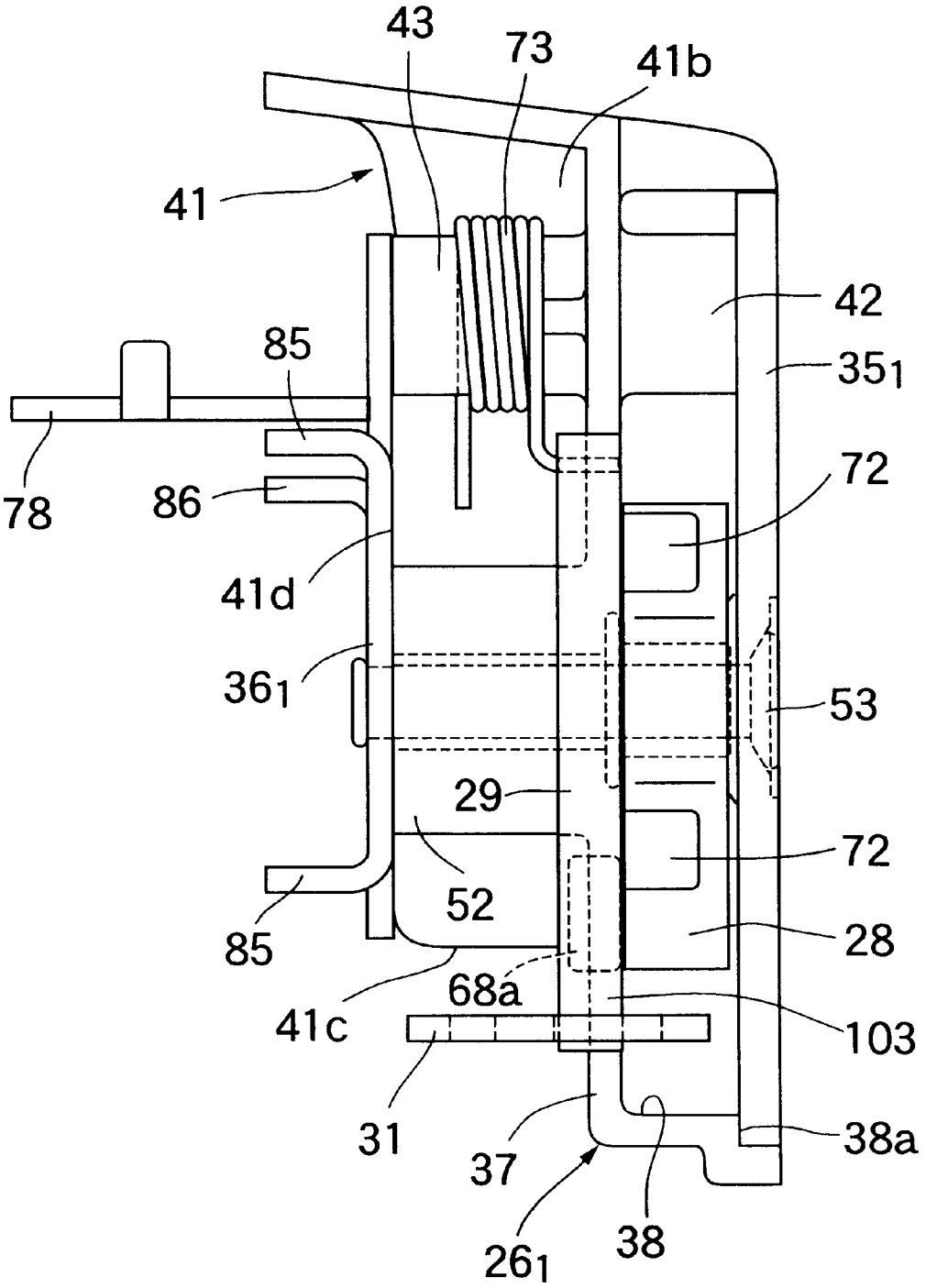

Referring also to FIG. 9, the casing $\mathbf{26}_1$ comprises a casing body 37 of a synthetic resin clamped between a surface plate $\mathbf{35}_1$ and a back plate $\mathbf{36}_1$ made of a metal. A recess 38 with its lower end opened is provided in a surface of the casing body 37 which is opposed to the surface plate $\mathbf{35}_1$, a step 38*a* is formed at an opened end of the recess 38 on the side of the surface plate $\mathbf{35}_1$. The surface plate $\mathbf{35}_1$ formed into a flat plate shape is fitted into the recess 38 in such a manner that it is received at the step 38*a*. A lower portion of the surface plate $\mathbf{35}_1$ protrudes downwards from a lower portion of the casing body 37.

The casing body 37 is integrally provided with a bulged portion 41 which is bulged away from the surface plate $\mathbf{35}_1$, and an ingress passage 40, which opens into the recess 38, is defined by the bulged portion 41 to permit the entering of a striker 39 (see FIG. 6) fixed to the pillar of the vehicle body 20. More specifically, the bulged portion 41 is comprised of upper and lower sidewalls 41*a* and 41*b* forming upper and lower inner sides of the ingress passage 40, an end wall 41*c* which connects inner ends of both the sidewalls 41*a* and 41*b* to each other in such a manner that it is opposed to an inlet 40*a* of the ingress passage 40, and a connecting wall 41*d* which connects both the sidewalls 41*a* and 41*b* and the end wall 41*c* to each other.

A cylindrical boss portion 42 is integrally provided in a projecting manner on a lower portion of a section of the casing body 37 which is opposed to the surface plate $\mathbf{35}_1$, with a tip end face of the boss portion 42 being connected flush to the step 38*a*. A cylindrical boss portion 43 corresponding to the boss portion 42 is integrally provided in a projecting manner on the casing body 37 on the opposite side from the surface plate $\mathbf{35}_1$ in such a manner that its tip end face is disposed at the same level as an outer surface of the connecting wall 41*d* of the bulged portion 41. A screw member 44, which is inserted through the surface plate $\mathbf{35}_1$ fitted in the recess 38 in such a manner that it is received at the step 38*a* and the boss portion 42 and through both the boss portions 42 and 43, is threadedly engaged with the back plate $\mathbf{36}_1$ put into abutment against the connecting wall 41*d* of the bulged portion 41 and the tip end face of the boss portion 43.

A flat support surface 37*a* is formed on the casing body 37 in an opposed relation to the back plate $\mathbf{36}_1$ at a location above the bulged portion 41, and a cylindrical boss portion 50 is integrally provided on the casing body 37 to protrude from the support surface 37*a* to abut against the back plate $\mathbf{36}_1$. The surface plate $\mathbf{35}_1$, the casing body 37 and the back plate $\mathbf{36}_1$ are coupled together by a rivet shaft 51 extending through the boss portion 50. A protrusion support portion 52, which is connected flush to the connecting plate portion 41*b* and protrudes downwards, is integrally connected to the lower sidewall 41*b* of the bulged portion 41. The surface plate $\mathbf{35}_1$, the casing body 37 and the back plate $\mathbf{36}_1$ are coupled together by a rivet shaft 53 extending through the protrusion support portion 52.

In this manner, the surface plate $\mathbf{35}_1$, the back plate $\mathbf{36}_1$ and the casing body 37 are coupled by the screw member 44 and the pair of rivet shafts 51 and 53 in such a manner that the casing body 37 is sandwiched between the surface and back plates $\mathbf{35}_1$ and $\mathbf{36}_1$, thereby forming the casing $\mathbf{26}_1$.

An opening 45 corresponding to the ingress passage 40 is provided in the surface plate $\mathbf{35}_1$. A pair of threaded bores 46, 46 are provided in an upper portion of the surface plate $\mathbf{35}_1$, and a single threaded bore 47 is provided in a lower portion of the surface plate $\mathbf{35}_1$ at a portion protruding downwards from the casing body 37. The surface plate $\mathbf{35}_1$ and the casing $\mathbf{26}_1$ are fastened to the end wall 25*a* of the inner panel 25 in the front side door $D_F$ by bolts (not shown) which are threadedly inserted into the threaded bores 46, 46 and 47, respectively. In a state in which the casing $\mathbf{26}_1$ has been mounted to the front side door $D_F$, the bulged portion 41 of the casing body 37 is bulged inwards of the front side door $D_F$, i.e., toward the glass sash 23.

Accommodating cylindrical portions 48, 48 formed into a bottomed cylinder shape are integrally provided on the casing body 37 at locations corresponding to the two threaded bores 46, 46 in the upper portion of the surface plate $\mathbf{35}_1$ to accommodate the bolts screwed into the threaded bores 46, 46, so that they open into the recess 38.

The latch 27 is inserted between the surface plate $\mathbf{35}_1$ and the casing body 37 of the casing $\mathbf{26}_1$ and turnably carried by the rivet shaft 51. The ratchet 28 and the ratchet lever 29 are disposed in a superposed manner between the surface plate $\mathbf{35}_1$ and the protrusion support portion 52 and turnably carried by the common rivet shaft 53. Namely, the latch 27 is turnably supported on the casing $\mathbf{26}_1$ above the ingress passage 40, while the ratchet 28 and the ratchet lever 29 are turnably supported on the casing $\mathbf{26}_1$ below the ingress passage 40 in such a manner that the ingress passage 40 is sandwiched between the ratchet 28 as well as the ratchet lever 29 and the latch 27. Moreover, the rivet shafts 51 and 53 have parallel axes, and the latch 27 and the ratchet 28 as well as the ratchet lever 29 are turnable about parallel axes.

Figure 6:
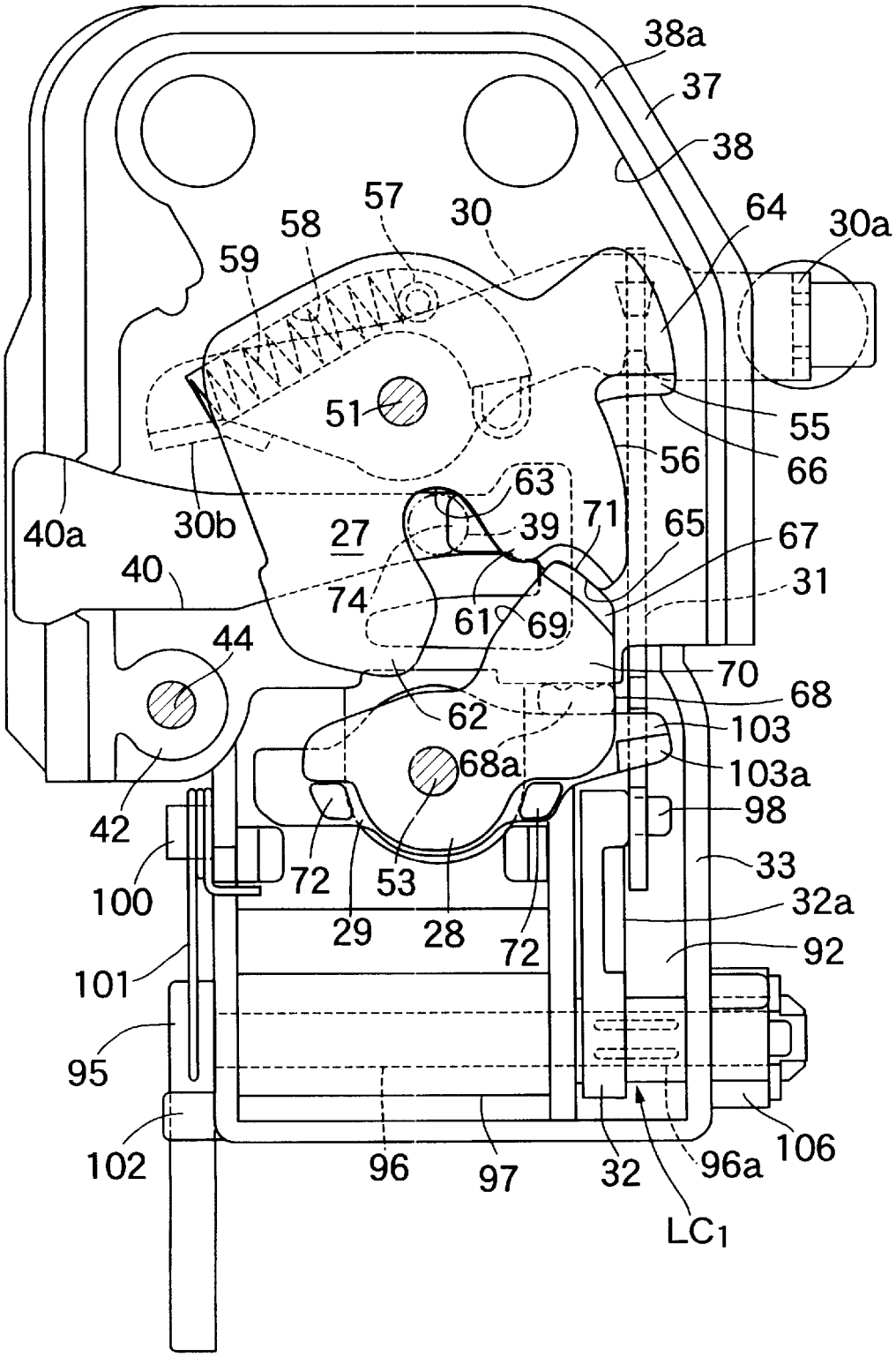

Referring particularly to FIG. 6, the latch 27 includes a latch body 55 made of a metal, most of which is covered with a covering member 56 made of a synthetic resin, and a pin 57 is projectingly provided on a surface of the latch 27 which is opposed to the casing body 37. On the other hand, an accommodating groove 58 in which the pin 57 is inserted is provided in the casing body 37 in an arcuate shape about the axis of the rivet shaft 51, and a coiled spring 59 is provided under compression between one end of the accommodating groove 58 and the pin 57 and accommodated within the accommodating groove 58. Thus, the latch 27 is biased for turning movement in a door opening direction (in a clockwise direction in FIG. 6). The end of the turning movement of the latch 27 in the door opening direction is defined by the abutment of the pin 57 against the other end of the accommodating groove 58.

The latch 27 is provided with (1) a first leg 61 which protrudes outwards, so that it is opposed to the inlet 40*a* of the ingress passage 40 when the latch 27 is at the end of the turning movement in the door opening direction, (2) a second leg 62 which protrudes outwards in front of the first leg 61 in the door opening direction to define an engage groove 63 engaged by the striker 39 entering the ingress passage 40 between the second leg 62 and the first leg 61, and (3) a protrusion 64 which protrudes outwards so as to be stepped with respect to the first leg 61 in rear of the first leg 61 in the door opening direction. A full-engage step 65 is formed at a portion of the tip end of the first leg 61 which faces forwards in the door opening direction in such a manner that the latch body 55 is torn off, and a half-engage step 66 is formed at a portion of the protrusion 64 which faces forwards in the door opening direction in such a manner that the latch body 55 is torn off.

On the other hand, the ratchet 28 also comprises a ratchet body 67 made of a metal, most of which is covered with a covering member made of a synthetic resin. The ratchet 28 is integrally provided with an engage arm portion 70 which has, at one side thereof, a sliding-contact surface 69 capable of coming into sliding contact with outer peripheries of the first leg 61 and the protrusion 64 of the latch 27 and which protrudes toward the latch 27. A locking surface 71 capable of engaging with the full-engage step 65 and the half-engage step 66 of the latch 27 is formed at a tip end of the engage arm portion 70 in such a manner that the ratchet body 67 is torn off.

The ratchet lever 29 is formed from a synthetic resin and turnably carried by the rivet shaft 53 common to the ratchet 28 in such a manner that it is sandwiched between the protrusion support portion 52 of the casing body 37 and the ratchet 28. Moreover, a pair of engage pins 72, 72 are integrally provided in a projecting manner on the ratchet lever 29 for engagement with the ratchet 28 to inhibit the relative turning movement of the ratchet lever 29 relative to the ratchet 28. More specifically, the ratchet lever 29 is disposed coaxially in a superposed relation to the ratchet 28, so that it is turned in unison with the ratchet 28.

A torsion spring 73 is mounted between the casing body 37 and the ratchet lever 29 to surround the boss portion 43 through which the screw member 44 is inserted, so that the ratchet 28 turnable in unison with the ratchet lever 29 is biased for turning movement in a direction (in a counterclockwise direction in FIG. 6) to engage the latch 27 by a spring force of the torsion spring 73.

The end of the turning movement of the ratchet 28 turnable in unison with the ratchet lever 29 in the direction to engage the latch 27 is defined by the abutment of a resilient stopper 68*a* provided on the ratchet 28 against a lower side end of the casing body 37. The resilient stopper 68*a* is formed integrally with the covering member 68 of the ratchet 28 so as to protrude from the ratchet 28 in a direction parallel to the turning axis of the ratchet 28, and is put into abutment against the lower side end of the casing body 37 with a resiliency. Moreover, the ratchet lever 29 is provided with an engage arm portion 103 which extends toward an open link 31 which is a component of the locked-state switch-over means $LC_1$. The engage arm portion 103 is disposed so as to support the resilient stopper 68*a* from the side opposite from the lower side end of the casing body 37.

When the latch 27 is at the end of the turning movement in the door opening direction, the sliding-contact surface 69 of the ratchet 28 is in contact with the outer periphery of the protrusion 64 of the ratchet 28. When the first leg 61 is pushed by the striker 39 entering the ingress passage 40 to turn the latch 27 in a door closing direction (in the counterclockwise direction in FIG. 6), the striker 39 is brought into engagement with the engage groove 63, and the sliding-contact surface 69 of the ratchet 28 is shifted from the outer periphery of the protrusion 64 to a position of contact with the outer periphery of the first leg 61. In this case, a half-closed state of the front side door $D_F$ is maintained by engagement of the locking surface 71 of the ratchet 28 with the half-engage step 66. When the latch 27 is further turned in the door closing direction as the striker 39 engaged in the engage groove 63 is further moved inwards within the ingress passage 40, the locking surface 71 of the ratchet 28 having the sliding-contact surface 69 in sliding contact with the outer periphery of the first leg 61 is brought into engagement with the full-engage step 65. Thus, the front side door $D_F$ is locked in a completely closed state by the engagement of the locking surface 71 with the full-engage step 65.

A stopper 74 made of a rubber is fitted and fixed to the casing body 37 to face an inner end of the ingress passage 40 and adapted to abut against the striker 39 entering the ingress passage 40 to define the end of entering of the striker 39.

The open lever 30 is formed to extend over a long distance in a direction along a lengthwise direction of the bulged portion 41 of the casing body 37 above the bulged portion 41, and a lengthwise intermediate portion of the open lever 30 is turnably carried on the boss portion 50, while being in sliding contact with the support surface 37*a* of the casing body 37. A torsion spring 75 is mounted between the open lever 30 and the casing body 37 to surround the boss portion 50 between the lengthwise intermediate portion of the open lever 30 and the back plate $36_1$, so that the open lever 30 is biased for turning movement in a clockwise direction in FIG. 8 by a spring force of the torsion spring 75.

Figure 8:
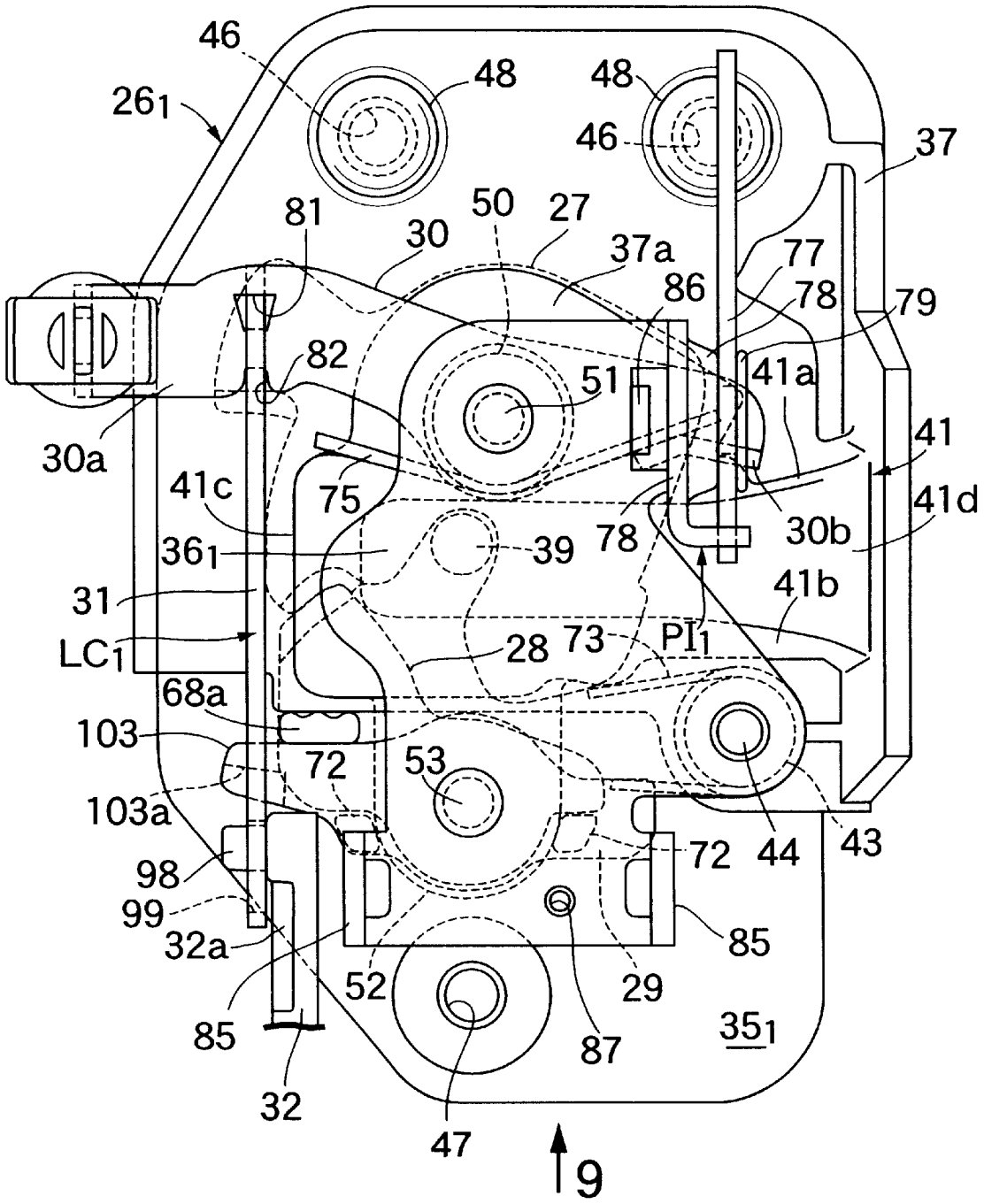

A lengthwise one end 30*a* of the open lever 30 protrudes from the casing $26_1$ in such a manner that it is located outside the window glass pane $21_F$ within the front side door $D_F$, and an operating force depending on the operation of an outside handle 76 (see FIG. 1) mounted on an outer surface of the front side door $D_F$ is inputted to the one end 30*a* to turn the open lever 30 in a counterclockwise direction in FIG. 8 against the spring force of the torsion spring 75.

The internal operating force inputting means $P_1$ comprises an input lever 77 which is turnably carried on a bracket 78 integrally provided on the back plate $36_1$ through a support shaft 79 having an axis in a direction perpendicular to the turning axis of the open lever 30, and an urging portion 77*a* is integrally provided on the input lever 77. On the other hand, an input plate portion 30*b* is integrally provided at the lengthwise other end of the open lever 30 and substantially opposed to the upper portion, i.e., the upper sidewall 41*a* of the bulged portion 41 of the casing body 37. The urging portion 77*a* is capable of being brought into contact with the input plate portion 30*b*.

The input lever 77 is turned in a direction (in a counterclockwise direction in FIG. 4) to urge the input plate portion 30*b* of the open lever 30 by the urging portion 77*a* in response to the operation of an inside handle (not shown) mounted on an inner surface of the front side door $D_F$. The open lever 30 is turned in the counterclockwise direction in FIG. 8 against the spring force of the torsion spring 75 by the turning movement of the input lever 77 in response to the operation of the inside handle.

Namely, the open lever 30 is turned in the counterclockwise direction in FIG. 8 by operating either of the outside handle 76 and the inside handle, and the range of turning movement of the open lever 30 is defined by the abutment of the open lever 30 against the upper sidewall 41*a* of the bulged portion 41.

Figure 10:
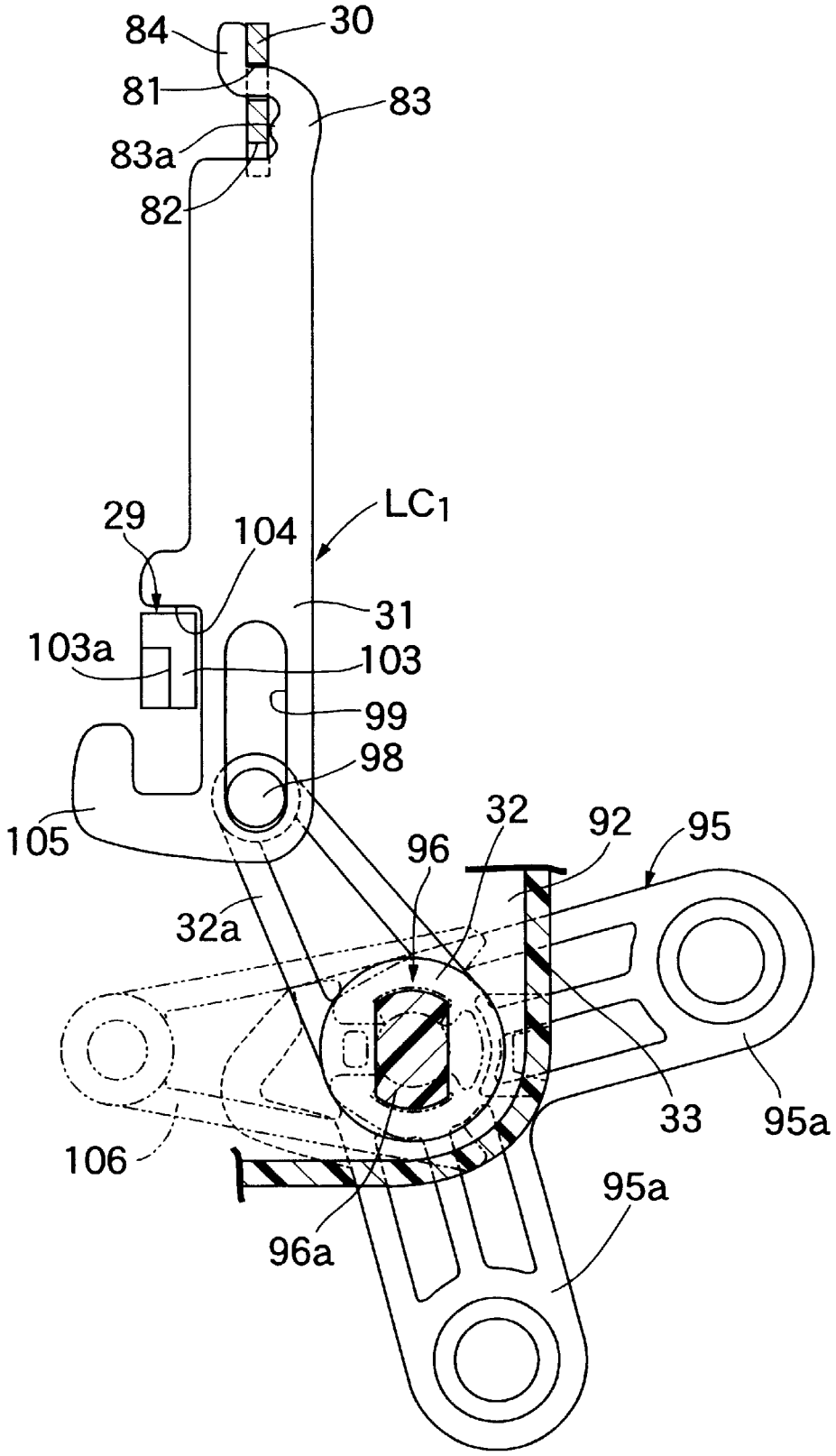

Referring also to FIG. 10, the lock-state switch-over means $LC_1$ is comprised of the open link 31 connected at its one end to the open lever 30, a locking lever 32 connected to the other end of the open link 31 for operation between an unlocking position in which an operating force for operating the ratchet lever 29 and the ratchet 28 from their engaged positions to their disengaged positions in response to the operation of the open lever 30 can be transmitted from the open link 31 to the ratchet lever 29, and a locking position in which the transmission of the operating force from the open link 31 to the ratchet lever 29 cannot be permitted irrespective of the operation of the open lever 30, a knob lever 95 coaxially connected to the locking lever 32, and a cylinder lever 106 coaxially connected to the knob lever 95.

The open link 31 is disposed sideways of the bulged portion 41 on the side opposite from the inlet 40*a* of the ingress passage 40 to extend upwards and downwards along a plane perpendicular to the lengthwise direction of the ingress passage 40.

A connecting bore 81 is provided in the open lever 30 at the middle between one end 30*a* of the open lever 30 and the boss portion 50, and a rectangular notch 82 is provided in a side edge of the lower portion of the open lever 30 at a location corresponding to the connecting bore 81. On the other hand, one end, i.e., an upper end of the open link 31 is inserted and engaged into the notch 82, and an extension arm 83 opposed to a surface of the open lever 30 opposite from the casing body 37 is integrally connected at its base end to the one end of the open link 31. An engage arm portion 84 formed into a substantially L-shape and inserted into the connecting bore 81 is integrally connected to a tip end of the extension arm 83. The extension arm 83 is integrally provided with a protrusion 83*a* bulged in a semi-circular shape to come into contact with the surface of the open lever 30 opposite from the casing body 37.

With such a structure in which the one end of the open link 31 has been engaged with and connected to the open lever 30, the open link 31 is operated so that it is stroked toward the other end in the lengthwise direction of the open link 31, i.e., downwards in response to the turning movement of the open lever 30 in the counterclockwise direction in FIG. 8 with the operation of either of the outside handle 76 and the inside handle. In this case, the connecting bore 81 and the notch 82 are defined to permit the operation of the open link 31 within a plane perpendicular to the lengthwise direction of the ingress passage 40, irrespective of the turning operation of the open lever 30. The open link 31 is capable of being swung within the plane perpendicular to the lengthwise direction of the ingress passage 40 about a point of contact of the protrusion 83*a* at one end of the open link 31 with the open lever 30.

The cover 33 is formed from a synthetic resin into a box shape with a portion on the side of the casing $\mathbf{26}_1$ being opened, and is fastened to the casing $\mathbf{26}_1$ to cover the side of the casing $\mathbf{26}_1$ opposite from the surface plate $\mathbf{35}_1$, i.e., adjacent the glass sash 23. To fasten the cover 33, a pair of positioning protrusions 85, 85 are integrally provided at the lower portion of the back plate $\mathbf{36}_1$ of the casing $\mathbf{26}_1$ at a distance spaced apart from each other in the lengthwise direction of the ingress passage 40 to protrude toward the cover 33. A threaded bore 87 is provided in the lower portion of the back plate $\mathbf{36}_1$, so that it is located at the middle between both of the positioning protrusions 85, 85, and a single positioning protrusion 86 is integrally provided at the upper portion of the back plate $\mathbf{36}_1$ at a location spaced apart from the bracket 78 to protrude toward the cover 33. On the other hand, the cover 33 is provided with positioning bores 88, 88 into which the positioning protrusions 85, 85 are fitted, and a bottomed positioning bore 89 into which the positioning protrusion 86 is fitted. In a state in which the cover 33 has been positioned relative to the casing $\mathbf{26}_1$ by fitting the positioning protrusions 85, 85 and 86 into the corresponding positioning bores 88, 88 and 89, respectively, a screw member 90 inserted through the cover 33 is screwed into the threaded bore 87 in the back plate $\mathbf{36}_1$.

In a state in which the cover 33 has been attached to the casing $\mathbf{26}_1$ in the above manner, the ratchet 28, the ratchet lever 29, most of the open lever 30, the open link 31 and the locking lever 32 are covered with the cover 33, and the opposite ends of the open lever 30 protrude in opposite sideways directions from the cover 33.

Figure 7:
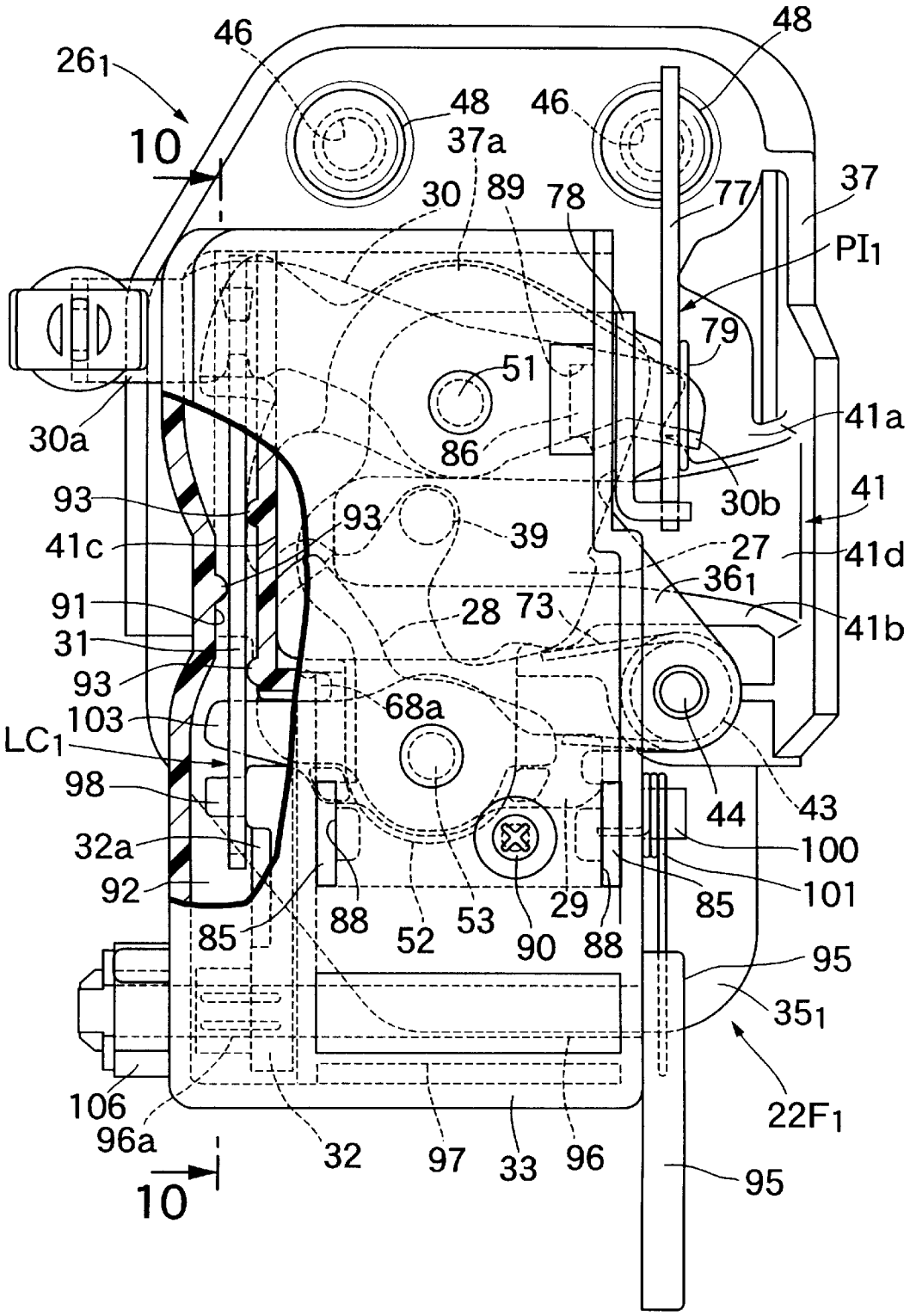

A guide groove 91 for guiding of the open link 31 operated within the plane perpendicular to the lengthwise direction of the ingress passage 40 is provided in the cover 33 to extend over a long distance along such plane, and an operating chamber 92, in which the locking lever 32 is accommodated for operation, is defined in the cover 33 to lead to a lower end of the guide groove 91. Moreover, a plurality of ribs 93 are fixedly mounted on an inner side of the guide groove 91 to come into sliding contact with opposite sides of the open link 31, as best shown in FIG. 7. The ribs 93 may be formed integrally with the cover 33, as shown, or may be formed of an elastomeric material such as a rubber different from a material for the cover 33, which is fixedly provided on the inner sides of the guide groove 91 by affixing or the like.

A knob lever 95 is carried at the lower portion of the cover 33 for turning movement about a turning axis that extends on a plan perpendicular to the turning axes of the ratchet 28 and the ratchet lever 29 and extending substantially in the lengthwise direction of the ingress passage 40, so that it is turned in response to the operation of an operating knob (not shown) provided on the inner surface of the front side door $D_F$.

The knob lever 95 is disposed inside the cover 33 within the front side door $D_F$, and is formed from a synthetic resin and integrally provided with a shaft section 96 having the same axis as the turning axis of the knob lever 95. The cover 33 has a cylindrical support shaft section 97 integrally provided thereon at a location excluding the operating chamber 92, with the shaft section 96 being turnably fitted in the cylindrical support shaft section 97.

The shaft section 96 has a connecting shaft portion 96*a* which is formed thereon at a location corresponding to the inside of the operating chamber 92 and which has, for example, a non-circular cross-sectional shape having flat surfaces parallel to each other along a diametric line of the shaft section 96. The connecting shaft portion 96*a* is fitted in the locking lever 32 fitted in the cover 33 at a location corresponding to the operating chamber 92, so that the axial movement of the connecting shaft portion 96*a* is inhibited. Thus, the locking lever 32 is connected to the shaft section 96, i.e., the knob lever 95 for non-turning movement relative to each other.

The locking lever 32 is integrally provided with a connecting arm portion 32*a* extending toward the open link 31, and a pin 98 projectingly provided at a tip end of the connecting arm portion 32*a* is engaged and connected in an elongated bore 99 which is provided in the other end, i.e., the lower portion of the open link 31 to extend in the lengthwise direction of the open link 31.

Figure 11:
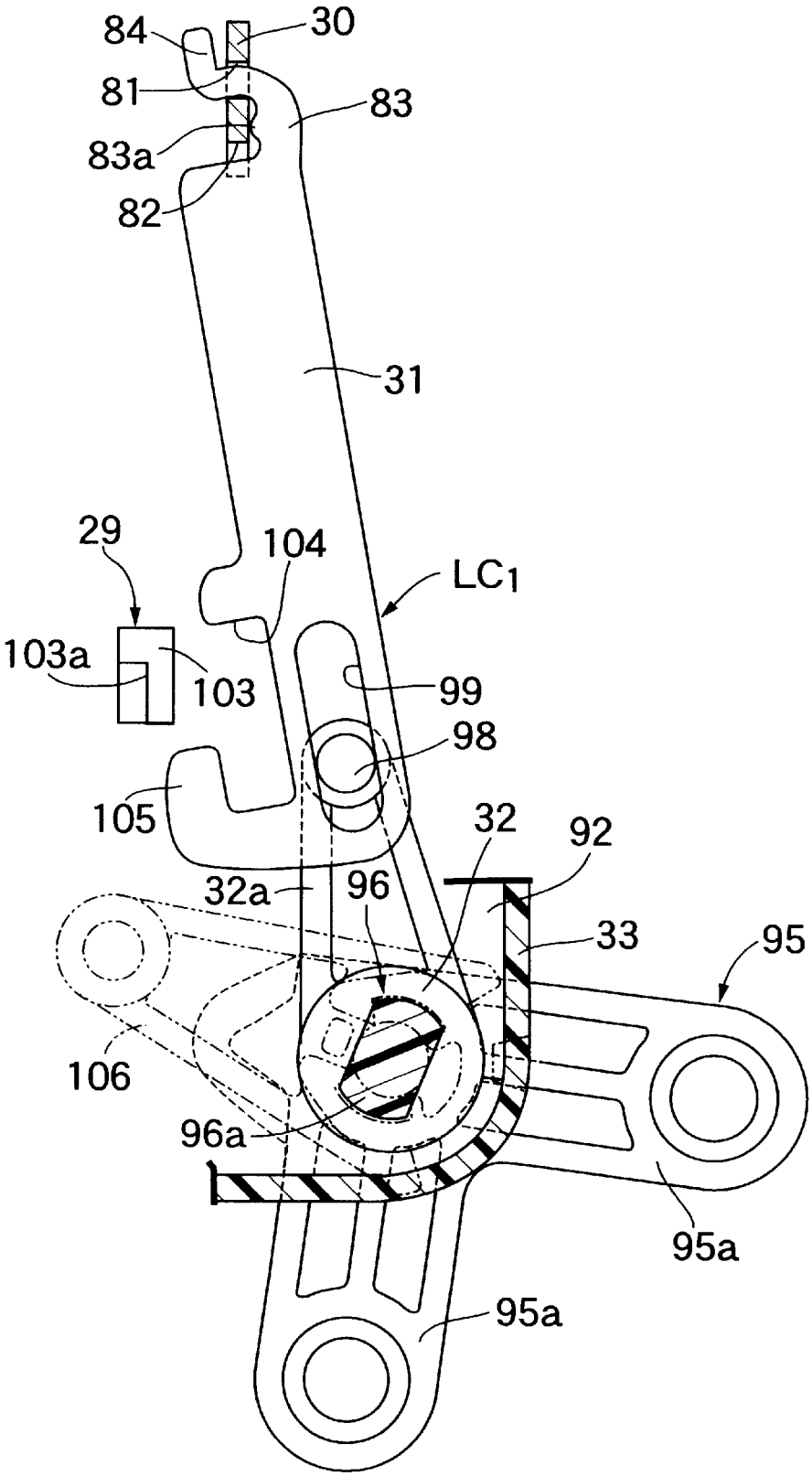

The locking lever 32 is capable of being turned between the unlocking position shown in FIG. 10 and the locking position shown in FIG. 11 in response to the operation of the knob lever 95, and the open link 31 is also swung in response to the turning movement of the locking lever 32.

The knob lever 95 is integrally provided with a pair of lever portions 95*a*, 95*a* which form an angle of approximately 90 degree and which are connected to the operating knob (not shown) mounted on the inner surface of the front side door $D_F$ through a transmitting means which is not shown. Moreover, the knob lever 95 is provided with a triangular projection 95*b* having an apex directed toward the end wall 25*a* of the inner panel 25, and a torsion spring 101 engaged at its one end with the cover 33 surrounds a support pin 100 integrally provided on the cover 33, and extends to a position in which the other end thereof is opposed to the projection 95*b*. A triangular projection 101*a* having an apex directed toward the projection 95*b* is provided at the other end of the torsion spring 101, and the torsion spring 101 exhibits a spring force for urging the projection 101*a* against the projection 95*b* of the knob lever 95. Therefore, the knob lever 95 is turned against a resilient force of the torsion spring 101, so that the projection 95*b* climbs over the projection 101*a*, and the knob lever 95 and the locking lever 32 are turned moderately between the unlocking position and the locking position.

A stopper pin 102 is projectingly provided on the cover 33 and is capable of abutting against a side of the knob lever 95 to limit the turning movement of the knob lever 95 and the locking lever 32 in a range between the unlocking position and the locking position.

A cylinder lever 106 is mounted to an end of the shaft section 96 opposite from the knob lever 95 and is disposed sideways of the cover 33 to sandwich the cover 33 between the cylinder lever 106 and the knob lever 95. The cylinder lever 106 is turned about an axis of the shaft section 96 in response to a key operation of a key cylinder lock 107 (see FIG. 1) mounted in the front side door $D_F$ to face the outer surface of the front side door $D_F$, and is connected to the shaft section 96 for permitting turning movement relative to the shaft section 96 in a range limited around the axis.

The acceptable range of relative turning movement of the cylinder lever 106 and the shaft section 96 is set so that the force cannot be transmitted from the shaft section 96 to the cylinder lever 106, when the locking lever 32 is turned between the unlocking position and the locking position by the knob lever 95 integral with the shaft section 96. When the cylinder lever 106 is operated to turn the locking lever 32 between the unlocking position and the locking position, the knob lever 95 is also turned integrally with the shaft section 96.

Figure 12:
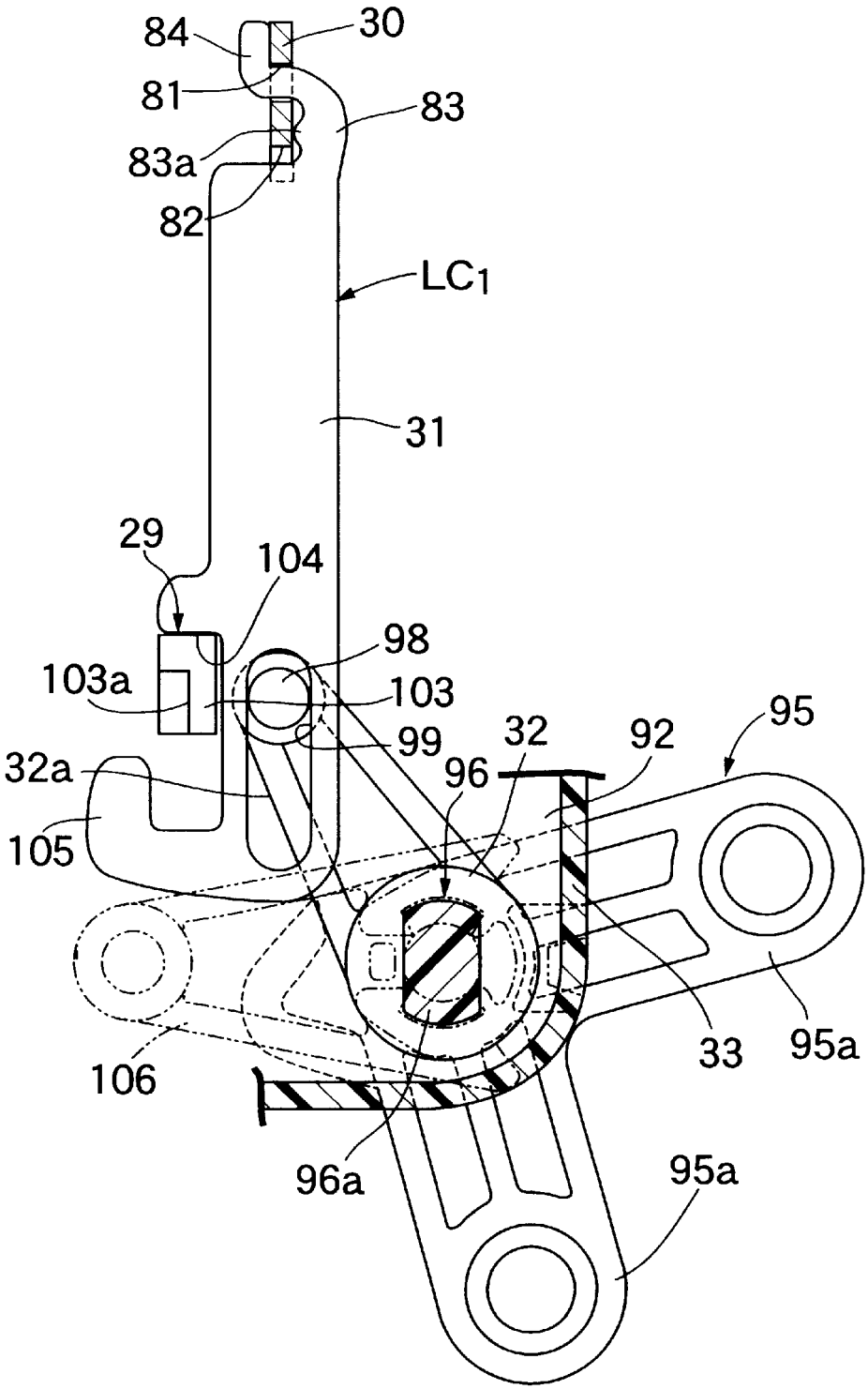

The engage arm portion 103 integrally provided on the ratchet lever 29 extends with its tip end disposed sideways of the open link 31 on the side of the surface plate $35_1$ within the operating chamber 92, and the open link 31 is provided with an urging surface 104 which is opposed to the tip end of the engage arm portion 103. When the locking lever 32 is in the unlocking position and moreover, the ratchet 28 is in a state in which its locking surface 71 has been brought into engagement with the full-engage step 65, i.e., in a state shown in FIG. 10, the urging force is applied from the urging face 104 to the engage arm portion 103, as the open link 31 is operated downwards as shown in FIG. 12 in response to the inputting of the operating force to the open lever 30. This causes the ratchet lever 29 to be turned in the clockwise direction in FIG. 6 against the spring force of the torsion spring 73, and the ratchet 28 turned integrally with the ratchet lever 29 is turned in a direction to release the engagement with the latch 27, thereby releasing the locked state of the front side door $D_F$.

When the open link 31 is operated in the direction to release the locked state in the state in which the locking lever 32 is in the unlocking position, as described above, the pin 98 provided on the connecting arm portion 32*a* of the locking lever 32 is only moved within the elongated bore 99 in the open link 31, as shown in FIG. 12, and the force cannot be transmitted from the open link 31 to the locking lever 32.

The urging surface 104 is displaced from the position in which it is opposed to the engage arm portion 103 of the ratchet lever 29, when the locking lever 32 is turned to the locking position, as shown in FIG. 11. Therefore, even if either of the outside handle 76 and the inside handle is operated to operate the open link 31 in the direction to release the locked state, when the locking lever 32 is in the locking position, the urging surface 104 cannot apply the urging force to the engage arm portion 103. In other words, the transmission of the operating force from the open link 31 to the ratchet lever 29 is impossible, and hence, the ratchet 28 remains engaged with the latch 27, and the locked state of the front side door $D_F$ is maintained.

A substantially L-shaped engage portion 105 is integrally provided at the other end, i.e., the lower end of the open link 31 at a distance spaced apart from the urging surface 104, and an engage step 103*a*, with which the engage portion 105 can be brought into engagement, is provided at the tip end of the engage arm portion 103 of the ratchet lever 29.

Figure 13:
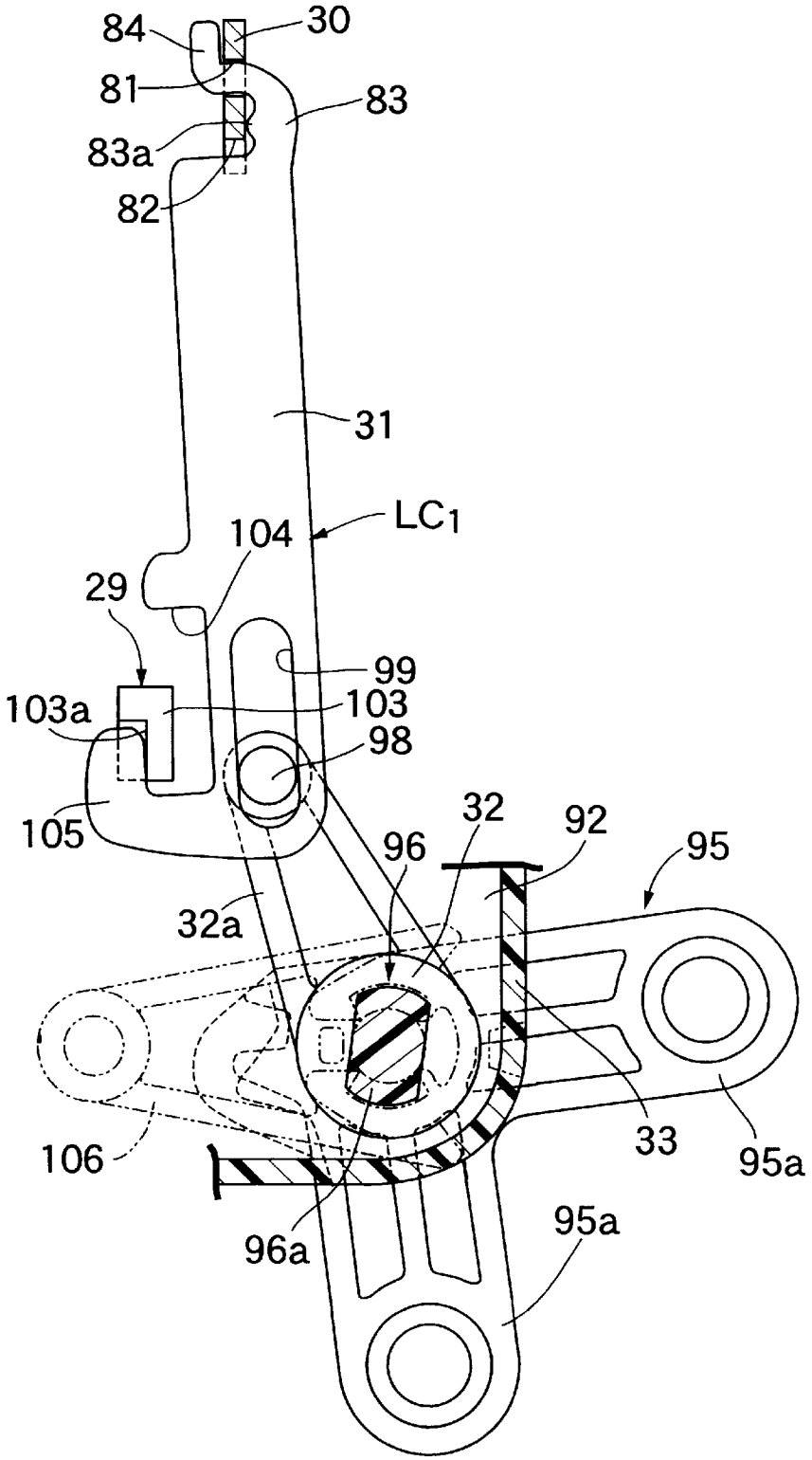
Figure 14:
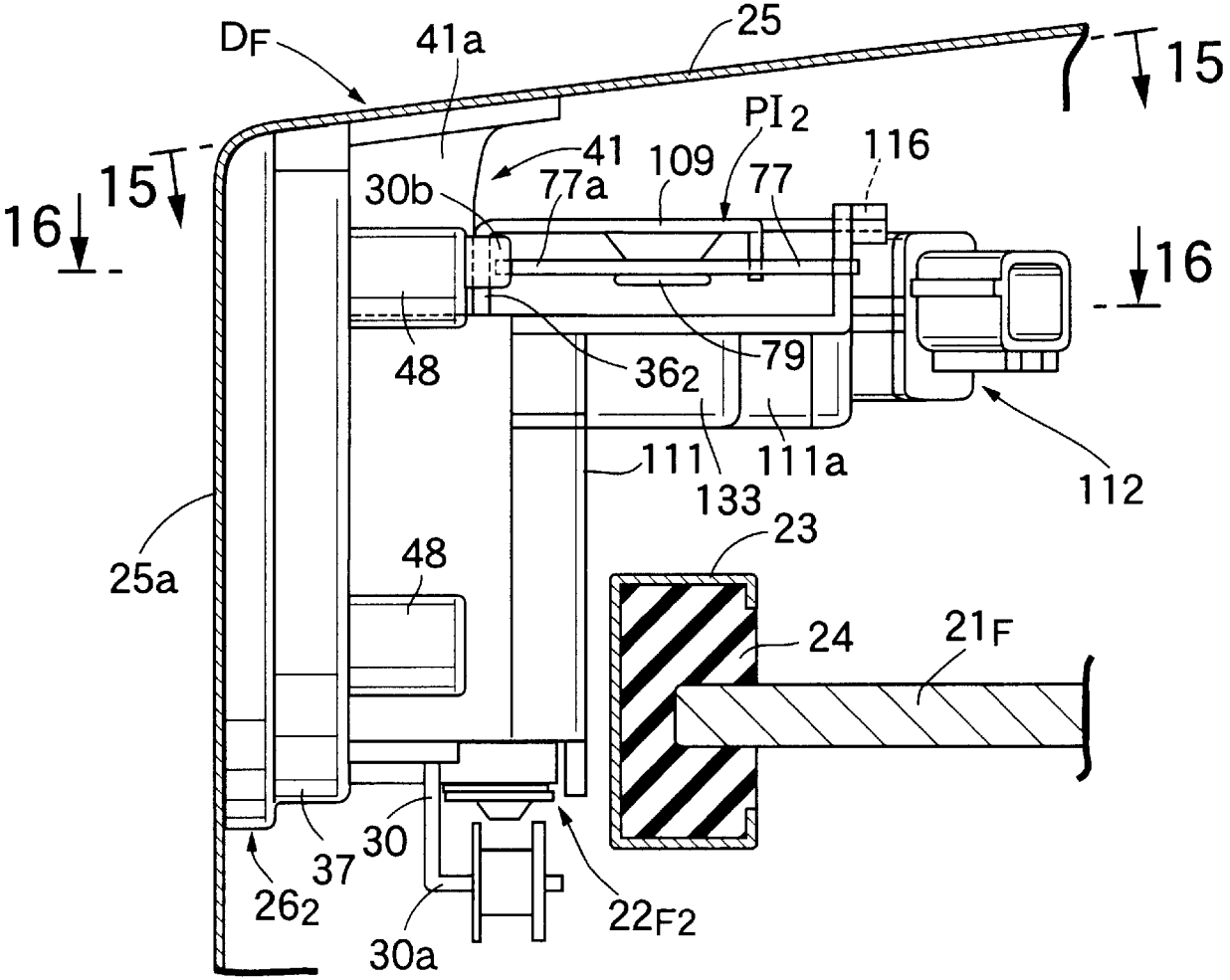
Figure 15:
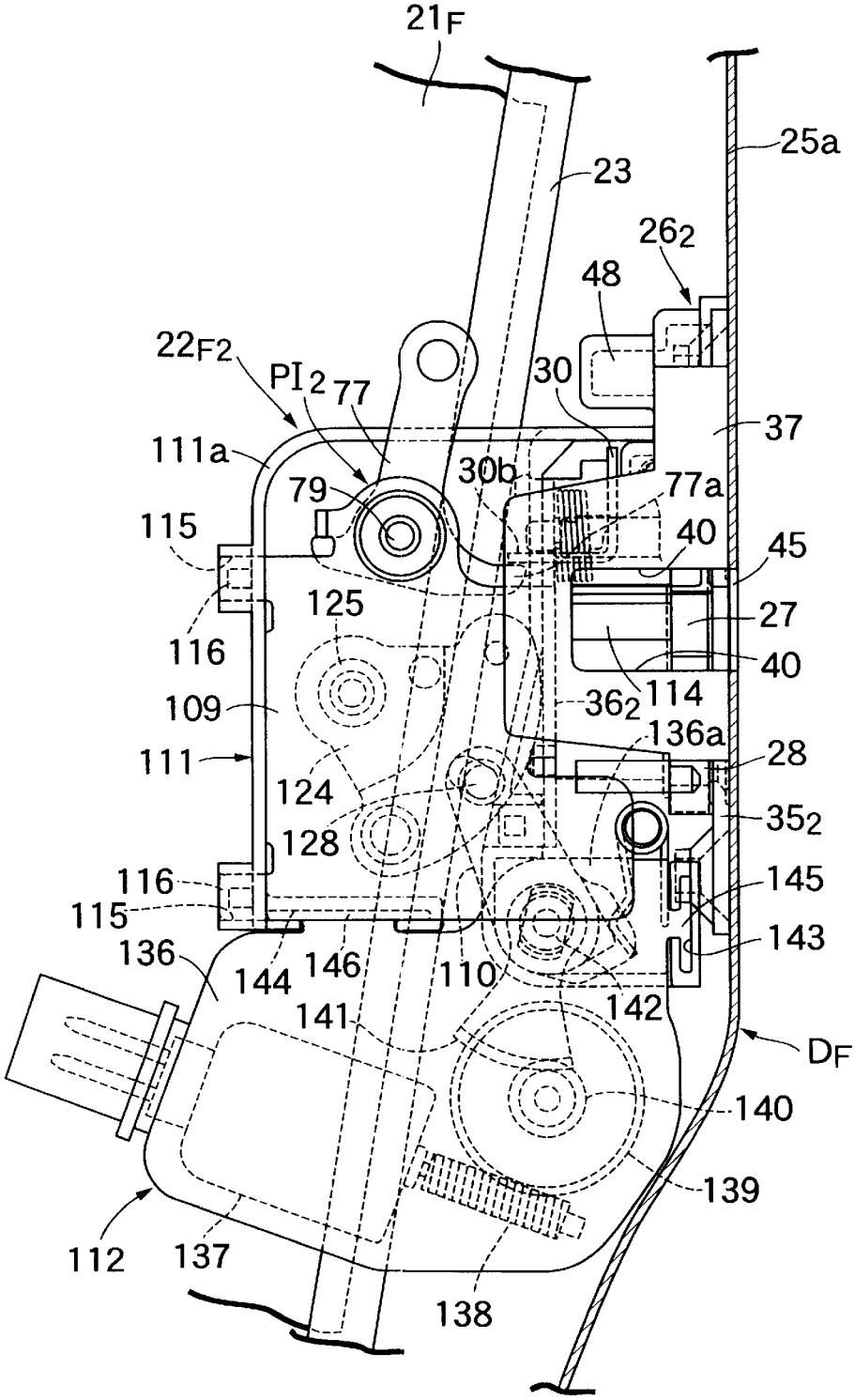
Figure 16:
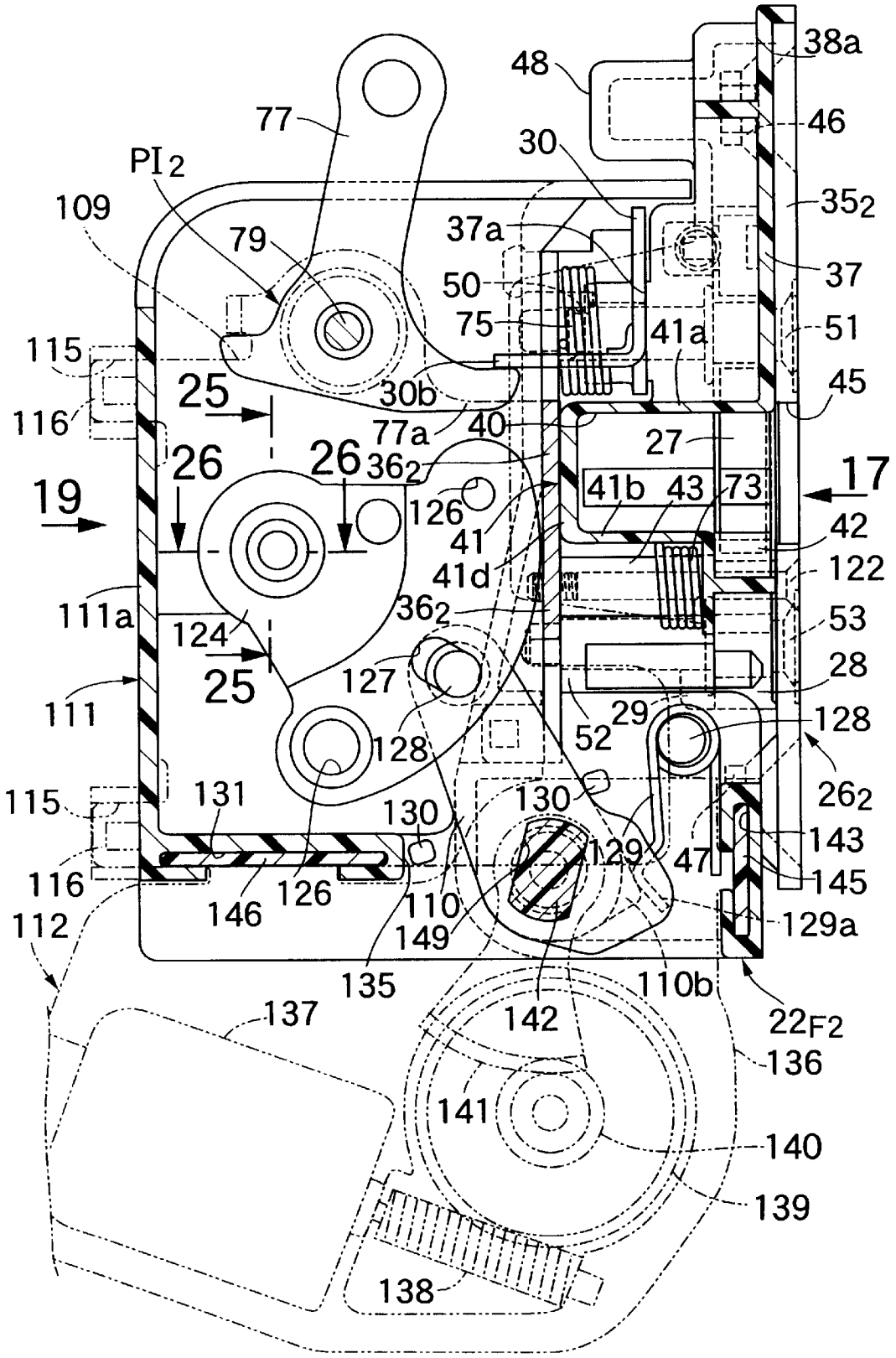
Figure 17:
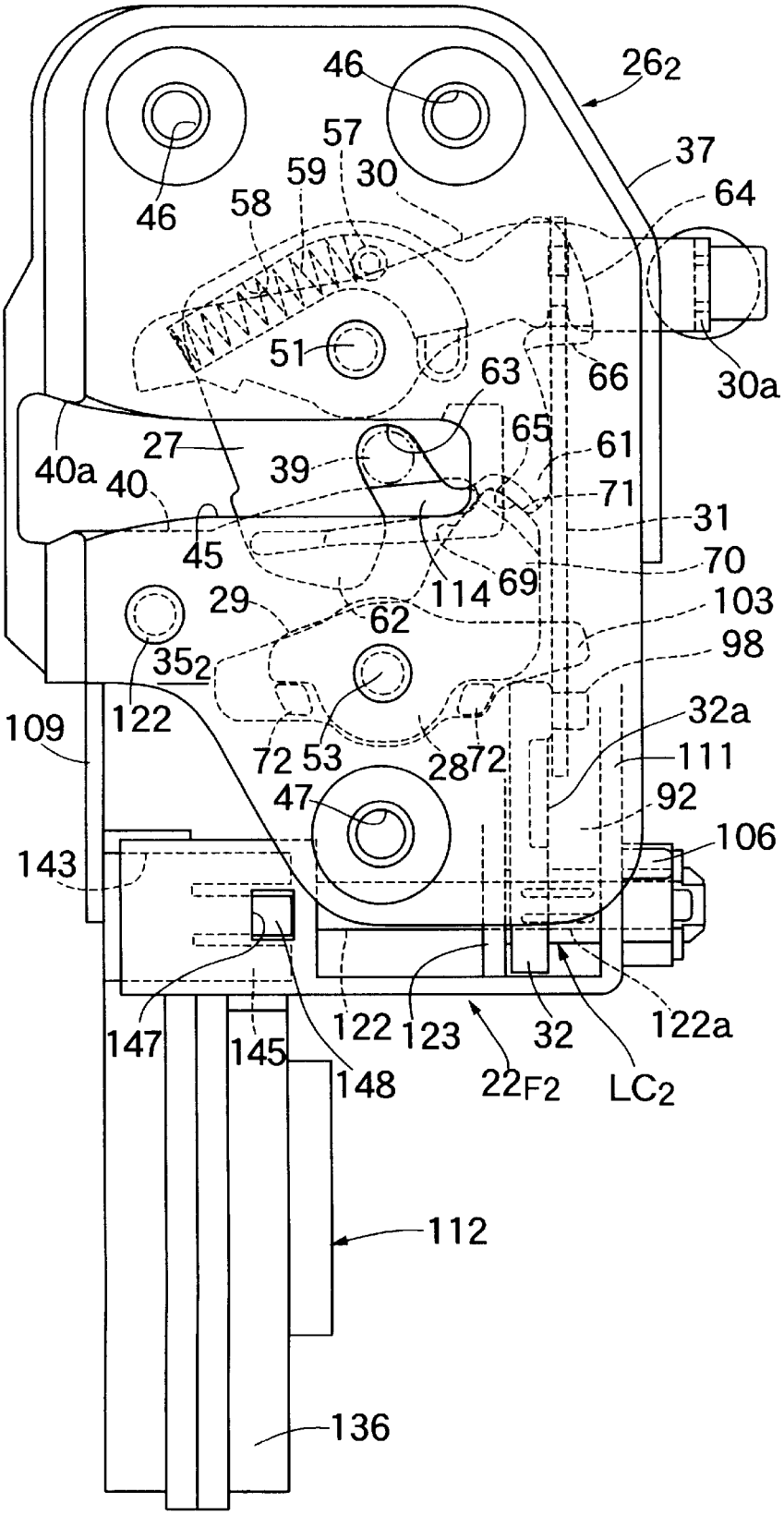
Figure 18:
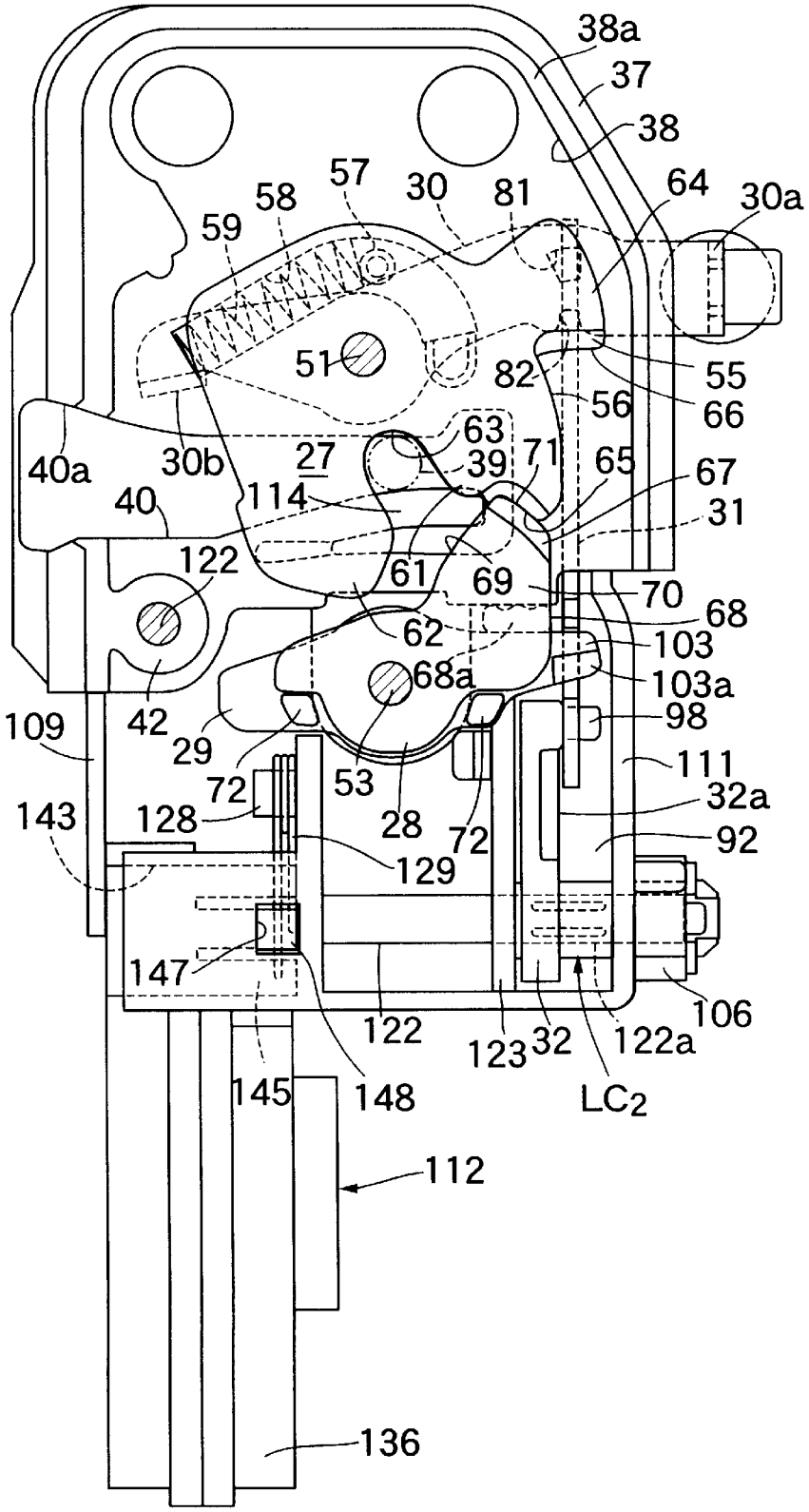

The engage portion 105 is brought into engagement with the engage step 103*a* of the engage arm portion 103, as shown in FIG. 13, in response to turning movement of the locking lever 32 from the unlocking position to the locking position in a state in which the latch 27 is at the end of turning movement in the door opening direction in response to the leaving of the striker 39 from the ingress passage 40, i.e., in a state in which the sliding-contact surface 69 of the ratchet 28 is in sliding contact with the outer periphery of the protrusion 64 of the latch 27 and the ratchet 28 has been disengaged from the latch 27. Thus, even if the operating knob is operated by mistake to turn the locking lever 32 toward the locking position when the front side door $D_F$ is to be opened with an engine key left in the inside of the vehicle, the locking lever 32 cannot be turned to the locking position, and the front side door $D_F$ cannot be fallen into the locked state with the key remaining left in the inside of the vehicle.

The cover 33 is assembled to the back plate $36_1$ of the casing $26_1$ in such a manner that one end of the open link 31 is brought into engagement with the open lever 30 in a state in which the locking lever 32, the knob lever 95, the cylinder lever 106 and the open link 31 have been assembled to the cover 33.

The operation of the first embodiment will be described below. In the door lock device $22_{F1}$, the open link 30 capable of transmitting to the ratchet lever 29 the operating force for operating the ratchet 28 in the direction to release the engagement with the latch 27 in response to the inputting of the operating force to the open lever 30, extends along the plane perpendicular to the lengthwise direction of the ingress passage 40, and is disposed sideways of the bulged portion 41 on the side opposite from the inlet 40*a* of the ingress passage 40 and capable of being stroked and swung within such plane.

Therefore, the open link 31 can be disposed for operation by effectively utilizing a space occupied between the end wall 25*a* of the inner panel 25 and the glass sash 23 by the bulged portion 41 included in the casing body 37 of the casing $26_1$, and it is unnecessary to ensure a space required for the operation of the open link 31 on a large scale behind the bulged portion 41 (on the side of the glass sash 23) and hence, a relatively large unoccupied space can be ensured between the door lock device $22_{F1}$ and the glass sash 23. In addition, the space required for disposition of the open link 31 sideways of the bulged portion 41 on the side opposite from the inlet 40*a* of the ingress passage 40 may be small and hence, the space occupied by the door lock device $22_{F1}$ in the direction of the thickness of the front side door $D_F$ is also small. Thus, the freedom degree of design of the internal structure of the front side door $D_F$ and the freedom degree of setting of the thickness the front side door $D_F$ can be increased.

The cover 33 is mounted to the casing $26_1$ to cover at least the open link 31 and the locking lever 32, and even if an exclusive tool is inserted into the front side door $D_F$ when the front side door $D_F$ is in the locked state, the exclusive tool cannot be brought into engagement with the open link 31 or the locking lever 32. Therefore, it is possible to reliably prevent the open link 31 or the locking lever 32 from being operated as undesired by the exclusive tool, thereby enhancing the steal-preventing property.

The knob lever 95 and the cylinder lever 106 connected to the locking lever 32 are disposed outside the cover 33, but the cylinder lever 106 cannot be turned, unless the key cylinder lock 107 is operated. The knob lever 95 is disposed inside the window glass pane $21_F$ in the front side door $D_F$ and hence, it is impossible to bring the exclusive tool into engagement with the knob lever 95 from the side of the outer surface of the front side door $D_F$.

In addition, since the guide groove 91 for guiding the operation of the open link 31 is provided in the cover 33 for covering the open link 31, the operation of the open link 31 can be reliably can be carried out without addition of a part other than the cover 33, notwithstanding that the open link 31 is cantilever-supported on the open lever 30. Moreover, since the plurality of ribs 93 are fixedly provided on the inner side of the guide groove 91 to come into sliding contact with the opposite sides of the open link 31, the chattering of the open link 31 can reliably be eliminated and hence, it is possible to effectively prevent the generation of a noise during traveling of the vehicle or during opening and closing of the front side door $D_F$.

The knob lever 95, which is turned in response to the operation of the operating knob, is connected to the locking lever 32 connected to the other end of the open link 31, but the knob lever 95 is integrally with the shaft section 96 coaxial with the axis of turning movement of the knob lever 95, and the locking lever 32 is connected to the shaft section 96 for relative non-turning movement. Therefore, the locking lever 32 and the knob lever 95 can be supported commonly, and they can be supported for turning movement by a small number of parts and in a small number of assembling steps. Moreover, the force can be transmitted with an excellent efficiency between the knob lever 95 and the locking lever 32 by turning the locking lever 32 and the knob lever 95 in unison with each other about the same axis. Further, since the cylinder lever 106 connected to the key cylinder lock 107 is connected to the shaft section 96 for turning movement about the same axis as the shaft section 96 in unison with the shaft section 96, the cylinder lever 106 in addition to the knob lever 32 and the locking lever 95 can be turned about the same axis. Thus, the knob lever 95, the locking lever 32 and the cylinder lever 106 can be supported for turning movement by a smaller number of parts and in a smaller number of assembling steps, and the efficiency of transmission of the force between the cylinder lever 106 and the locking lever 32 is also enhanced.

Further, since the shaft section 96 is turnably supported by the cover 33 mounted to the casing $26_1$ to enhance the steal preventing property, any part for supporting the locking lever 32, the knob lever 95 and the cylinder lever 106 is not required other than the cover 33, which can contribute to a reduction in number of parts.

Since the ratchet lever 29 is coaxially disposed in the superposed relation to the ratchet 28 for relative non-turning movement, the ratchet 28 and the ratchet lever 29 can turnably and commonly be supported by the rivet shaft 53, leading to a reduced number of parts and to an enhanced efficiency of transmission of the force between the ratchet lever 29 and the ratchet 28. Moreover, the ratchet 28 and the ratchet lever 29 are connected in a compact arrangement, whereby the door lock device $22_{F1}$ can be made compact.

The end of turning movement of the ratchet 28 in the direction to be engaged with the latch 27 is defined by abutment of the resilient stopper 68*a* provided on the ratchet 28 against the lower side end of the casing body 37 of the casing $26_1$, and the resilient stopper 68*a* is formed integrally with the covering member 68 of the ratchet 28. Therefore, it is possible to absorb a shock sound generated upon abutment of the resilient stopper 68*a* against the casing body 37 by the resilient action of the resilient stopper 68*a* to define the end of the turning movement, thereby preventing the generation of a noise.

Further, since the resilient stopper 68*a* is sandwiched between the casing body 37 and the engage arm portion 103 of the ratchet lever 29 upon abutment against the casing body 37, the resilient stopper 68*a* can be supported on the engage arm portion 103 of the ratchet lever 29, whereby the durability of the resilient stopper 68*a* can be enhanced. Moreover, since the resilient stopper 68*a* protrudes from the ratchet 28 in the direction parallel to the turning axis of the ratchet 28, the space occupied by the ratchet 28 in the plane perpendicular to such turning axis can be reduced, as compared with a case where the stopper protrudes radially from the turning axis, whereby a reduction in size of the ratchet 28 and in its turn, a reduction in size of the casing $26_1$ can be provided.

A second embodiment of the present invention will now be described with reference to FIGS. 14 to 26, wherein portions or components corresponding to those in the first embodiment are designated by like reference characters, and the detailed description of them is omitted.

Referring first to FIGS. 14 to 20, a door lock device $22_{F2}$ comprises a casing $26_2$ fastened to the end wall 25*a* of the inner panel 25, the latch 27 turnably supported on the casing $26_2$, the ratchet 28 turnably carried on the casing $26_2$ for engagement with the latch 27, the ratchet lever 29 engaged with and connected to the ratchet 28 for turning movement in unison with the ratchet 28, and an open lever 30 turnably carried on the casing $26_2$ so as to be capable of receiving an operating force for releasing a locked state in which the ratchet 28 has been engaged with the latch 27. The door lock device $22_{F2}$ further includes an internal operating force inputting means $PI_2$ connected to an open lever 30, so that it can transmit a door opening operation force depending on a door opening operation in the inside of the vehicle to the open lever 30, a locked-state switch-over means $LC_2$ which is capable of switching-over an unlocked state in which the ratchet lever 29 and the ratchet 28 can be operated from their engaged positions to their disengaged positions in response to the turning movement of the open lever 30 following the input of the door opening operation force, and an unlocked state in which the operations of the ratchet lever 29 and the ratchet 28 from the engaged state to the disengaged state cannot be conducted, irrespective of the turning movement of the open lever 30 following the input of the door opening operation force, and a cover 111 mounted to the casing $26_2$ to cover the ratchet 28, the ratchet lever 29, most of the open lever 30 and the locked-state switch-over means $LC_2$.

Figure 21:
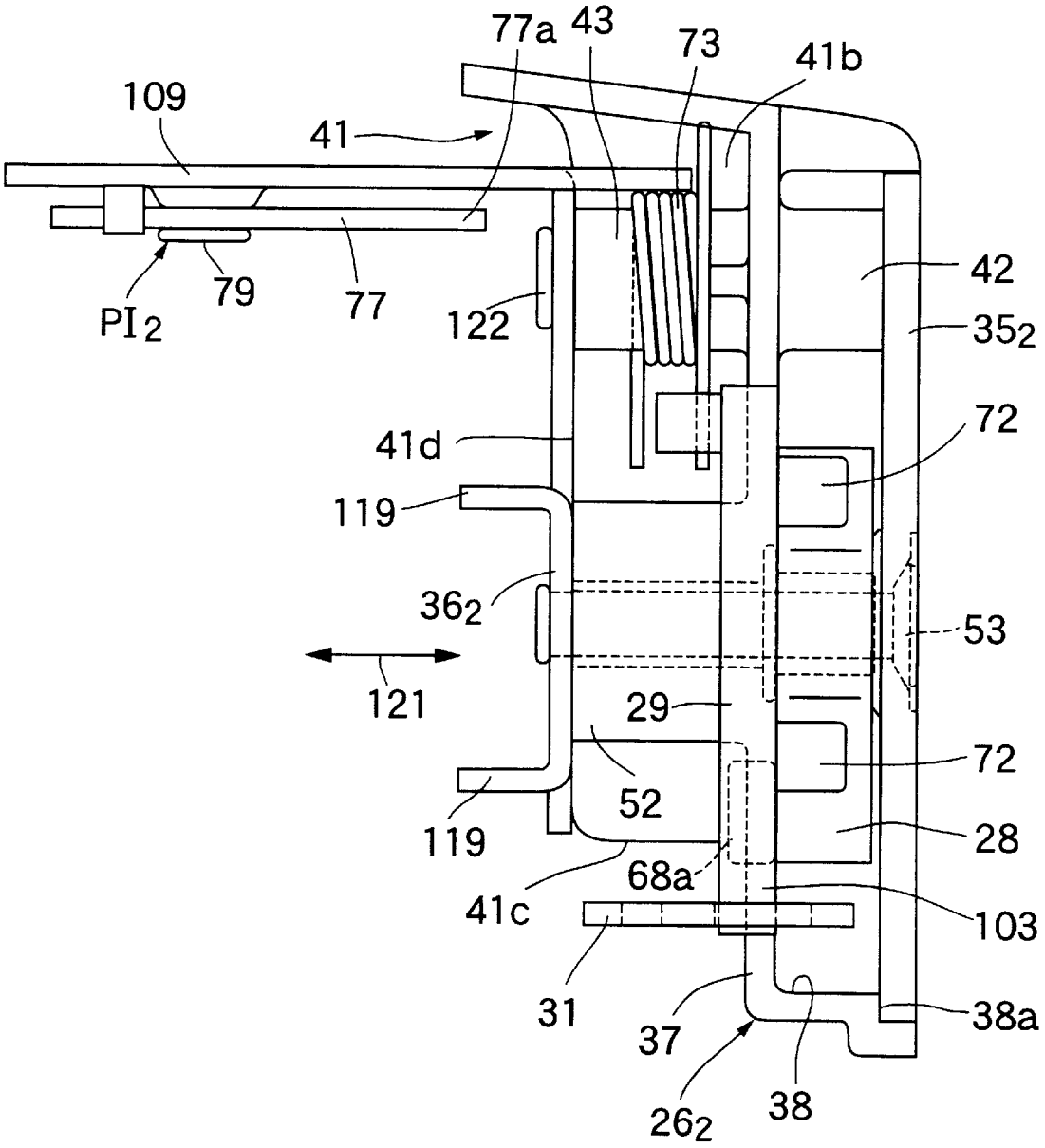

Referring also to FIG. 21, the casing $26_2$ comprises the casing body 37 of a synthetic resin clamped between a surface plate $35_2$ and a back plate $36_2$ made of a metal. In the first embodiment, the casing $26_1$ is coupled by the screw member 44 and the pair of rivet shafts 51 and 53, so that the casing body 37 is sandwiched between the surface plate $35_1$ and the back plate $36_1$, whereas in the second embodiment, the casing $26_2$ is coupled by the rivet shafts 113, 51 and 53, so that the casing body 37 is sandwiched between the surface plate $35_2$ and the back plate $36_2$. More specifically, the rivet shaft 113 is inserted through the surface plate $35_2$ fitted in the recess 38 and the boss portions 42 and 43 of the casing body 37, so that it is received by the step 38*a* and the boss portion 42 of the casing body 37. The surface plate $35_2$ and the back plate $36_2$ abutting against the connecting wall 41*d* of the bulged portion 41 and a tip end face of the boss portion 43 are coupled to each other by the rivet shaft 113 with the casing body 37 interposed therebetween.

A tongue piece portion 114 adapted to resiliently abut against the striker 39 entering the ingress passage 40 from the sideways to brake the entering of the striker 39 is integrally provided on the casing body 37 to extend from the inlet 40*a* toward the inner end of the ingress passage 40.

The internal operating force inputting means $PI_2$ comprises the input lever 77 which is turnably carried, through a support shaft 79 having an axis extending in a direction perpendicular to a turning axis of the open lever 30, on a bracket 109 which is formed into a flat shape along a plane parallel to the turning axes of the latch 27 and the ratchet 28 and integrally connected at right angles to the back plate $36_2$. On the other hand, an input plate portion 30*b* is integrally provided at a lengthwise other end of the open lever 30, and the urging portion 77*a* is integrally provided on the input lever 77 to come into contact with the input plate portion 30*b*.

The cover 111 is formed from a synthetic resin into a box shape with a portion on the side of the casing $26_2$ being opened, and is mounted to the casing $26_2$ to cover a portion of the casing $26_2$ on the side opposite from the surface plate $35_2$, i.e., on the side of the glass sash 23.

Figure 22:
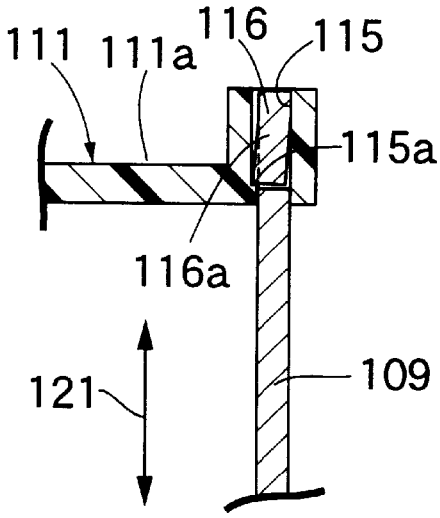

The cover 111 is integrally provided with a risen portion 111*a* corresponding to the bracket 109 of the back plate $36_2$ of the casing $26_2$, and a pair of fitting bores 115, 115 extending in a direction parallel to the turning axes of the latch 27 and the ratchet 28 are provided in a rectangular cross-sectional shape in a tip end of the risen portion 111*a* as shown in FIG. 22. Steps 115*a* are provided in the fitting bores 115, 115 to face outwards, i.e., on the side opposite from the casing $26_2$. On the other hand, rectangular fitting projections 116, 116 are provided at a tip end of the bracket 109 and fitted in the fitting bores 115, 115, respectively. Each of the fitting projections 116, 116 is provided with cut/risen portions 116*a* to resiliently be engaged with the steps 115*a* on inner surfaces of the fitting bores 115, 115 to inhibit the leaving of the fitting projections 116, 116 from the fitting bores 115, 115, when the fitting projections 116, 116 have been fitted into the fitting bores 115, 115.

Figure 23:
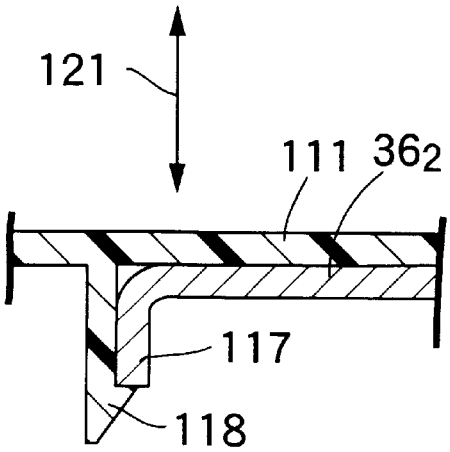

As shown in FIG. 23, a locking projection 117 is integrally provided at an upper portion of the back plate $36_2$ of the casing $26_2$ on the side opposite from the bracket 109 to protrude at right angles toward the casing body 37, and an engage claw 118 is integrally provided on an inner surface of the cover 111 to resiliently be engaged with a tip end of the locking projection 117.

Further, a pair of fitting projections 119, 119 are provided at a lower portion of the back plate $36_2$ to protrude toward the cover 111, and a pair of fitting bores 120, 120 for fitting of the fitting projections 119, 119 are provided in the cover 111. Thus, the fitting projections 119, 119 are resiliently engaged with inner surface of the fitting bores 120, 120 in an engage structure similar to the structure in which the fitting projections 116, 116 are resiliently engaged into the fitting bores 115, 115.

Therefore, the cover 111 is resiliently engaged with the back plate $36_2$ of the casing $26_2$, so that the attaching and detaching operations can be carried out in a direction along the bracket 109, i.e., in an operating direction 121 parallel to the turning axes of the latch 27 and the ratchet 28.

The locked-state switch-over means $LC_2$ is comprised of the open link 31, the locking lever 32, a knob lever 110 coaxially connected to the locking lever 32, the cylinder lever 106 coaxially connected to the knob lever 110, an actuator 112 connected to the locking lever 32 and clamped and fixed between casing $26_2$ and the cover 111, and a connecting lever 124 connected to the knob lever 110 and turnably carried on the cover 111.

In a state in which the cover 111 has been mounted to the casing $26_2$, the ratchet 28, the ratchet lever 29, most of the open lever 30, the open link 31, the locking lever 32 and the connecting lever 124 are covered with the cover 111, and opposite ends of the open lever 30 protrude in opposite sideways directions from the cover 111.

Figure 19:
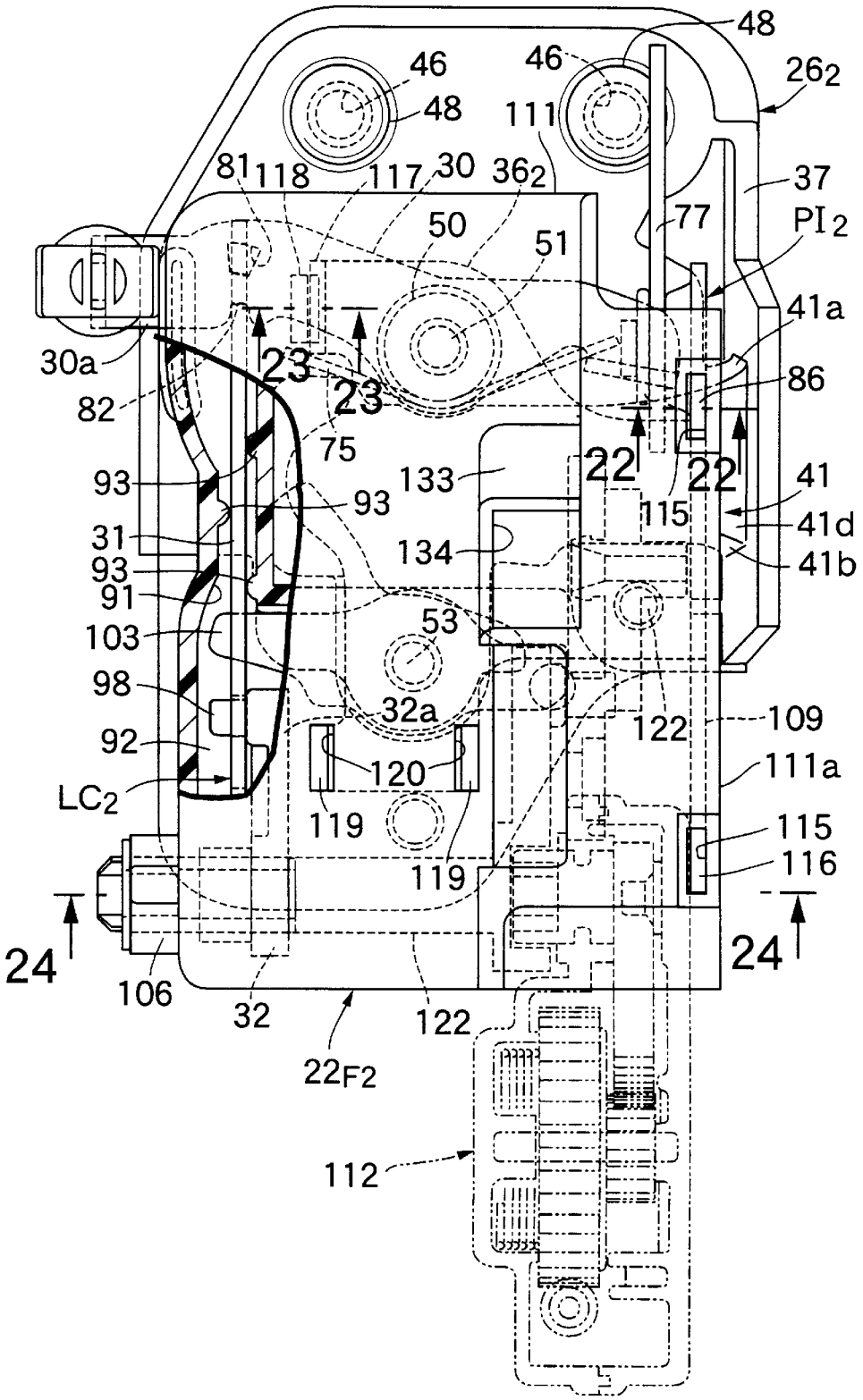
Figure 20:
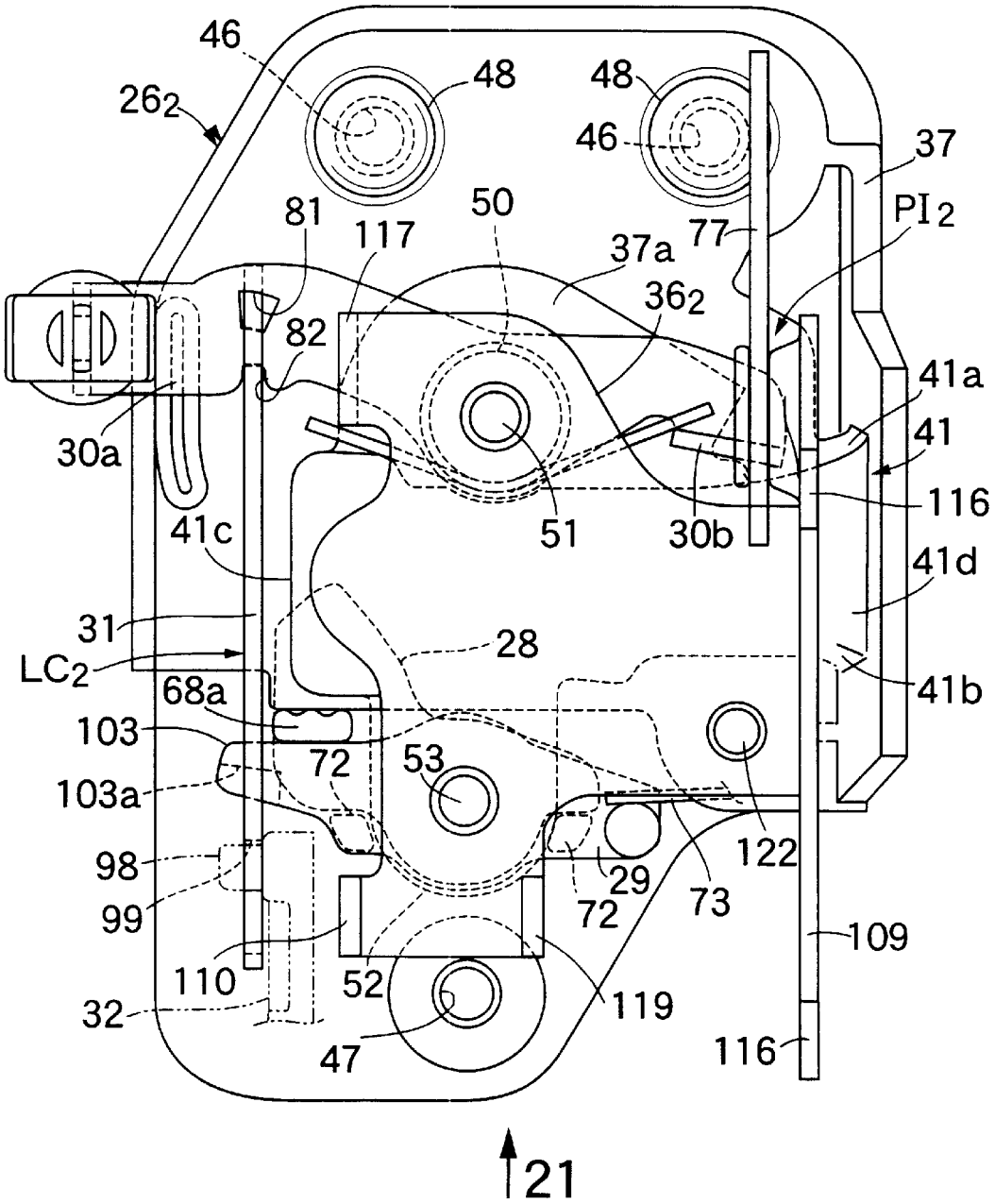

As in the first embodiment, the guide groove 91 for guiding the open link 31 operated within a plane perpendicular to the lengthwise direction of the ingress passage 40 is provided in the cover 111 to extend over a long distance along such plane, and the operating chamber 92, in which the locking lever 32 is accommodated for operation, is defined in the cover 111 to lead to a lower end of the guide groove 91. Moreover, a plurality of ribs 93 are fixedly provided on an inner side of the guide groove 91 to come into sliding contact with opposite sides of the open link 31, as best shown in FIG. 19. The ribs 93 may be formed integrally with the cover 111, as shown, or may be formed of an elastomeric material such as a rubber different from a material for the cover 111, which is fixedly provided on the inner sides of the guide groove 91 by affixing or the like.

A knob lever 110 is carried at the lower portion of the cover 111 for turning movement about a turning axis perpendicular to the turning axes of the ratchet 28 and the ratchet lever 29 and extending substantially in the lengthwise direction of the ingress passage 40, so that it is turned in response to the operation of the locking knob (not shown) provided on the inner surface of the front side door $D_F$.

Figure 24:
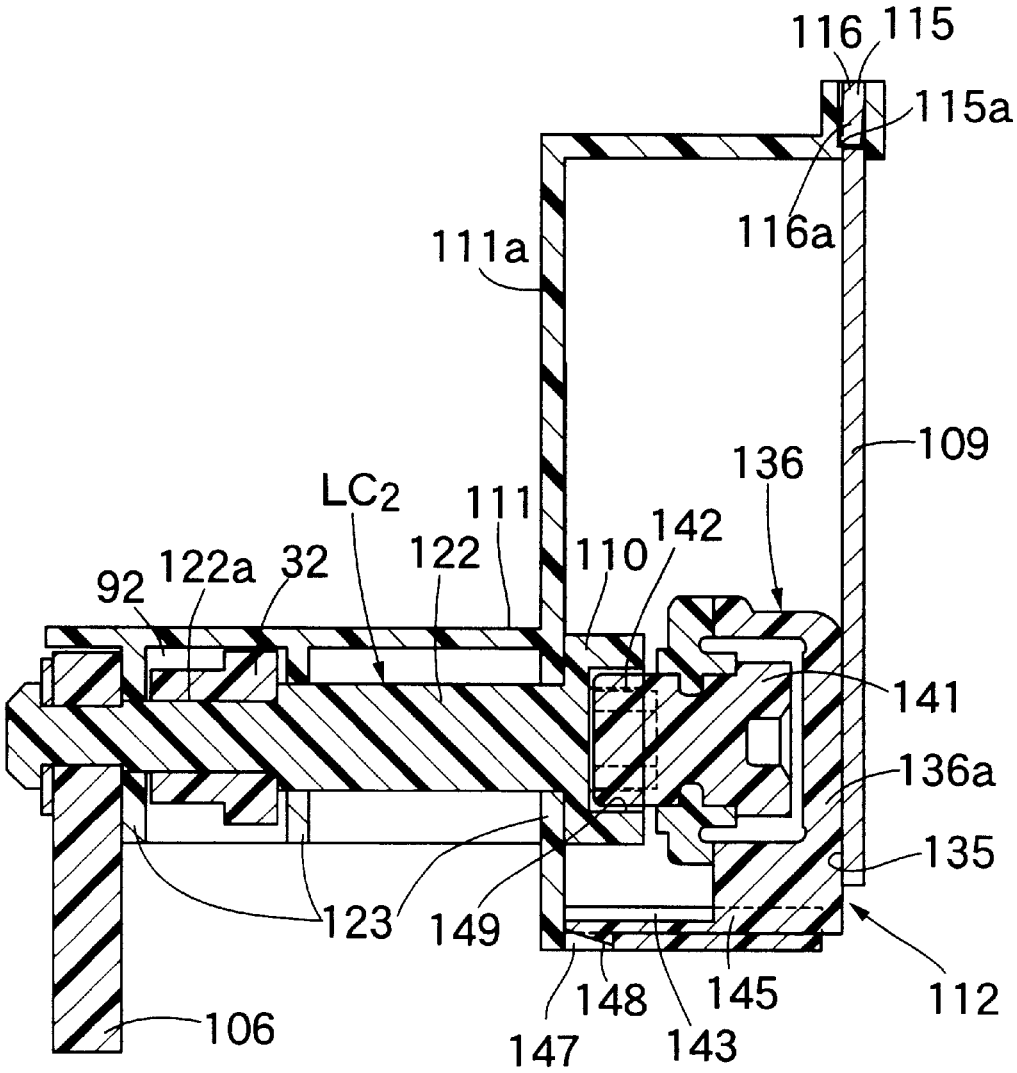

Referring also to FIG. 24, the knob lever 110 integrally provided with a shaft section 122 is disposed inside the cover 111 within the front side door $D_F$, and support plate portions 123 are integrally formed on the cover 111 for turnably supporting the shaft section 122 at a plurality of points axially spaced apart from one another.

The shaft section 122 has a connecting shaft portion 122*a* which is formed thereon at a location corresponding to the inside of the operating chamber 92 and which has, for example, a non-circular cross-sectional shape having flat surfaces parallel to each other along a diametric line of the shaft section 122. The connecting shaft portion 122*a* is fitted in the locking lever 32 fitted in the cover 111 at a location corresponding to the operating chamber 92, so that the axial movement is inhibited. Thus, the locking lever 32 is connected to the shaft section 122, i.e., the knob lever 110 for non-turning movement relative to each other.

A connecting lever 124 is turnably carried on the risen portions 111*a* of the cover 111 and disposed inside the risen portion 111*a*, and the knob lever 110 is connected to the connecting lever 124. The connecting lever 124 is formed into a substantially fan shape from a synthetic resin, and a shaft portion 125 is integrally connected to the connecting lever 124 at a location corresponding to an essential portion of the fan shape. Moreover, connecting bores 126, 126 are provided in circumferentially opposite ends of the connecting lever 124, and a transmitting means (not shown) such as a rod connected to a locking knob (not shown) mounted on the inner surface of the front side door $D_F$ is selectively connected to each of the connecting bores 126, 126. An engage bore 127 is provided in a circumferentially intermediate portion of the connecting lever 124, and an engage pin 128 integrally provided at a tip end of the knob lever 110 is inserted and engaged into the engage bore 127 to turn the knob lever 110 in response to the turning movement of the connecting lever 124.

A triangular projection 110*b* is provided on the knob lever 110, and a torsion spring 129 surrounds a support pin 128 integrally provided on the cover 111, with one end engaged with the cover 111, and extends to a position in which the other end thereof is opposed to the projection 110*b*. A triangular projection 129*a* having an apex directed toward the projection 110*b* is provided at the other end of the torsion spring 129, and the torsion spring 129 exhibits a spring force for urging the projection 129*a* against the projection 110*b* of the knob lever 110. Therefore, the knob lever 110 is turned against a resilient force of the torsion spring 129, so that the projection 110*b* climbs over the projection 129*a*, and the knob lever 110 and the locking lever 32 are turned moderately between the unlocking position and the locking position.

A pair of stopper pins 130, 130 are projectingly provided on the cover 111 and is capable of abutting against a side of the knob lever 110 to limit the turned positions of the knob lever 110 and the locking lever 32 in a range between the unlocking position and the locking position.

Figure 25:
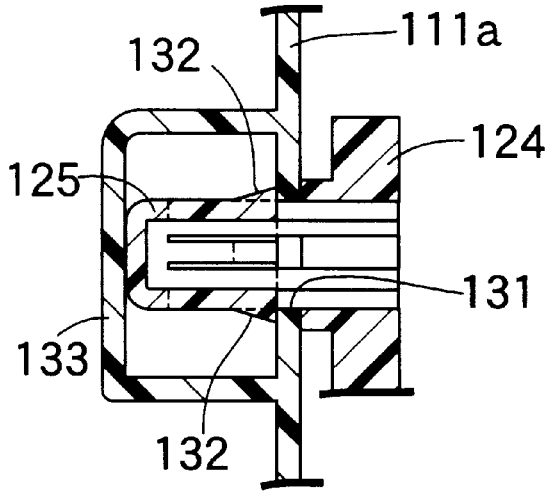
Figure 26:
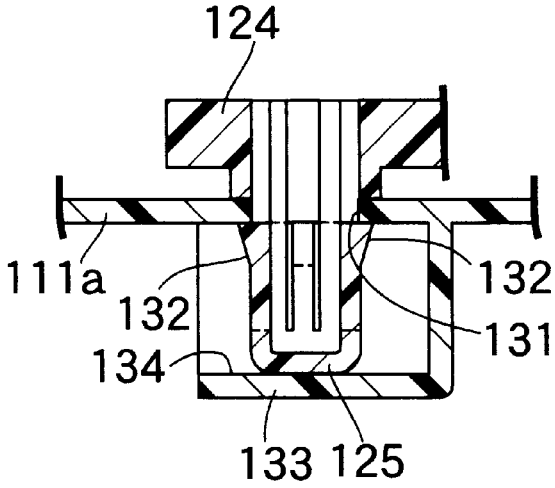
Figure 27:
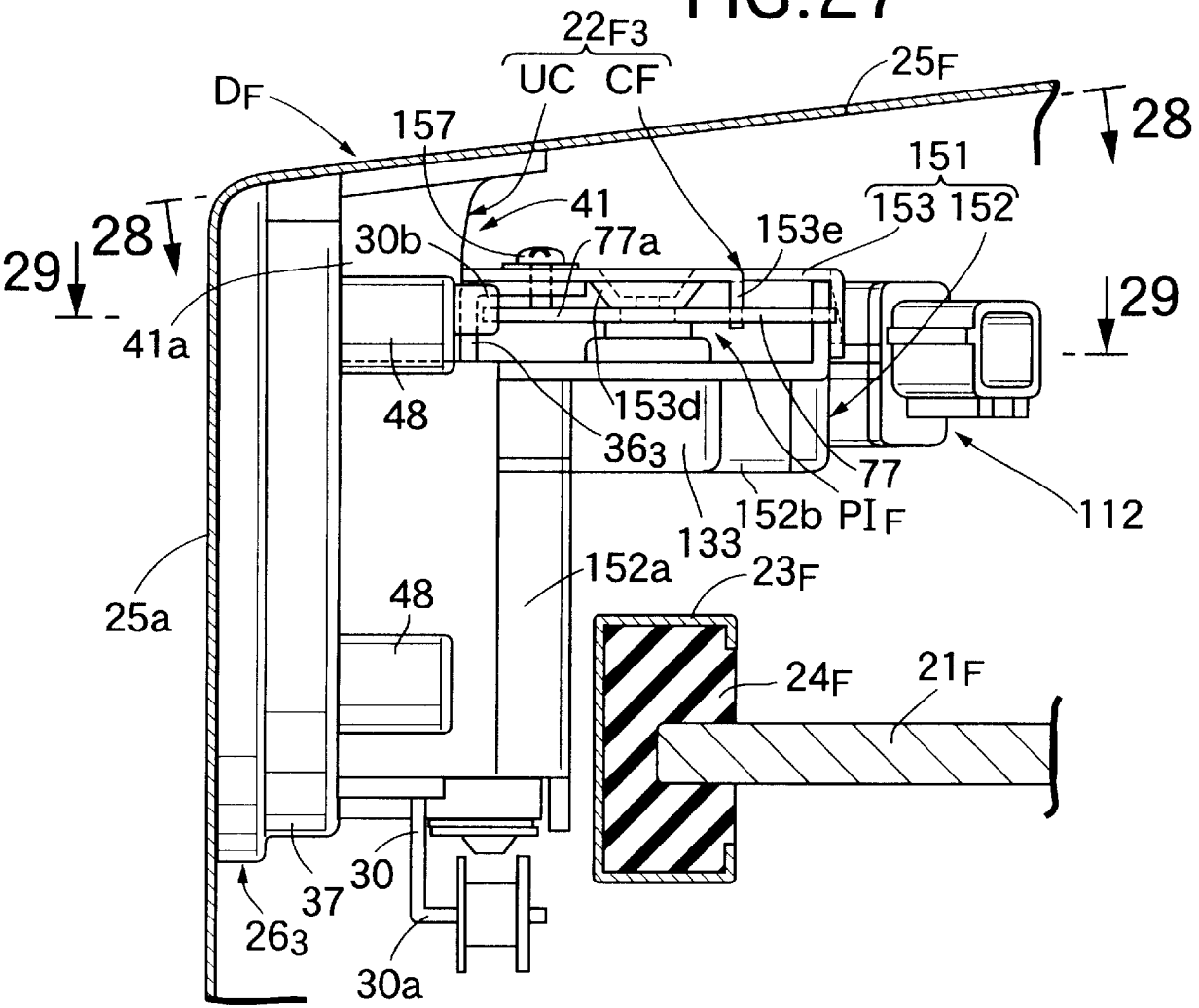
Figure 28:
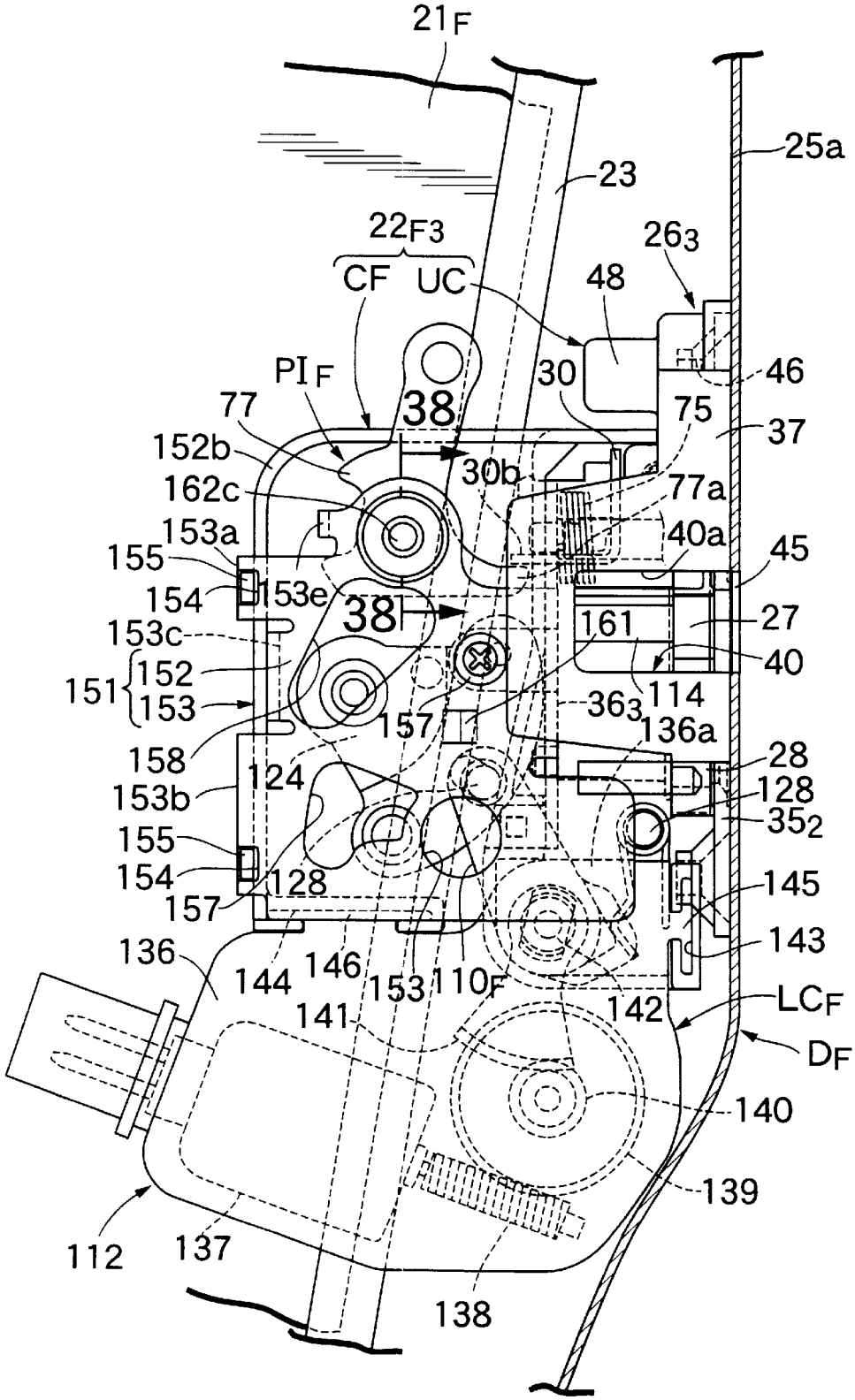
Figure 29:
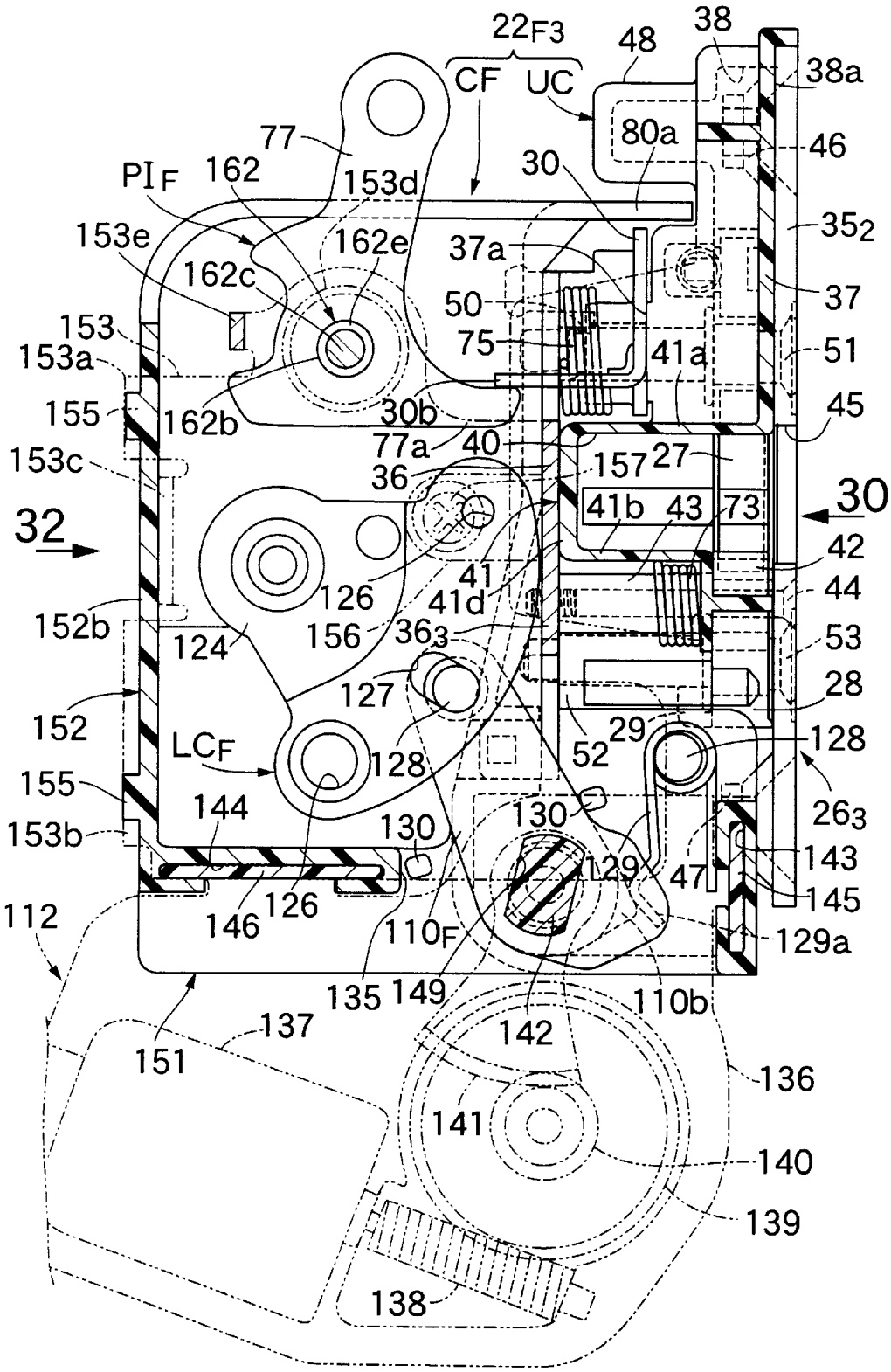
Figure 30:
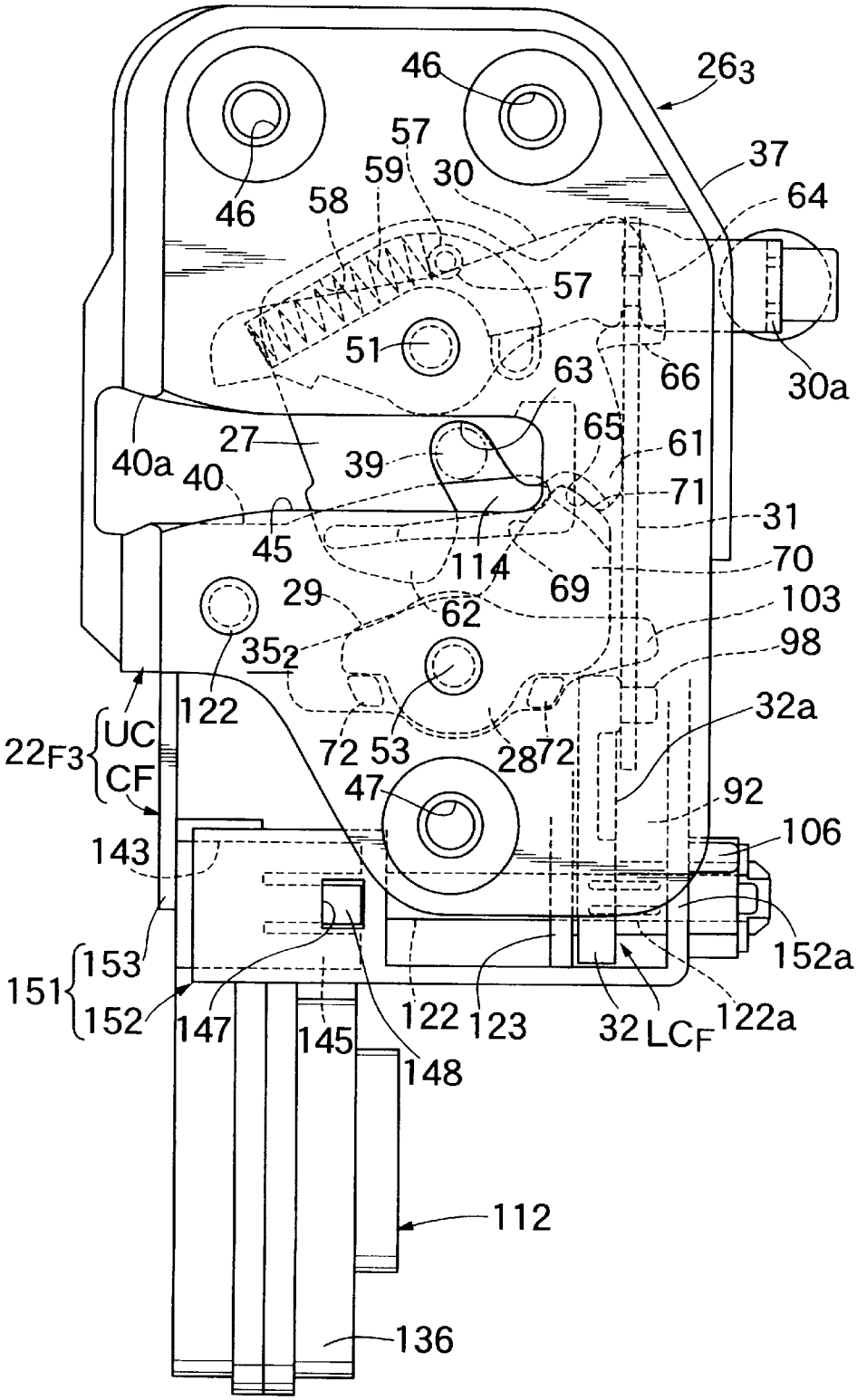
Figure 31:
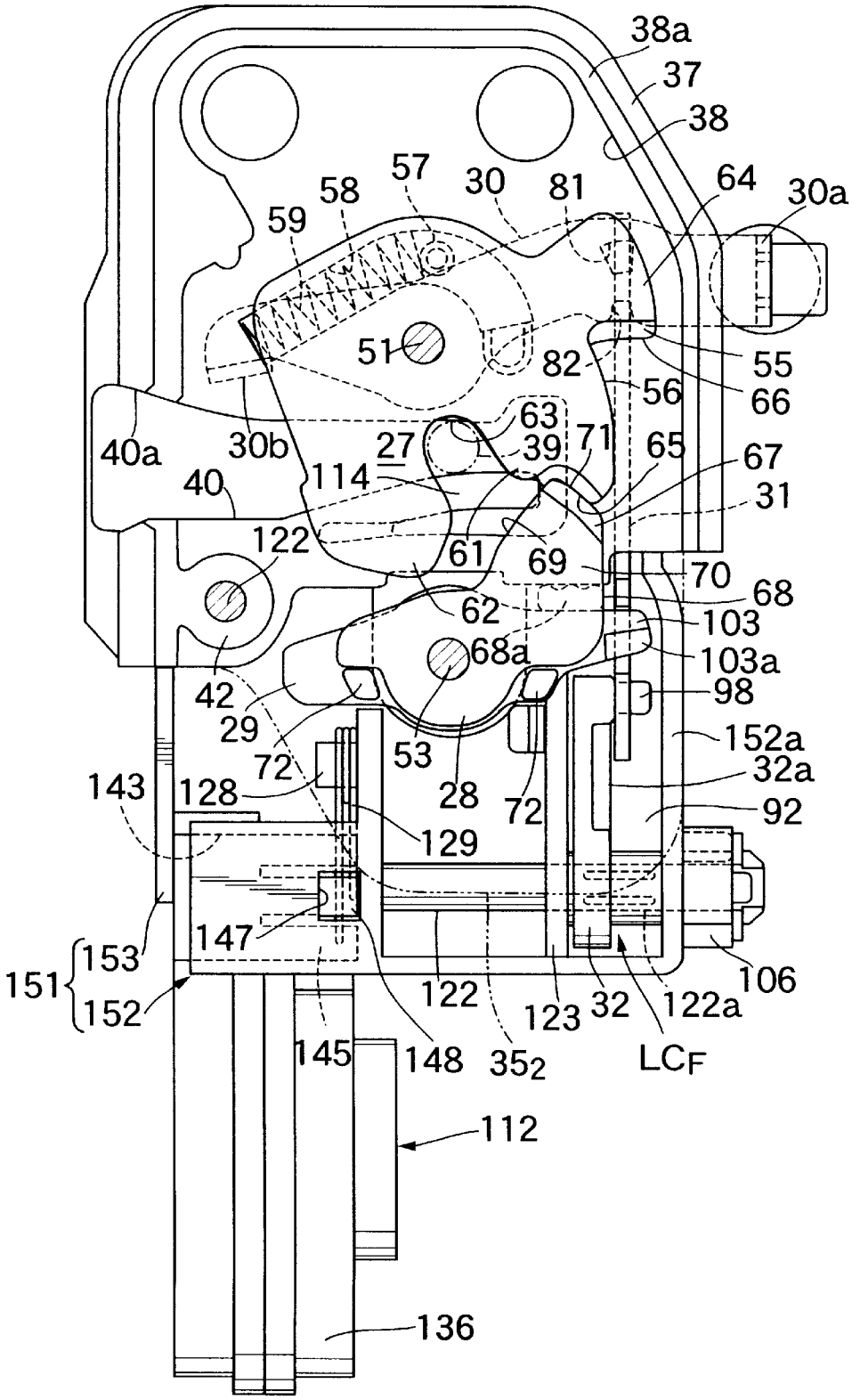
Figure 32:
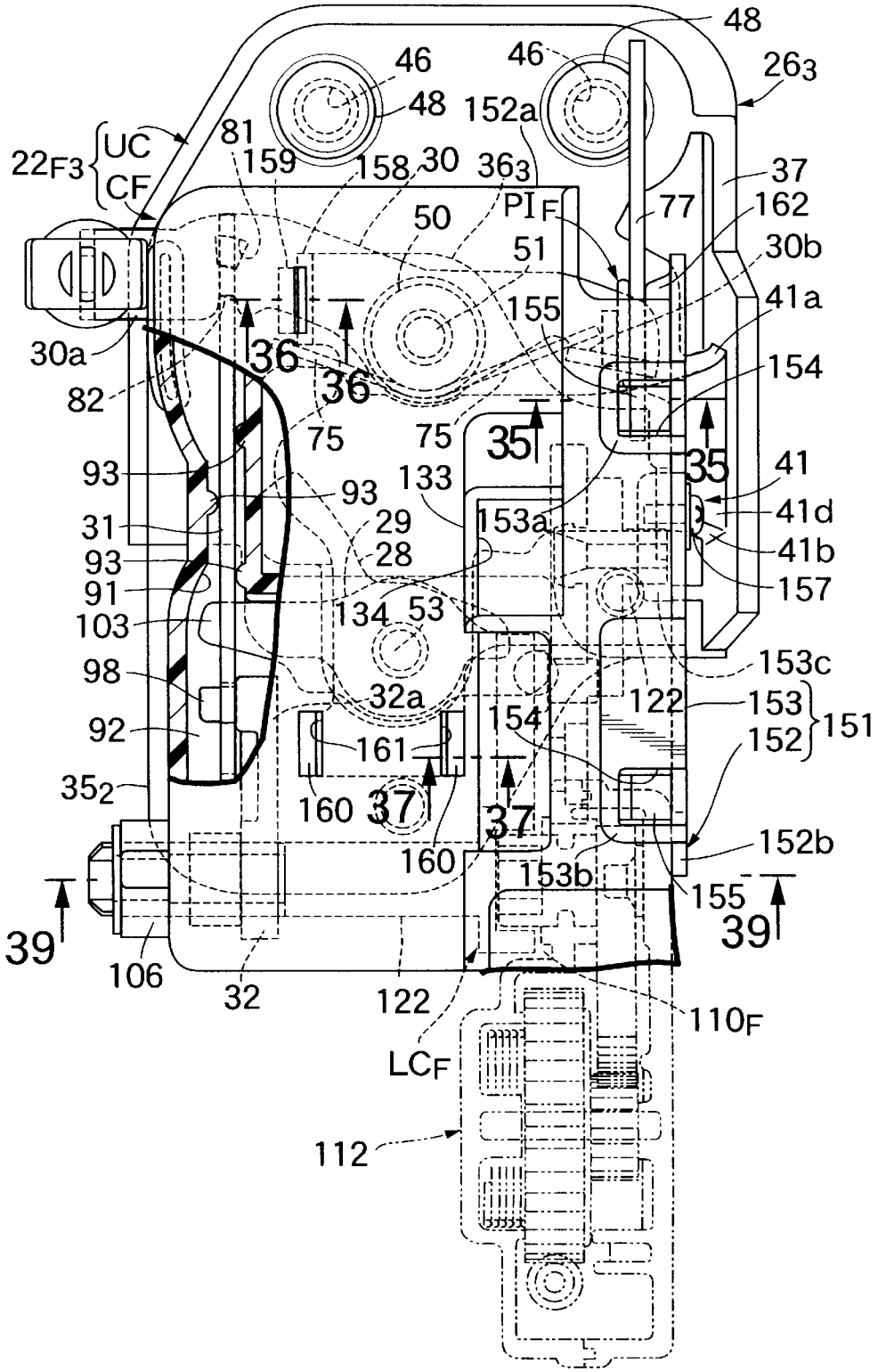
Figure 33:
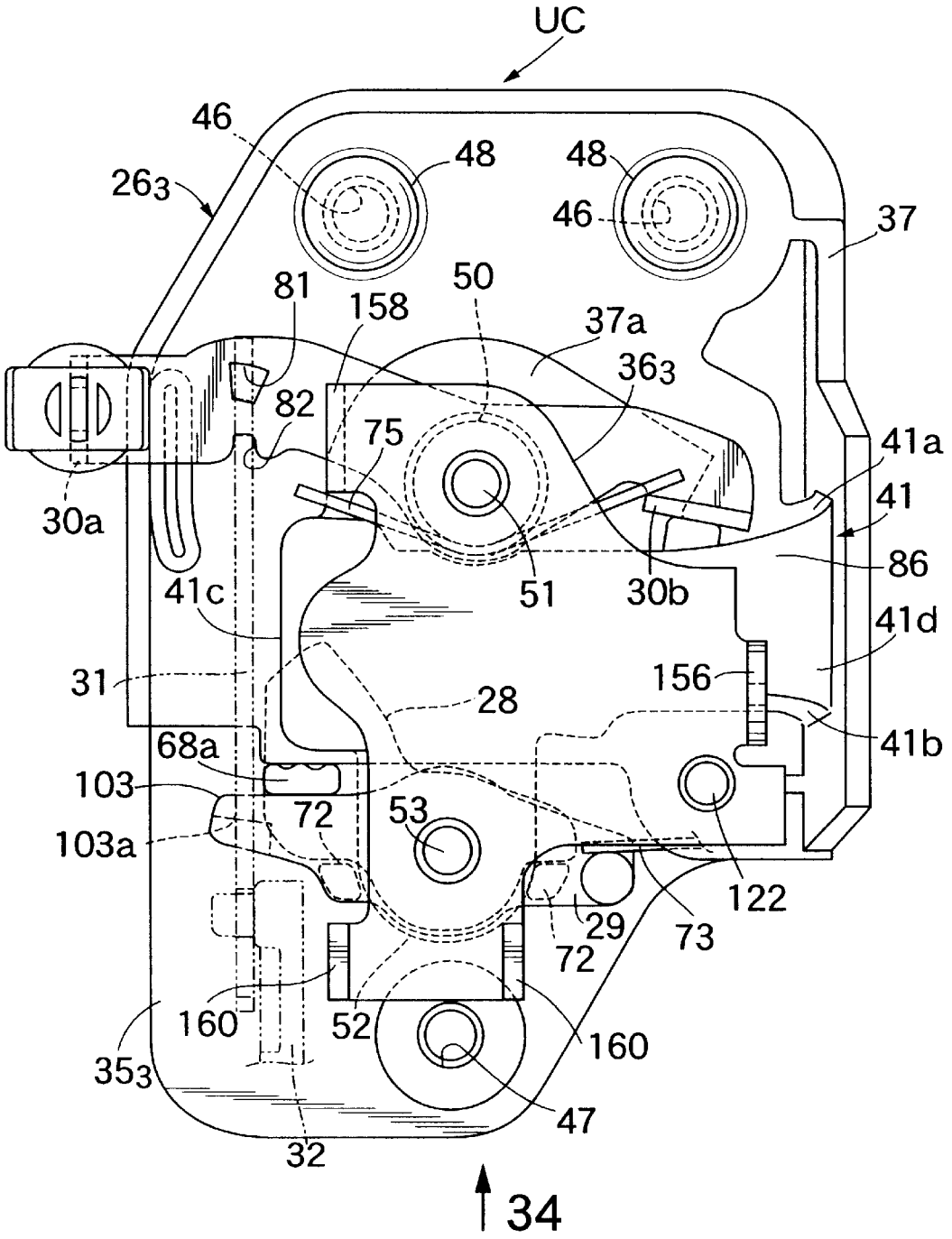

Referring to FIGS. 25 and 26, the risen portion 111*a* of the cover 111 is provided with a support bore 131 into which the shaft section 125 integrally provided on the connecting lever 124 is inserted for turning movement about its axis. Engage claws 132 are provided on the shaft section 125 at a plurality of points circumferentially spaced apart from one another on the side of an outer surface of the risen portion 111*a* of the cover 111 to resiliently be engaged with a periphery of the support bore 131. Therefore, the connecting lever 124 is turnably carried on the risen portion 111*a* only by inserting the shaft section 125 into the support bore 131 from inside the cover 111.

Moreover, the risen portion 111*a* is integrally provided with a covering portion 133 which covers a protrusion of the shaft section 125 from the outer surface of the risen portion 111*a*. A pattern drawing bore 134 used in the molding of the covering portion 133 integral with the risen portion 111*a* is provided in a side portion of the covering portion 133. The pattern drawing bore 134 is disposed to keep away from a position above the shaft section 125, and at least an upper portion and an outer end of the shaft section 125 are covered with the covering portion 133.

The cylinder lever 106 is disposed sideways of the cover 111 to sandwich the cover 111 between the cylinder lever 106 and the knob lever 110 and is attached to an end of the shaft section 122 which is opposite from the knob lever 110. The cylinder lever 106 is connected to the shaft section 122 for permitting turning movement relative to the shaft section 122 in a range limited about the axis.

The acceptable range of relative turning movement of the shaft section 122 and the cylinder lever 106 is set so that the force cannot be transmitted from the shaft section 122 to the cylinder lever 106, when the locking lever 32 is turned between the unlocking position and the locking position by the knob lever 110 integral with the shaft section 122. When the cylinder lever 106 is operated to turn the locking lever 32 between the unlocking position and the locking position, the knob lever 110 is also turned with the shaft section 122.

An opening 135 which opens downwards is defined between the lower portion of the cover 111 and the lower portion of the back plate $\mathbf{36}_2$ of the casing $\mathbf{26}_2$, and the actuator 112 connected to the shaft section 122 turned with the locking lever 32 is mounted to the cover 111 and the casing $\mathbf{26}_2$, so that a portion thereof protrudes into the cover 111 through the opening 135.

The actuator 112 includes, within a housing 136 made of a synthetic resin, a motor 137, a worm 138 provided on an output shaft of the motor 137, a worm gear 139 rotatably carried on the housing 136 and meshed with the worm 138, a gear 140 integral with the worm gear 139, and a sector gear 141 meshed with the gear 140. A rotary shaft of the sector gear 141 is provided as an output shaft 142 of the actuator 112 to protrude from the housing 136.

The housing 136 of the actuator 112 includes a protrusion 136*a* protruding into the opening 135, and the output shaft 142 protrudes outwards from the protrusion 136*a*.

Fitting grooves 143 and 144 opening toward the bracket 109 on the back plate $\mathbf{36}_2$ of the casing $\mathbf{26}_2$ are provided in the cover 111 at a location corresponding to the opening 135 and defined in a substantially T-shape within a plane perpendicular to the operating direction 121 for attaching and detaching the cover 111 to and from the casing $\mathbf{26}_2$. The fitting grooves 143 and 144 are provided in the cover 111 with the relative attitudes different through 90 degree within such plane.

On the other hand, substantially T-shaped fitting portions 145 and 146 are provided on the housing 136 of the actuator 112 and fitted into the fitting grooves 143 and 144, respectively. Moreover, one 145 of the fitting portions is provided with an engage claw 148 resiliently engaged into an engage bore 147 which is provided in the cover 111 to open into the fitting groove 143. The other fitting portion 146 is also resiliently engaged with the cover 111 in a structure similar to the structure in which the fitting portion 145 has been resiliently engaged with the cover 111.

Therefore, the actuator 112 is resiliently engaged with the cover 111 from the side of the casing $\mathbf{26}_2$ in such a manner that the position thereof is invariable relative to the cover 111 within the plane perpendicular to the operating direction 121 for attaching and detaching the cover 111 to and from the casing $\mathbf{26}_2$. The bracket 109 of the back plate $\mathbf{36}_2$ of the casing $\mathbf{26}_2$ is opposed to the protrusion 136*a* of the housing 136 of the actuator 112 to inhibit the leaving of the actuator 112 from the cover 111.

Moreover, the output shaft 142 of the actuator 122 is formed into a non-circular cross-sectional shape. On the other hand, a recess 149, into which the output shaft 142 is relatively non-turnably fitted, is provided in an end of the shaft section 122 non-turnable relative to the locking lever 32, which is opposed to the output shaft 142, i.e., an end on the side of the knob lever 110, and the output shaft 142 of the actuator 122 is coaxially connected to the shaft section 122.

The operation of the second embodiment will be described below. The knob lever 110 turned in response to the operation of the locking knob is connected to the locking lever 32 connected to the other end of the open link 31. The knob lever 110 is integrally provided with the shaft section 122 coaxial with the turning axis of the knob lever 110, and the locking lever 32 is connected to the shaft section 122 for non-turning movement relative to each other. Therefore, the locking lever 32 and the knob lever 110 can be supported commonly, and they can be turnably supported by a small number of parts and in a small number of assembling steps. Moreover, the force can be transmitted with an excellent efficiency between the knob lever 110 and the locking lever 32 by turning the locking lever 32 and the knob lever 110 in unison with each other about the same axis. In addition, since the cylinder lever 106 connected to the key cylinder lock 107 (see FIG. 1) is connected to the shaft section 122 for turning movement about the same axis as the shaft section 122 in unison with the shaft section 122, the cylinder lever 106 in addition to the knob lever 110 and the locking lever 32 can be turned about the same axis. Thus, the knob lever 110, the locking lever 32 and the cylinder lever 106 can be turnably supported by a smaller number of parts and in a smaller number of assembling steps, and the efficiency of transmission of the force between the cylinder lever 106 and the locking lever 32 is also enhanced.

The cover 111 is resiliently engaged with the casing $\mathbf{26}_2$, so that the attaching and detaching operations can be carried out in the operating direction 121 parallel to the turning axes of the latch 27 and the ratchet 28, and the actuator 112 connected to the locking lever 32 is resiliently engaged with the cover 111 from the side of the casing $\mathbf{26}_2$, so that the position thereof relative to the cover 111 in the plane perpendicular to the operating operation 121 is invariable. The casing $\mathbf{26}_2$ is provided with the bracket 109 as the limiting plate opposed to the actuator 112 to inhibit the leaving of the actuator 112 from the cover 111. Therefore, the actuator 112 is clamped and fixed between the bracket 109 of the casing $\mathbf{26}_2$ and the cover 111 by bringing the cover 111 into resilient engagement with the casing $\mathbf{26}_2$ in the state in which the actuator 112 has been brought into resilient engagement with the cover 111 from the side of the casing $\mathbf{26}_2$. As a result, the actuator 112 can easily be assembled without use of a fastening part such as a machine screw, leading to an enhanced assembling operability.

Moreover, since the output 142 of the actuator 112 is coaxially connected to the locking lever 32, it is not required that a connecting member is mounted between the output 142 of the actuator 112 and the locking lever 32. Thus, the number of parts can be reduced, and the assemblability can be enhanced, the efficiency of transmission of the power between the actuator 112 and the locking lever 32 can also be enhanced.

Due to the difficulty to directly connect to the knob lever 110 the operating force transmitting member such as a rod connected to the locking knob to because of the relative-positional relationship between the locking knob and the knob lever 110 receiving the operating force depending on the operation of the locking knob, the connecting lever 124 mounted between the operating force transmitting member and the knob lever 110 is turnably carried on the cover 111. However, the cover 111 is provided with the support bore 131 into which the shaft section 125 integrally provided on the connecting lever 124 is inserted, and the shaft section 125 is provided with the plurality of engage claws 132 resiliently engaged with the periphery of the support bore 131 on the side of the outer surface of the cover 111. Therefore, by inserting the shaft section 125 integrally connected to the connecting lever 124 into the support bore 131 of the cover 111, the shaft section 125, namely, the connecting lever 124 is attached to the cover 111 for turning movement about the axis and for axial movement inhibited. Thus, the attachment of the connecting lever 124 to the cover 111 is facilitated.

Moreover, since the covering member 133 is provided on the outer surface of the cover 111 to cover at least the upper portion and the outer end of the shaft section 125, the wrong access to the shaft section 125 from the outside is impossible. Furthermore, an external force is prevented from being applied to the shaft section 125 of the connecting lever 124 in a direction of leaving of the shaft section 125 from the support bore 131 at an assembling step or at a transporting stage, and the connecting lever 124 cannot be disconnected from the cover 111.

A third embodiment of the present invention will now be described with reference to FIGS. 27 to 49, wherein portions or components corresponding to those in the first and second embodiments are designated by like reference characters, and the detailed description of them is omitted.

Referring to FIGS. 27 to 33 in combination, a door lock device $\mathbf{22}_{F3}$ mounted in the front side door $D_F$ is comprised of a common unit UC common to the front side door $D_F$ and the rear side door $D_R$, and a cover unit CF for the front side door, which is assembled to the common unit UC.

The common unit UC comprises the latch 27, the ratchet 28, the ratchet lever 29, the open lever 30, the spring 59 and the torsion springs 73 and 75 which are parts common to the front side door $D_F$ and the rear side door $D_R$ and which mounted to a common casing $\mathbf{26}_3$ capable of being fastened to any of the front side door $D_F$ and the rear side door $D_R$.

Figure 34:
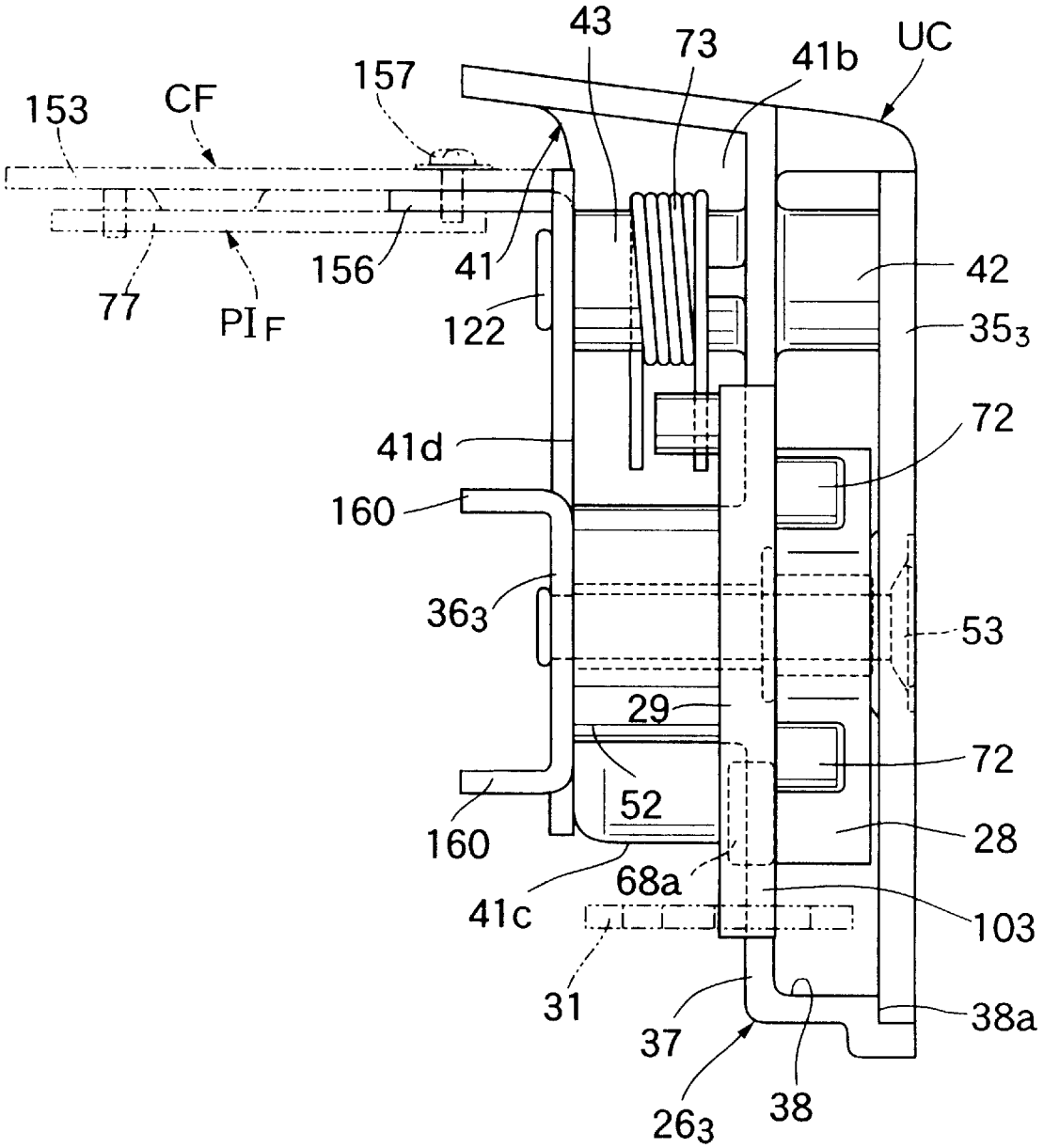

Referring also to FIG. 34, the casing $\mathbf{26}_3$ comprises the casing body 37 made of the synthetic resin and clamped between the surface plate $\mathbf{35}_3$ and the back plate $\mathbf{36}_2$ made of a metal, and is fastened to the end wall 25*a* of the inner panel $\mathbf{25}_F$.

The cover unit CF for the front side door comprises the internal operating-force inputting means $PI_F$ and the locked-state switch-over means $LC_F$ for the front side door $D_F$ mounted to a cover 151 which is formed into a shape common to the front side door $D_F$ and the rear side door $D_R$ and which is mounted to the casing $\mathbf{26}_3$ to cover the common unit UC.

The cover 151 comprises a support plate 153 made of a metal and coupled to a cover body 152 made of a synthetic resin. The cover body 152 integrally includes a main body portion 152*a* formed into a box shape with a portion on the side of the casing $\mathbf{26}_3$ being opened, and a risen portion 152*b* connected at its base end to an end of the main body portion 152*a* opposite from a glass sash $\mathbf{23}_F$ and extending in a direction away from the end wall 25*a* of the inner panel $\mathbf{25}_F$. The support plate 153 is coupled to the cover body 152, so that it is opposed to the risen portion 152*b* on the side opposite from the glass sash $\mathbf{23}_F$, and the cover 151 is mounted to the casing $\mathbf{26}_3$ to cover the side of the casing $\mathbf{26}_3$ opposite from the surface plate $\mathbf{35}_2$, i.e., adjacent the glass sash $\mathbf{23}_F$.

Figure 35:
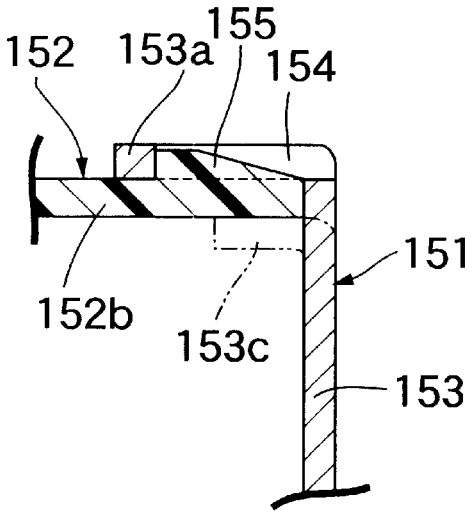

The support plate 153 is opposed to the risen portion 152*b* of the cover body 152 with one end abutting against the back plate $\mathbf{36}_3$ of the casing $\mathbf{26}_3$ and against the connecting wall 41*d* of the casing body 37. The other end of the support plate 153 is integrally provided, at locations spaced apart from each other, with (1) a pair of outer surface-side engage plate portions 153*a* and 153*b* which are capable of being brought into contact and engagement with an outer surface of a tip end of the risen portion 152*b* of the cover body 152, and which are mounted so that they are bent at right angles, and (2) an inner surface-side engage plate portion 153*c* which is capable of being brought into contact and engagement with the outer surface of the tip end of the risen portion 152*b* between both the outer surface-side engage plate portions 153*a* and 153*b* and which is mounted so that it is bent at right angles. Moreover, rectangular engage bores 154, 154 are provided in the outer surface-side engage plate portions 153*a* and 153*b*, as shown in FIG. 35, and engage claws 155, 155 are projectingly provided on the outer surface of the tip end of the risen portion 152*b* and brought into resilient engagement into the engage bores 154, 154. The back plate $\mathbf{36}_3$ is integrally provided with a support plate portion 156 which is brought into contact with an inner surface of one end of the support plate 153, and the one end of the support plate 153 is fastened to the support plate portion 156 by a screw member 157.

Figure 36:
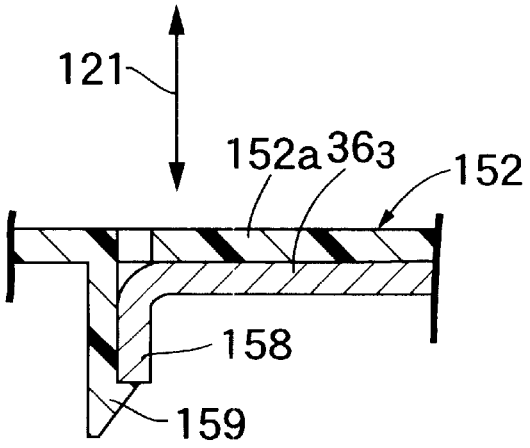

As shown in FIG. 36, a locking projection 158 is integrally provided at an upper portion of the back plate $\mathbf{36}_3$ of the casing $\mathbf{26}_3$ on the side opposite from the support plate 153 to protrude at right angles toward the casing body 37, and an engage claw 159 is integrally provided on an inner surface of the main body portion 152*a* of the cover body 152 to come into resilient engagement with a tip end of the locking projection 158.

Further, a pair of fitting projections 160, 160 are provided at a lower portion of the back plate $\mathbf{36}_3$ to protrude toward the cover 151, and a pair of fitting bores 161, 161, into which the fitting projections 160, 160 are fitted, are provided in the main body portion 152*a* of the cover body 152.

Figure 37:
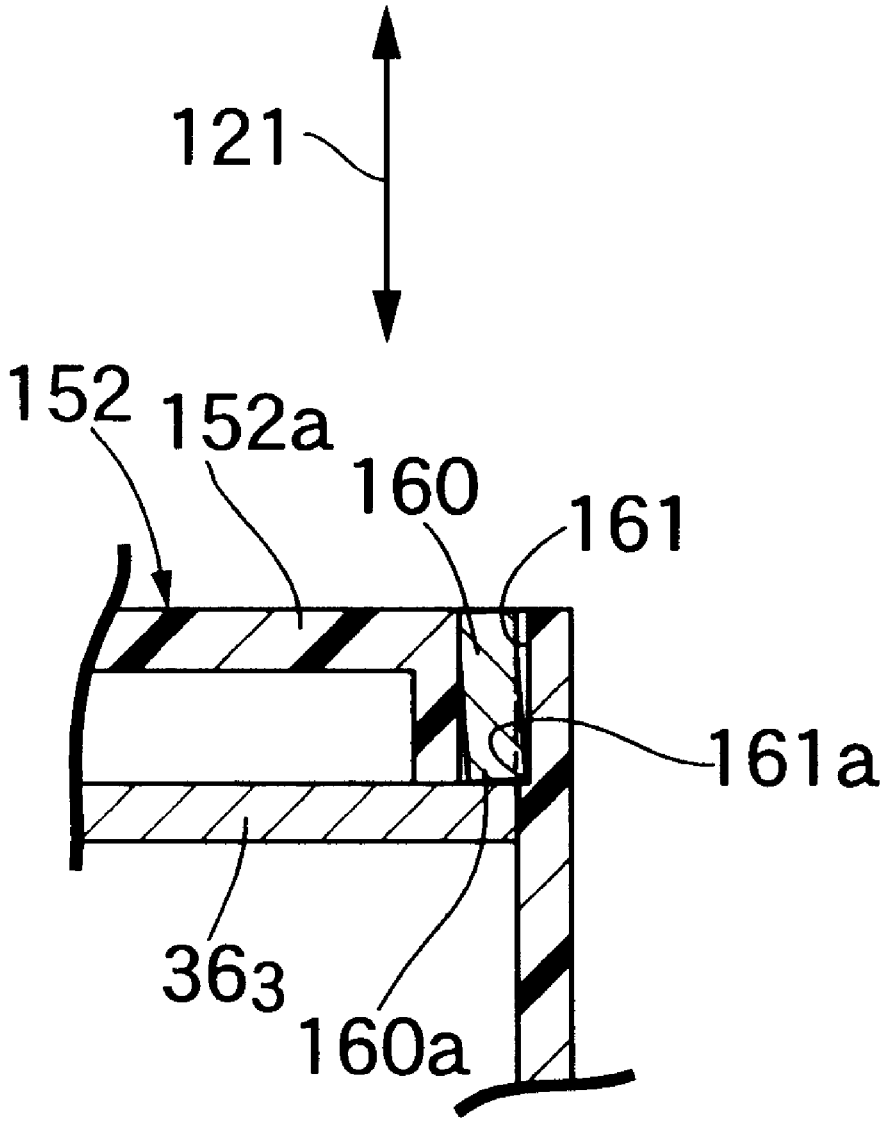

As shown in FIG. 37, steps 161*a* are provided in the fitting bores 161, 161 to face toward the side opposite from the back plate $\mathbf{36}_3$, and cut/risen portions 160*a* are provided on each of the fitting projections 160, 160, and are brought into resilient engagement with the steps 161*a* upon fitting of the fitting projections 160, 160 into the fitting bores 161, 161.

Therefore, the cover body 152 is brought into resilient engagement with the back plate $\mathbf{36}_3$ of the casing $\mathbf{26}_3$, so that it can be detached in a direction along the support plate 153, i.e., in an operating direction 121 parallel to the turning axes of the latch 27 and the ratchet 28.

Figure 38:
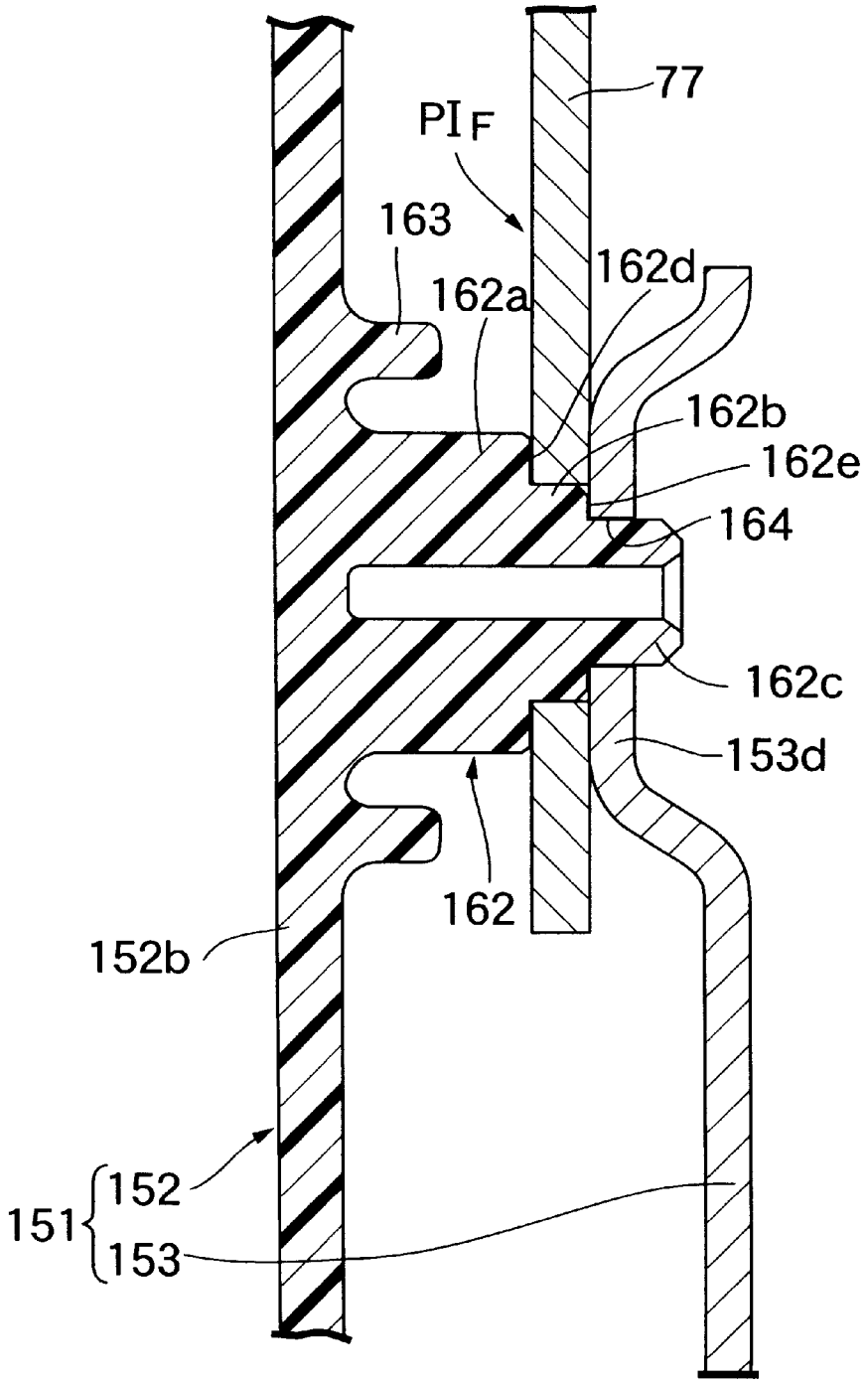

Referring also to FIG. 38, the internal operating-force inputting means $PI_F$ comprises the single input lever 77 turnably carried on a support shaft 162 which is integrally provided on the cover body 152 of the cover 151 and has an axis extending in a direction perpendicular to the turning axis of the open lever 30.

The support shaft 162 is integrally provided on the risen portion 152*b* of the cover body 152 to protrude toward the support plate 153, and has the axis extending in the direction perpendicular to the turning axis of the open lever 30. The support shaft 162 is formed into a stepped fashion and integrally provided with a large-diameter support portion 162*a* whose one end is connected integrally and at right angles to an inner end of the risen portion 152*b* which is opposed to the support plate 153, a small-diameter support portion 162*b* which has a diameter smaller than that of the large-diameter support portion 162*a* and whose one end is coaxially connected to the other end of the large-diameter support portion 162*a*, and an insertion shaft portion 162*c* which has a diameter further smaller than that of the small-diameter support portion 162*b* and which is coaxially connected to the other end of the small-diameter support portion 162*b*. An annular first step 162*d* is formed between the large-diameter support portion 162*a* and the small-diameter support portion 162*b* to face toward the support plate 153, and an annular second step 162*e* is formed between the small-diameter support portion 162*b* and the insertion shaft portion 162*c* to face toward the support plate 153.

An annular support tube portion 163 is integrally provided on the risen portion 152*b* of the cover body 152 to coaxially surround the large-diameter support portion 162*a* of the support shaft 162. The axial length of the support tube portion 163 is set such that a tip end of the support tube portion 163 is located at the axially intermediate portion of the large-diameter support portion 162*a*.

On the other hand, a circular projection 153*d* is provided on the support plate 153 at a location corresponding the support shaft 162 to protrude toward the risen portion 152*b*, and an insertion bore 164 is provided in the central portion of the projection 153*d*, so that the insertion shaft portion 162*c* of the support shaft 162 is inserted through the insertion bore 164.

When the cover body 152 and the support plate 153 are coupled to each other, the projection 153*d* of the support plate 153 is put into abutment against the second step 162*e* of the support shaft 162 in such a manner that the insertion shaft portion 162*c* is inserted through the insertion bore 164, and the input lever 77 is turnably supported on the small-diameter support portion 162*b* of the support shaft 162 in such a manner that it is sandwiched between the second step 162*e* and the projection 153*d*. A stopper 153*e* for defining the end of turning movement of the input lever 77 is provided on the support plate 153.

The locked-state switch-over means $LC_F$ includes the open link 31, the locking lever 32, the knob lever $\mathbf{110}_F$ coaxially connected to the locking lever 32, the connecting lever 124 connected to the knob lever $\mathbf{110}_F$, the cylinder lever 106 coaxially connected to the knob lever $\mathbf{110}_F$, and the actuator 112 connected to the locking lever 32 and fixed to the cover 151. The locked-state switch-over means $LC_F$ is covered with the cover 151.

A knob lever $\mathbf{110}_F$ is carried at a lower portion of the cover body 152 for turning movement about a turning axis perpendicular to the turning axes of the ratchet 28 and the ratchet lever 29 and extending substantially in the lengthwise direction of the ingress passage 40, so that it is turned in response to the operation of the locking knob (not shown) mounted on the inner surface of the front side door $D_F$.

Figure 39:
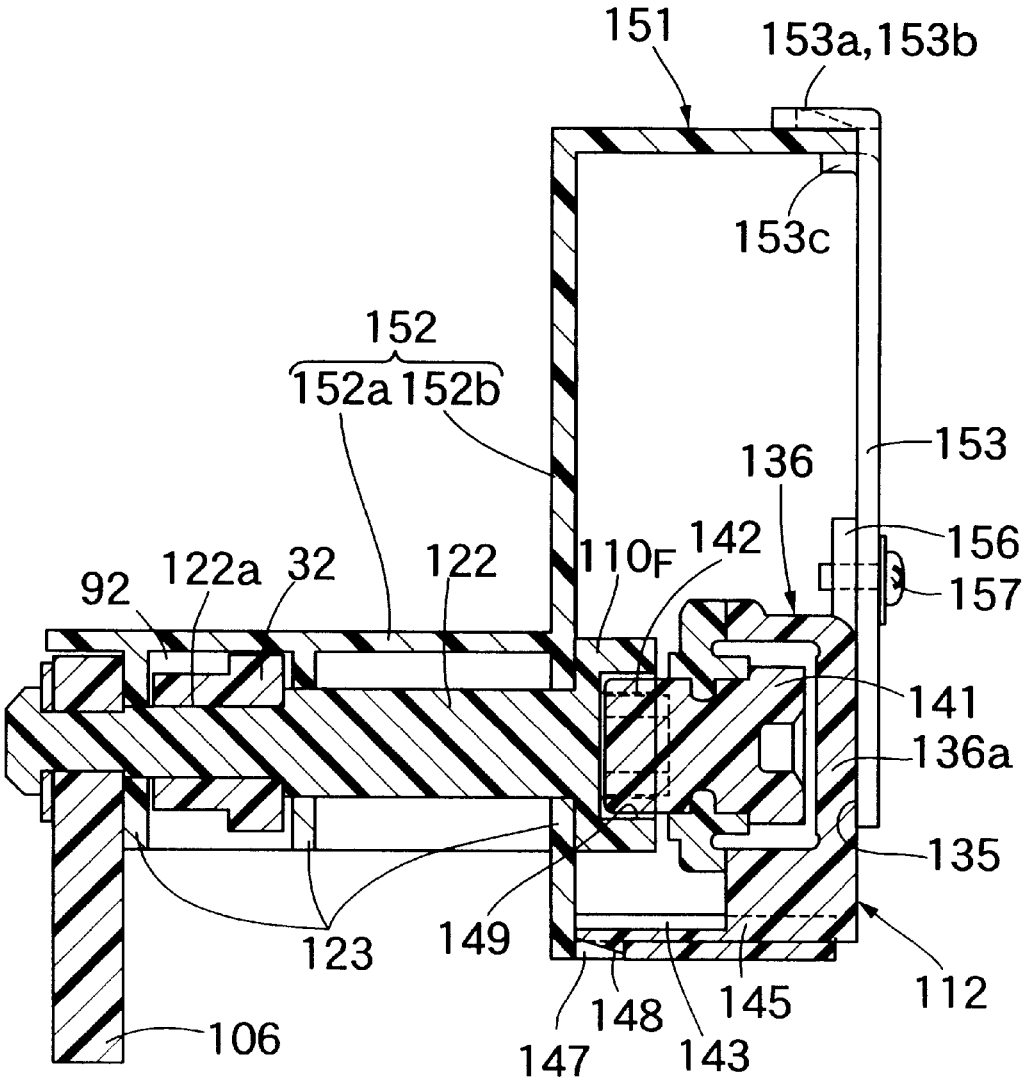

Referring also to FIG. 39, the knob lever $\mathbf{110}_F$ is formed from a synthetic resin and integrally provided with the shaft section 122 having the same axis as the turning axis of the knob lever $\mathbf{110}_F$. The shaft section 122 is turnably supported on support plate portions 123 provided on the cover body 152.

A connecting shaft portion 122*a* is formed on the shaft section 122 and fitted into the locking lever 32, whereby the locking lever 32 is relatively non-turnably connected to the shaft section 122, i.e., the knob lever $\mathbf{110}_F$.

An opening 135 which opens downwards is defined between the lower portion of the cover 151 and the lower portion of the back plate $\mathbf{36}_3$ of the casing $\mathbf{26}_3$, and the actuator 112 connected to the shaft section 122 turned with the locking lever 32 is mounted to the cover 151, so that a portion thereof protrudes into the cover 151 through the opening 135.

Namely, the actuator 112 is resiliently engaged with the cover body 152 from the side of the casing $\mathbf{26}_3$, so that the position thereof relative to cover body 152 is invariable in the plane perpendicular to the operating direction 121 for the operation of attaching and detaching the cover body 152 to the casing $\mathbf{26}_3$. The support plate 153 forming the cover 151 together with the cover body 152 is opposed as a limiting plate to the protrusion 136*a* of the housing 136 of the actuator 112 to inhibit the leaving of the actuator 112 from the cover body 152.

Figure 40:
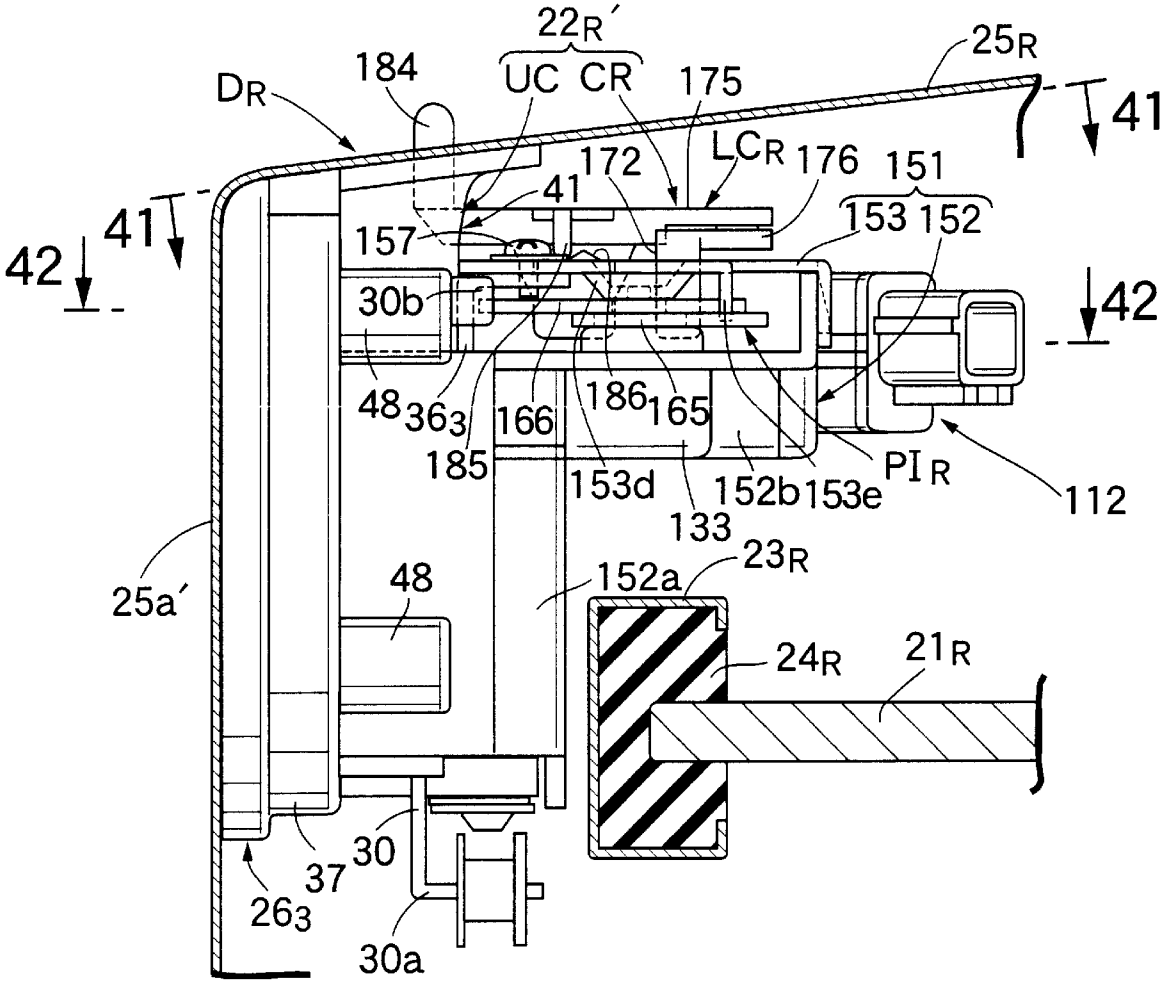
Figure 41:
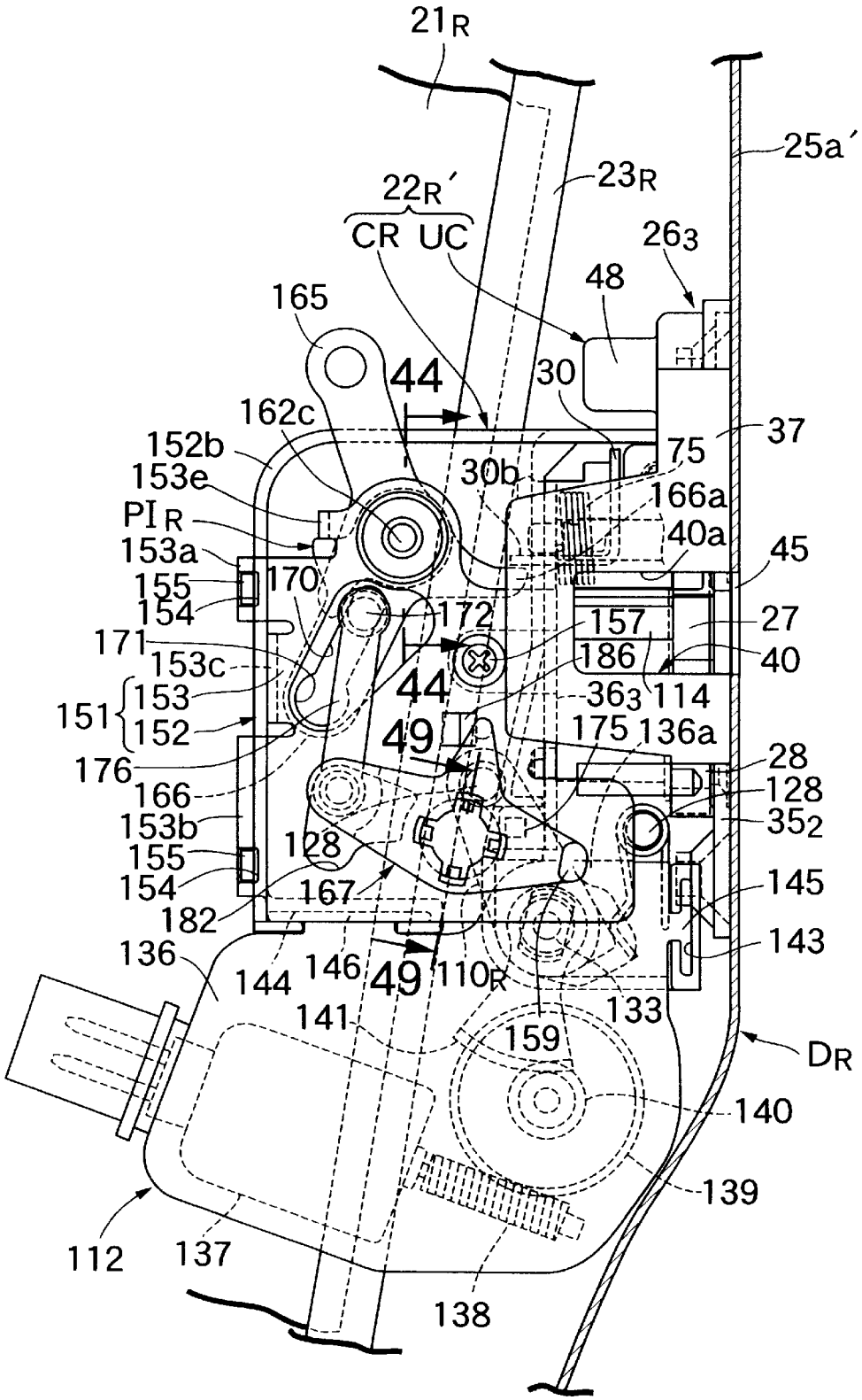

Referring to FIGS. 40 and 41, a glass sash $\mathbf{23}_R$ is mounted within the rear side door $D_R$, and the lifting and lowering movements of a window glass pane $\mathbf{21}_R$ are guided by a door glass run $\mathbf{24}_R$ made of an elastomeric material such as a rubber retained on the glass sash $\mathbf{23}_R$. An end wall 25*a*' is integrally formed on the inner panel $\mathbf{25}_R$ of the rear side door $D_R$, and adapted to be opposed to the vehicle body, when the rear side door $D_R$ is closed, and a door lock device $\mathbf{22}_R$' for the rear side door $D_R$ is coupled to an inner surface of the end wall 25*a*' to avoid the interference with the glass sash $\mathbf{23}_R$.

The door lock device $\mathbf{22}_R$' for the rear side door $D_R$ is comprised of a common unit UC common to the front side door $D_F$ and the rear side door $D_R$, and a rear side door cover unit CR assembled to the common unit UC.

Figure 42:
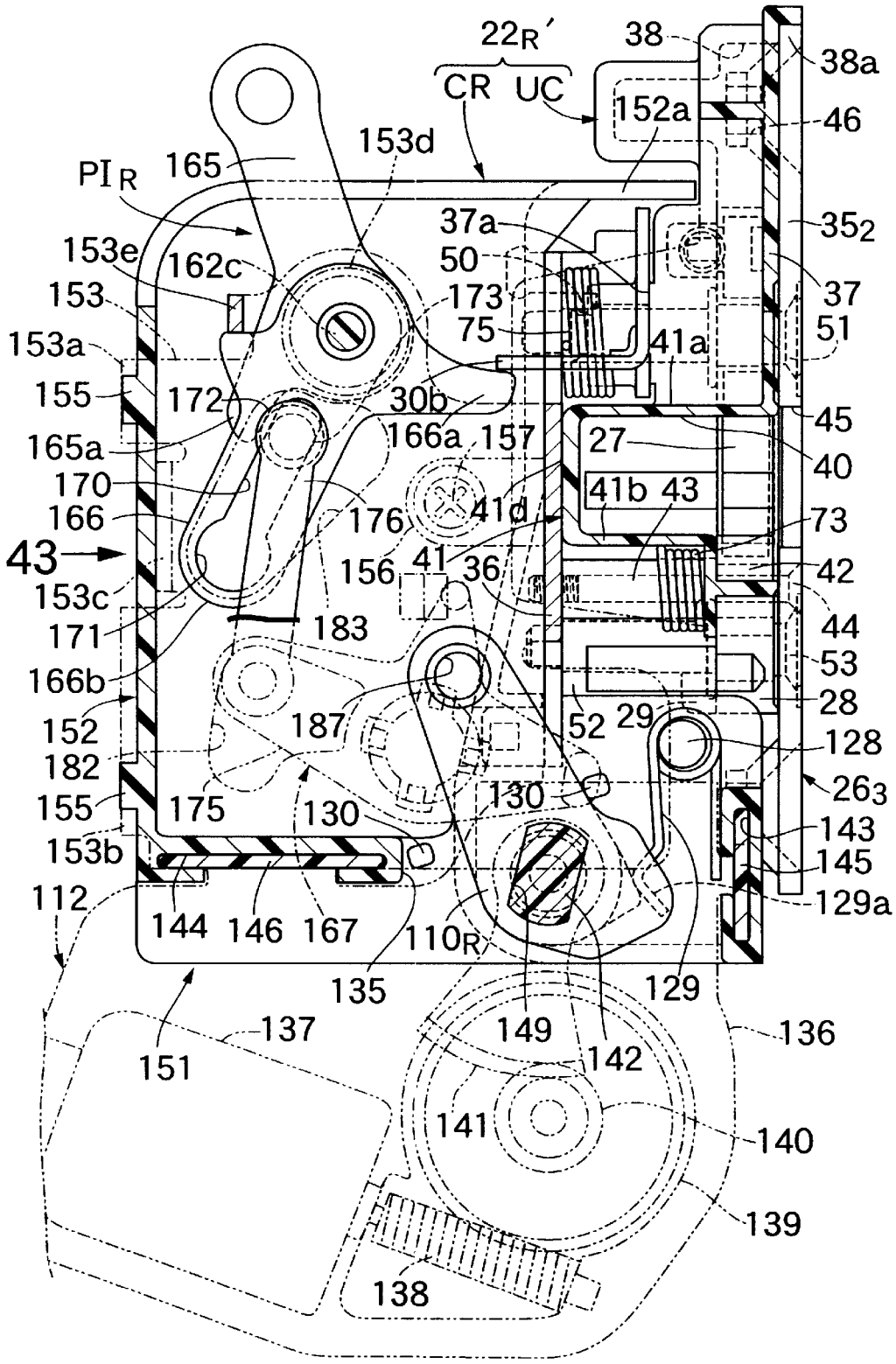
Figure 43:
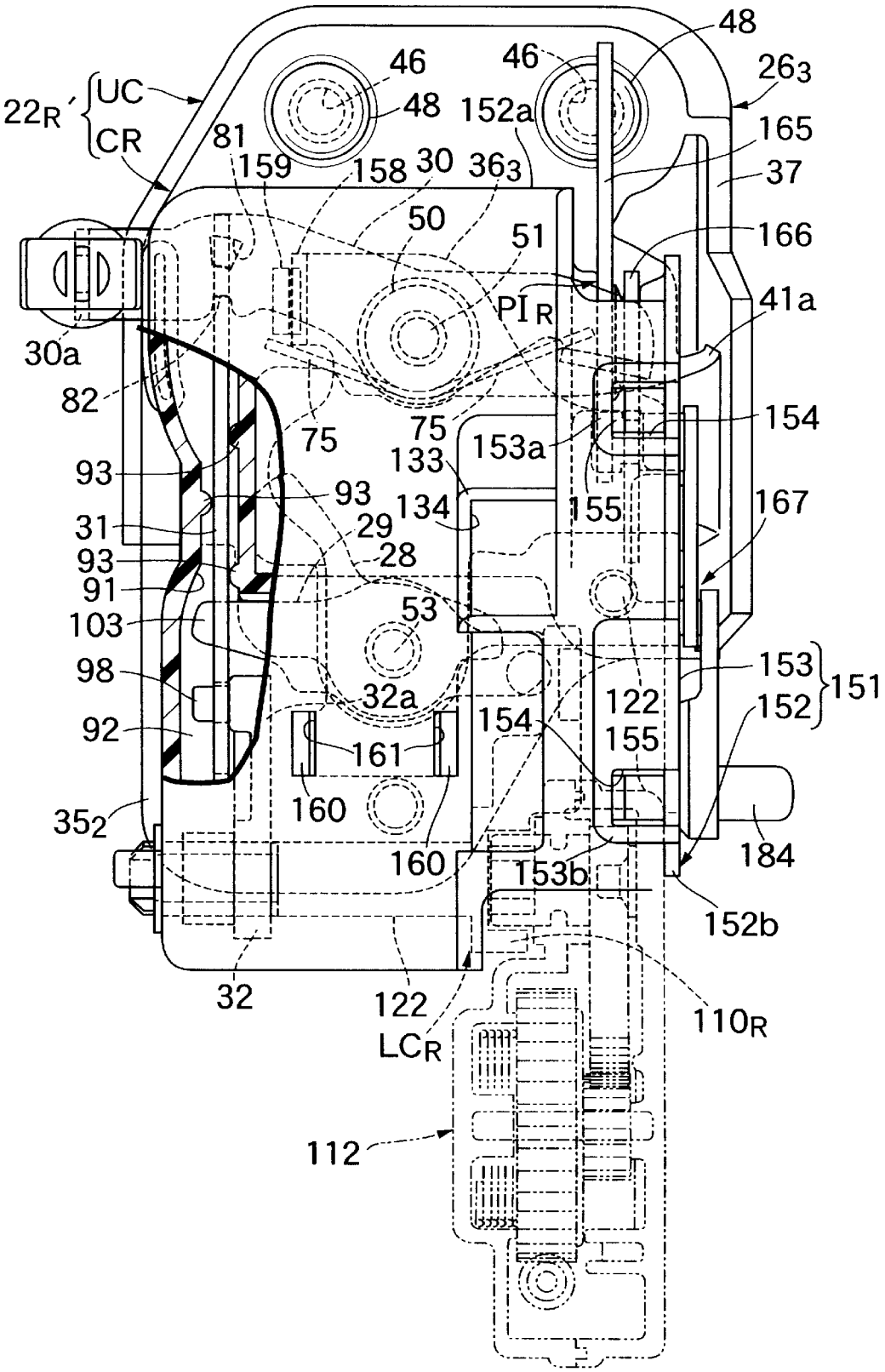

Referring also to FIGS. 42 and 43, the rear side door cover unit CR comprises an internal operating-force inputting means $PI_R$ and a locked-state switch-over means $LC_R$ for the rear side door $D_R$, which are mounted to the cover 151 that is formed into a shape common to the front side door $D_F$ and the rear side door $D_R$ and attached to the casing $\mathbf{26}_3$ to cover the common unit UC.

The internal operating-force inputting means $PI_R$ includes first and second input levers 165 and 166 turnably supported on the support shaft 162 of the cover 151, and a child lock mechanism 167.

Figure 44:
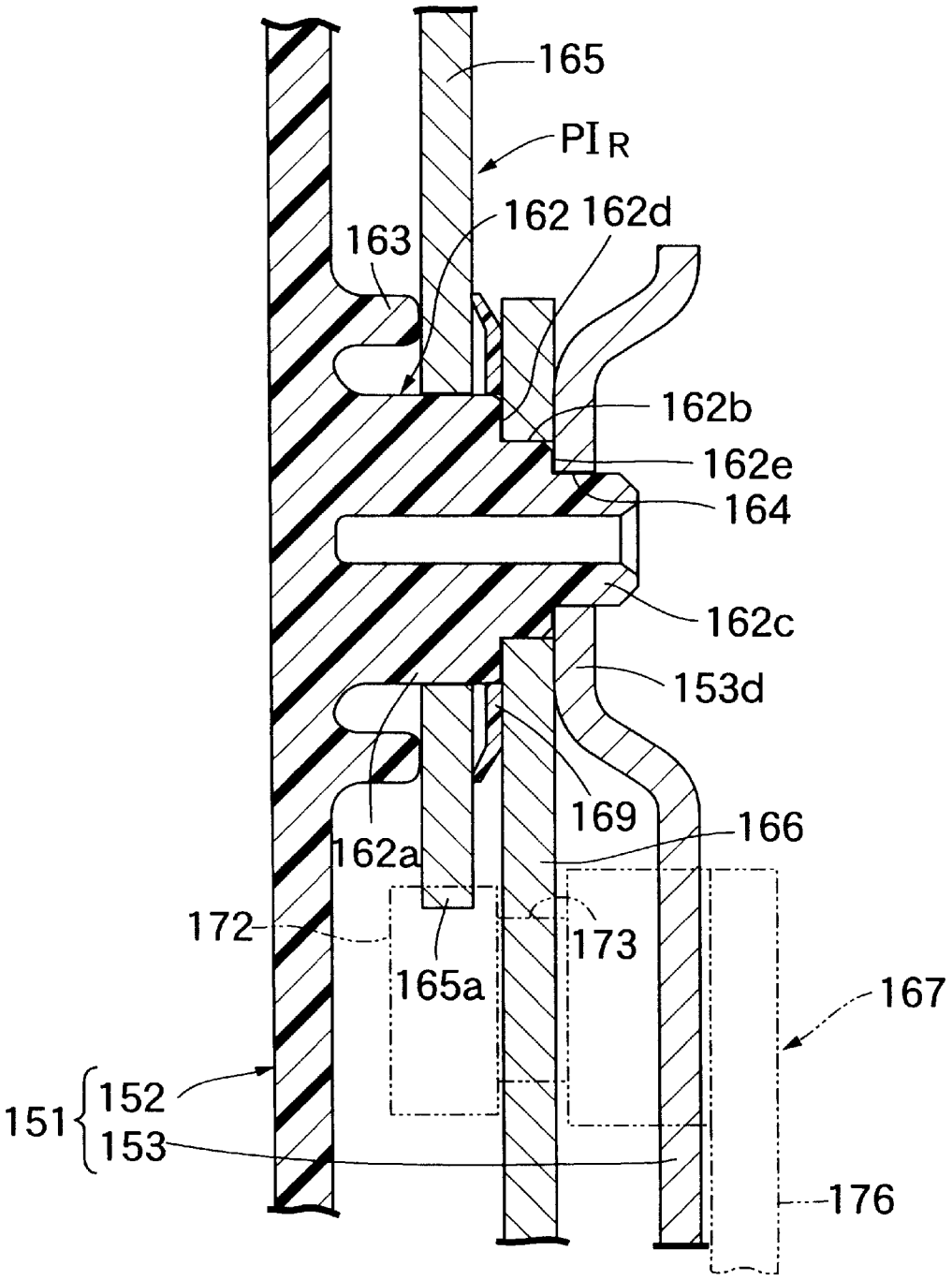

Referring to FIG. 44, the first and second input levers 165 and 166 are carried on the support shaft 162 of the cover 151 for turning movement about the same axis extending in the direction perpendicular to the turning axis of the open lever 30. More specifically, the first input lever 165 is turnably carried on the large-diameter support portion 162*a* of the support shaft 162 with its one end surface in sliding contact with a tip end of the support tube portion 163, and the second input lever 166 is turnably carried on the small-diameter support portion 162*b* of the support portion 162 with its one end surface in sliding contact with the first step 162*d* of the support shaft 162 and with the other end face in sliding contact with the projection 153*d* of the support plate 153. through which the insertion shaft portion 162*c* is inserted. A washer 169 made of a synthetic resin is interposed between the first and second input levers 165 and 166 to surround the large-diameter support portion 162*a*. The washer 169 serves to prevent the generation of the anchoring of the first and second input levers 165 and 166 due to the rusting, and the generation of a chattering sound due to mutual contacting of the first and second input levers 165 and 166, but the washer 169 may be omitted, so that the first and second input levers 165 and 166 may be in contact with each other.

Figure 45:
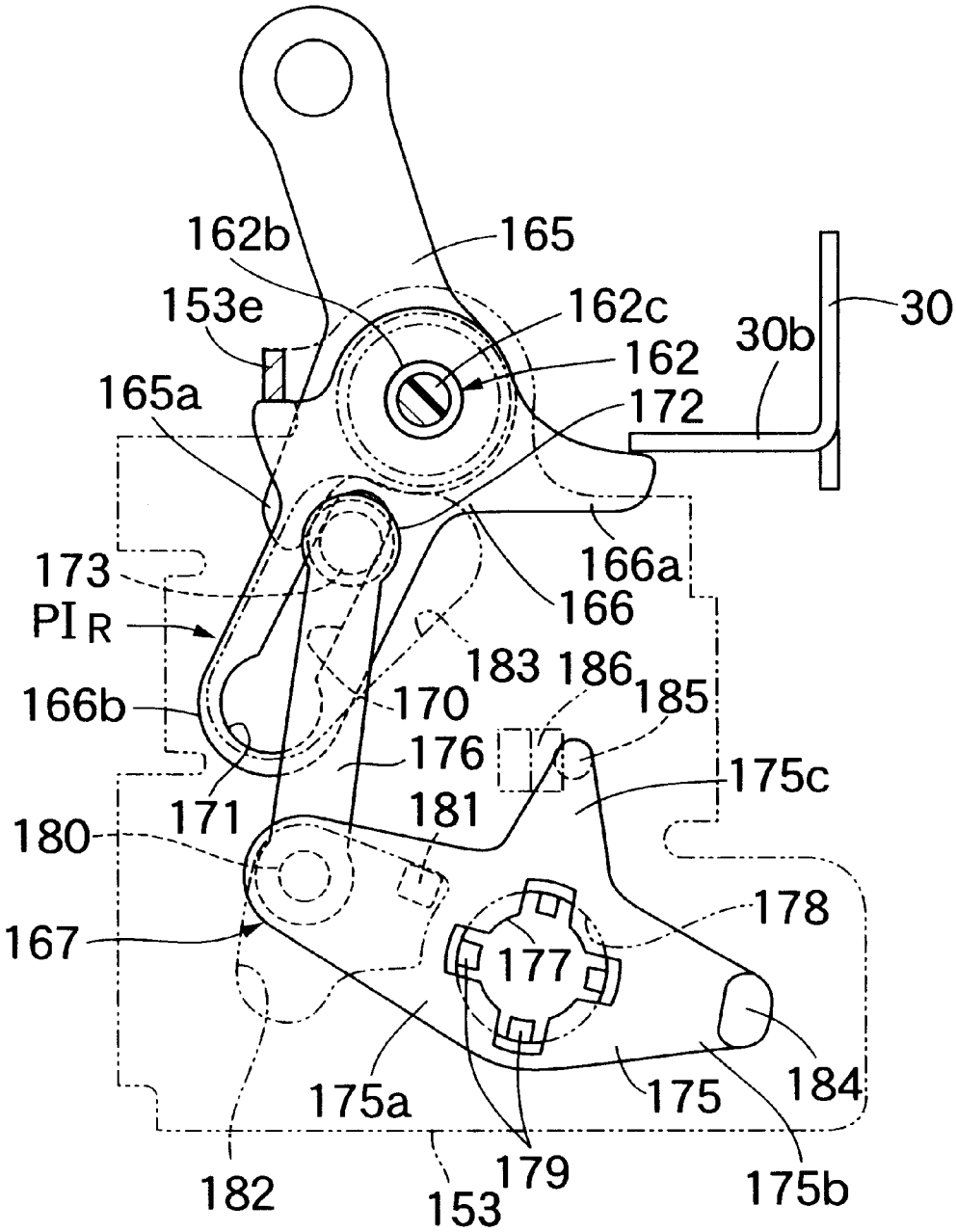
Figure 46:
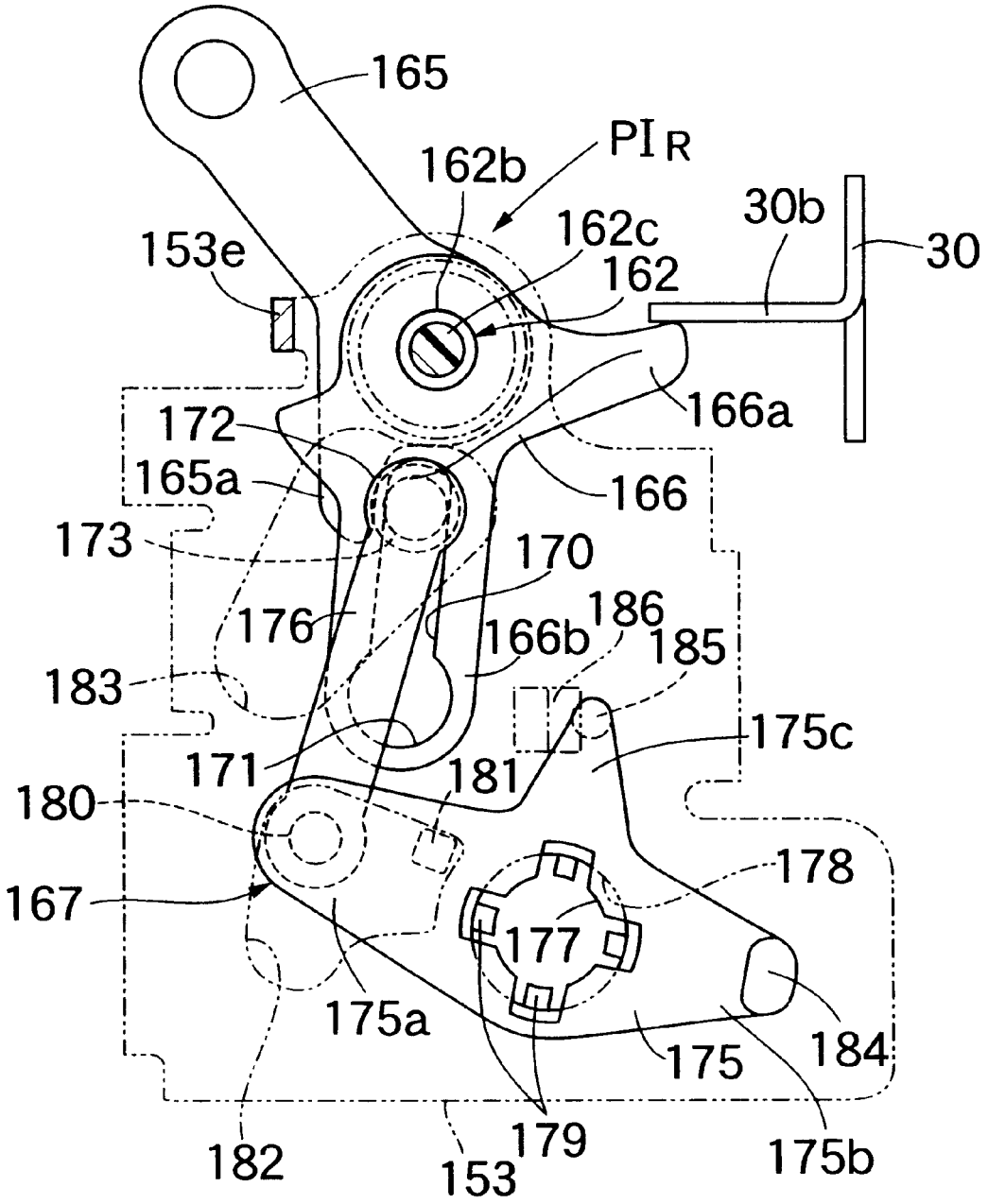

Referring also to FIGS. 45 and 46, the first input lever 165 is connected to the inside handle (not shown) mounted on the inner surface of the rear side door $D_R$, so that it is turned in a counterclockwise direction in FIGS. 45 and 46 in response to the operation of the inside handle. On the other hand, the second input lever 166 is connected to the open lever 30, and provided with an urging portion 166*a* abutting against the input plate portion 30*b* of the open lever 30 to urge the input plate portion 30*b* in the counterclockwise direction in FIGS. 45 and 46.

The second input lever 166 is integrally provided with an arm portion 166*b* which extends radially of the support shaft 162. The arm portion 166*b* is provided with an elongated bore 170 extending radially of the support shaft 162, and a circular bore 171 having a diameter larger than a width of the elongated bore 170 and connected to an outer end of the elongated bore 170.

A locking piece 172 is mounted to the arm portion 166*b* of the second input lever 166 and movable along the elongated bore 170. The locking piece 172 is formed from a synthetic resin into a columnar shape having a diameter which permits the locking piece 172 to be inserted into the circular bore 171, and an annular groove 173 is provided around an outer periphery of the locking piece 172 to be engaged with opposite side edges of the elongated bore 170.

On the other hand, the first input lever 165 is provided with an engage arm 165*a*. The engage arm 165*a* can be brought into engagement with the locking piece 172, from the counterclockwise direction in FIGS. 45 and 46, which is being moved to a position close to the support shaft 162 along the elongated bore 170. However, when the locking piece 172 is being moved to a position spaced apart from the support shaft 162 along the elongated bore 170, the engage arm 165*a* misses the locking piece 172 without being engaged with the locking piece 172, even if the first input lever 165 is turned in the counterclockwise direction in FIGS. 45 and 46.

Therefore, when the first input lever 165 is turned in the counterclockwise direction in FIGS. 45 and 46 in response to the operation of the inside handle on the inner surface of the rear side door $D_R$ in a state in which the locking piece 172 is being moved to the position close to the support shaft 162 along the elongated bore 170, the engage arm 165*a* is brought into engagement with the locking piece 172, and the second input lever 166 is turned in the counterclockwise direction in FIGS. 45 and 46, whereby the input plate portion 30*b* of the open lever 30 is urged by the urging portion 166*a* and thus, the opening operation force is applied to the open lever 30.

Figure 47:
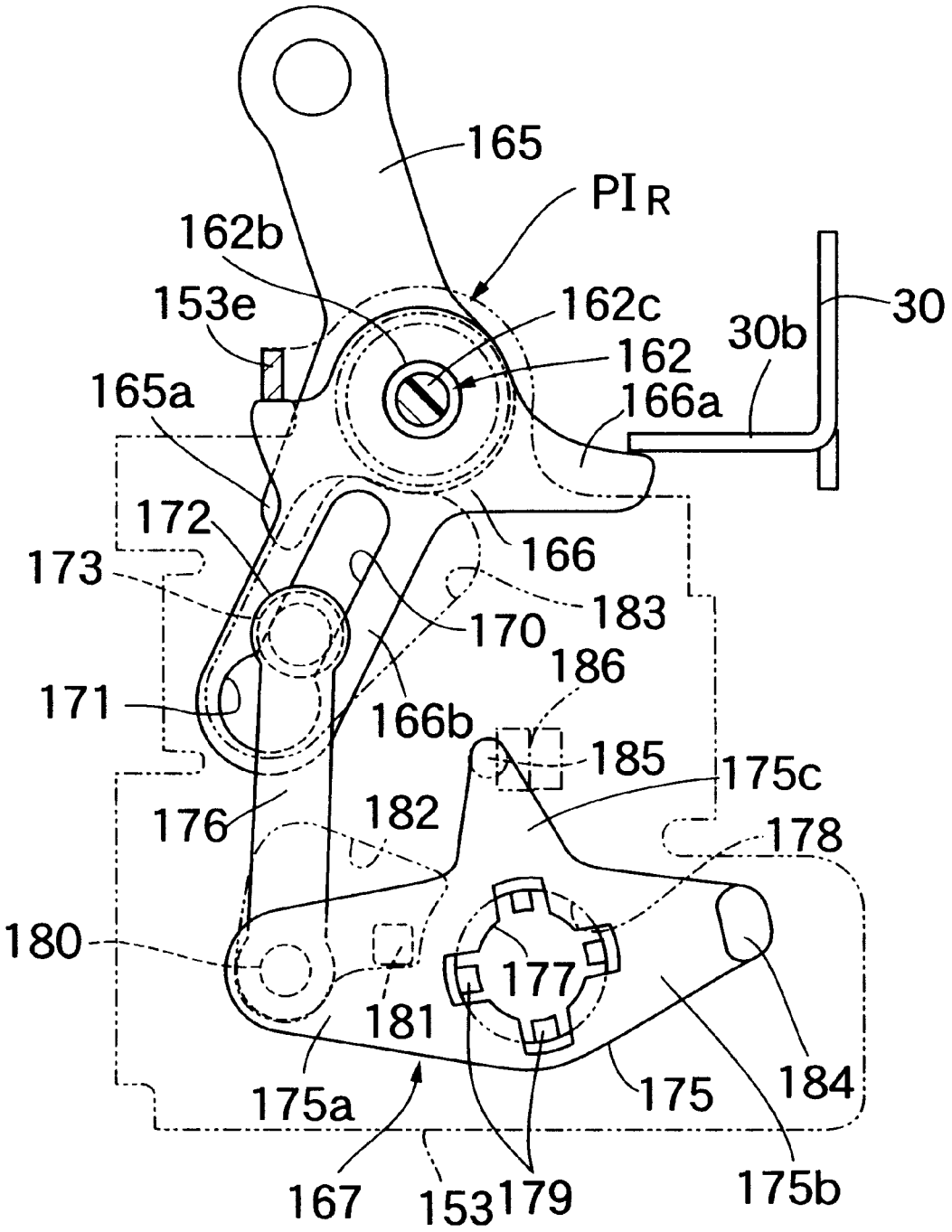
Figure 48:
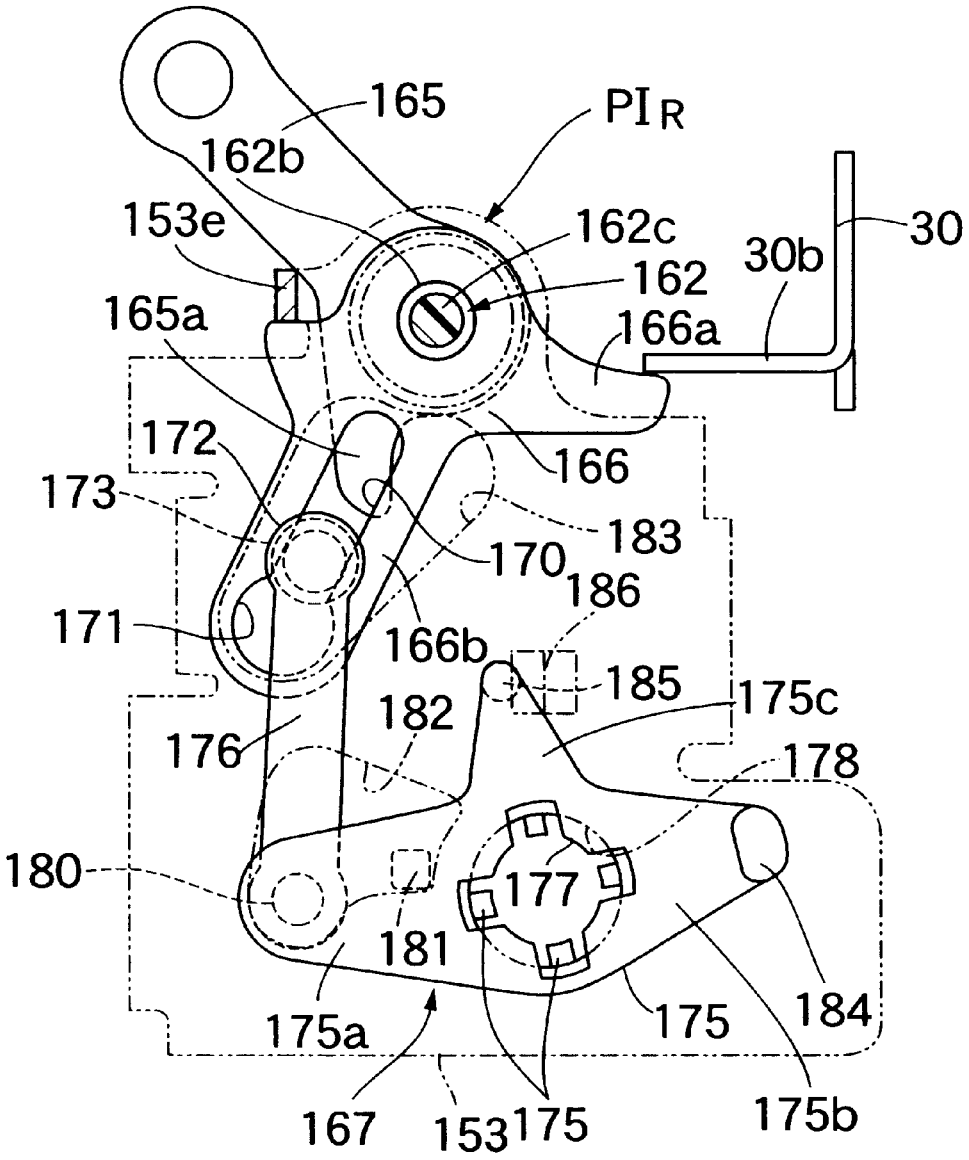

On the other hand, when the locking piece 172 is in the position spaced apart from the support shaft 162 along the elongated bore 170 as shown in FIGS. 47 and 48, the engage arm 165*a*, even if the first input lever is turned in the counterclockwise direction in FIGS. 47 and 48 in response to the operation of the inside handle, misses the locking piece 172 without being engaged with the locking piece 172. Thus, the second input lever 166 cannot be turned in the counterclockwise direction in FIGS. 47 and 48, and the input plate portion 30*b* of the open lever 30 cannot also be urged by the urging portion 166*a*. Therefore, the opening operation force is not applied to the open lever 30.

The child lock mechanism 167 is switched over between an unlocking state in which the locking piece 172 is moved to the position close to the support shaft 162 along the elongated bore 170, and a locking state in which the locking piece 172 is moved to the position spaced apart from the support shaft 162 along the elongated bore 170. In the locking state of the child lock mechanism 167, the opening operation force is not transmitted to the open lever 30, even if a child sitting on a rear seat switches the locked-state switch-over means $LC_R$ into the unlocking state by mistake, and operates the inside handle mounted on the inner surface of the rear side door $D_R$ for opening of the rear side door $D_R$.

The child lock mechanism 167 includes a child lever 175 of a synthetic resin, which is carried on the support plate 153 of the cover 151 for turning movement about an axis parallel to the turning axes of the first and second input levers 165 and 166, i.e., the axis of the support shaft 162, and a child link 176 of a synthetic resin, which is connected at one end thereof to the child lever 175 and integrally formed at the other end thereof with the locking piece 172.

Figure 49:
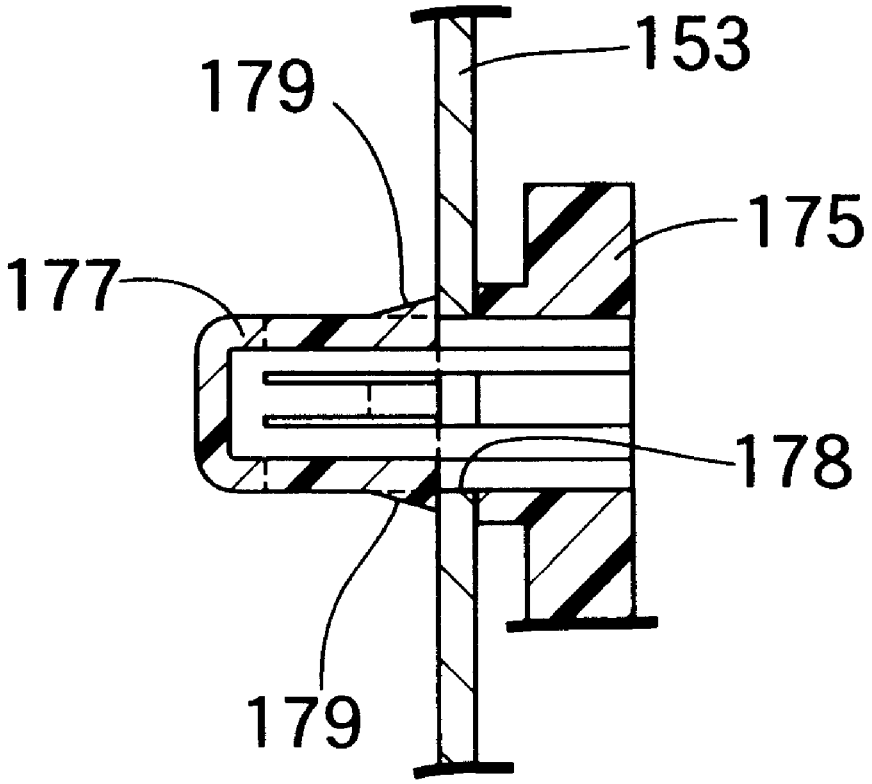

Referring to FIG. 49, the child lever 175 is carried on the support plate 153 in such a manner that it is disposed between the inner panel $25_R$ of the rear side door $D_R$ and the support plate 153. The support plate 153 is provided with a support bore 178 into which a shaft portion 177 integrally provided on the child lever 175 is inserted for turning movement about its axis. Engage claws 179 are provided on the shaft portion 177 at a plurality of circumferentially spaced-apart locations thereof to resiliently be engaged with the periphery of the support bore 178 on the side of the inner surface of the support plate 153. Therefore, the child lever 175 is turnably carried on the support plate 153 only by inserting the shaft portion 177 into the support bore 178 from on the side of the outer surface of the support plate 153.

The child lever 175 is integrally provided with arm portions 175*a* and 175*b* extending in opposite sideways directions along one diametrical direction of the shaft portion 177, and the child link 176 disposed on the outer surface of the support plate 153 is turnably connected at one end thereof to a connecting pin 180 which is integrally provided at a tip end of one 175*a* of the arm portions. A limiting pin 181 is integrally provided at a base end of the arm portion 175*a* to protrude toward the support plate 153. The support plate 153 is provided with a limiting bore 182 into which tip ends of the connecting pin 180 and the limiting pin 181 are inserted. The limiting bore 182 is defined, so that when the child lever 175 is turned between the unlocking position (position shown in FIGS. 45 and 46) and the locking position (position shown in FIGS. 47 and 48), the limiting bore 182 is put into abutment against the limiting pin 181 to limit the end of turning movement of the child lever 175, while at the same time, permitting the turning movement of the connecting pin 180 caused by the turning movement of the child lever 175.

The child link 176 is disposed on the outer surface of the support plate 153, while the second input lever 166 is disposed on the inner surface of the support plate 153. It is required that the locking piece 172 connected at one end thereof integrally and at right angles to the other end of the child link 176 has the other end passed through the support plate 153 and disposed inside the support plate 153. A through-bore 183 through which the locking piece 172 is extended is provided in the support plate 153 to permit the movement of the locking piece 172 with the operation of the child lock mechanism 167 and the turning operation of the second input lever 166.

On the other hand, a base end of a pin-shaped operating portion 184 is provided integrally and at right angles at a tip end of the other arm portion 175*b*. The door lock device $22_R'$ has been attached to the rear side door $D_R$, and a tip end of the operating portion 184 protrudes from the inner surface of the rear portion of the rear side door $D_R$. Moreover, the tip end of the operating portion 184 is disposed in a position in which it is hidden by members on the side of the vehicle body 20 in the closed state of the rear side door $D_R$, so that the child on the rear seat cannot operate the operating portion 184 in a state in which the rear side door $D_R$ has been closed.

In the opened state of the rear side door $D_R$, the operating portion 184 can be operated to turn the child lever 175 between the unlocking position and the locking position.

Further, the child lever 175 is integrally provided with an arm portion 175*c* which extends in a direction substantially perpendicular to both the arm portions 175*a* and 175*b*. A moderating pin 185 is integrally provided on the arm portion 175*c* to protrude toward the support plate 153, and a projection 186 is provided on the support plate 153 at a location corresponding to the moderating pin 185 to protrude in a triangular shape toward the moderating pin 185.

The turning movement of the child lever 175 between the unlocking position and the locking position by the operation of the operating portion 184 is conducted, so that the moderating pin 185 climbs over the projection 186, and thus, a moderation is applied to the turning operation of the child lever 175 between the unlocking position and the locking position.

The locked-state switch-over means $LC_R$ includes the open link 31, the locking lever 32, a knob lever $110_R$, and the actuator 112 connected to the locking lever 32 and fixed to the cover 151. The locked-state switch-over means $LC_R$ is covered with the cover 151.

The locked-state switch-over means $LC_R$ for the rear side door $D_R$ does not include the connecting lever 124 and the cylinder lever 106 which are included in the locked-state switch-over means $LC_F$ for the front side door $D_F$. Moreover, the shape of the knob lever $110_R$ of the locked-state switch-over means $LC_R$ for the rear side door $D_R$ is different from that of the knob lever $110_F$ included in the locked-state switch-over means $LC_F$ for the front side door $D_F$. A shaft section 122 is integrally provided on the knob lever $110_R$ and turnably carried on the cover body 152 of the cover 151, as in the knob lever $110_F$. The knob lever $110_R$ is provided with a connecting bore 187 for connecting a transmitting means (not shown) such as a rod connected to a locking knob (not shown) mounted on the inner surface of the rear side door $D_R$. The knob lever $110_R$ is also provided with a recess 188 into which the output shaft 142 of the actuator 112 is relatively non-turnably fitted.

The operation of the third embodiment will be described below. The common unit UC is comprised of the common casing $26_3$ capable of being attached to any of the front side door $D_F$ and the rear side door $D_R$, and the latch 27, the ratchet 28, the open lever 30, the spring 59 and the torsion springs 73 and 75, all of which are mounted to the casing $26_3$ as components common to the front side door $D_F$ and the rear side door $D_R$. The door lock device $22_{F3}$ for the front side door $D_F$ comprises the common unit UC and the front side door cover unit CF, and the door lock device $22_R'$ for the rear side door $D_R$ comprises the common unit UC and the rear side door cover unit CR.

The front side door cover unit CF comprises the internal operating-force inputting means $PI_F$ and the locked-state switch-over means $LC_F$ for the front side door, which are mounted to the cover 151 that is formed into the shape common to the front and rear side doors $D_F$ and $D_R$ and attached to the casing $\mathbf{26}_3$ to cover the common unit UC. The rear side door cover unit CR comprises the internal operating-force inputting means $PI_R$ and the locked-state switch-over means $LC_R$ for the rear side door, which are mounted to the cover 151. The casing $\mathbf{26}_3$ is capable of being selectively mounted to any of the internal operating-force inputting means $PI_F$ and the locked-state switch-over means $LC_F$ for the front side door $D_F$ and the internal operating-force inputting means $PI_R$ and the locked-state switch-over means $LC_R$ for the rear side door $D_R$.

More specifically, the cover body 152 of the cover 151 is provided with the support bore 131 for turnably supporting the connecting lever 124 of the locked-state switch-over means $LC_F$ for the front side door $D_F$. The support plate 153 of the cover 151 is provided with the limiting bore 182, the through-bore 183 and the projections 186 for the child lock mechanism 167 included in the internal operating-force inputting means $PI_R$ for the rear side door $D_R$. In the cover 151 used in the door lock device $\mathbf{22}_{F3}$ for the front side door $D_F$, the limiting bore 182, the through-bore 183 and the projections 186 are not used, and in the cover 151 used in the door lock device $\mathbf{22}_R$' for the rear side door $D_R$, the support bore 131 is not used.

By commonly using many of components forming the door lock device $\mathbf{22}_{F3}$ for the front side door $D_F$ as well as the door lock device $\mathbf{22}_R$' for the rear side door $D_R$ respectively as the common unit UC and commonly using the casing $\mathbf{26}_3$ for the front side door cover unit CF and the rear side door cover unit CR in the above manner, a reduction in cost can be provided, while facilitating the management of the components, and the assemblability can also be enhanced.

The single input lever 77 included in the internal operating-force inputting means $PI_F$ for the front side door $D_F$, as well as the first and second input levers 165 and 166 included in the internal operating-force inputting means $PI_R$ for the rear side door $D_R$ are turnably supported on the support shaft 162 integrally provided on the cover body 152 made of the synthetic resin. Therefore, as compared with a case where the input levers 77, 165 and 166 are supported using rivets, the number of parts can be reduced, and the assembling operation can be facilitated. Moreover, since the support shaft 162 integral with the cover body 152 is supported at its tip end on the support plate 153 coupled to the cover body 152, the support shaft 162 is dual-supported, or supported at two locations, whereby the strength of supporting of the input levers 77, 165 and 166 can be enhanced.

In addition, the support shaft 162 is formed into the stepped fashion and includes the large-diameter support portion 162*a* on which the second input lever 166 included in the internal operating-force inputting means $PI_R$ for the rear side door $D_R$ can be turnably supported, and the small-diameter support portion 162*b* which is coaxially connected to the large-diameter support portion 162*a* and on which the single input lever 77 included in the internal operating-force inputting means $PI_F$ for the front side door $D_F$ and the first input lever 165 included in the internal operating-force inputting means $PI_R$ for the rear side door $D_R$ can be selectively turnably supported. Therefore, the cover 151 can be used commonly for any of the front side door $D_F$ and the rear side door $D_R$, whereby the management of the components can be simplified.

Although the embodiments of the present invention have been described in detail, it will be understood that the present invention is not limited to the above-described embodiments, and various modifications may be made without departing from the spirit and scope of the invention defined in claims.

What is claimed is:

1. A door lock device for a vehicle, comprising a casing ($\mathbf{26}_1$, $\mathbf{26}_2$, $\mathbf{26}_3$) fixed to a door ($D_F$, $D_R$) and having a bulged portion (41) which is bulged inwards of said door ($D_F$, $D_R$) to define an ingress passage (40) into which a striker (39) on a vehicle body (20) side enters; a latch (27) turnably supported on said casing ($\mathbf{26}_1$, $\mathbf{26}_2$, $\mathbf{26}_3$) to be brought into engagement with said striker (39) entering said ingress passage (40) for turning movement; a ratchet (28) supported on said casing ($\mathbf{26}_1$, $\mathbf{26}_2$, $\mathbf{26}_3$) for turning movement between an engaged position in which said ratchet (28) is engaged with said latch (27) and a disengaged position in which such engagement is released; an open lever (30) turnably carried on said casing ($\mathbf{26}_1$, $\mathbf{26}_2$, $\mathbf{26}_3$) and capable of receiving an operating force for releasing a locking state in which said ratchet (28) is in engagement with said latch (27); an internal operating-force inputting means ($PI_1$, $PI_2$, $PI_F$, $PI_R$) connected to said open lever (30) to transmit to said open lever (30) a door opening operation force depending on a door opening operation within the vehicle; a locked-state switch-over means ($LC_1$, $LC_2$, $LC_F$, $LC_R$) which includes an open link (31) connected at one end thereof to said open lever (30) and which is capable of switching over an unlocked state in which said ratchet (28) can be operated from the engaged position to the disengaged position in response to the turning movement of said open lever (30) following input of said door opening operation force, and a locked state in which the operation of said ratchet (28) from the engaged position to the disengaged position is impossible irrespective of the turning movement of said open lever (30) following the input of said door opening operation force, wherein said open link (31) extends along a plane perpendicular to a lengthwise direction of said ingress passage (40) and is capable of being operated within said plane, said open link being disposed sideways of said bulged portion (41) on an opposite side from an inlet (40*a*) of said ingress passage (40).

2. A door lock device according to claim 1, wherein said locked-state switch-over means ($LC_1$, $LC_2$, $LC_F$, $LC_R$) includes at least said open link (31), and a locking lever (32) connected to the other end of said open link (31) for operation between an unlocking position in which an operating force for operating said ratchet (28) from the engaged position to the disengaged position in response to the operation of said open lever (30) following the input of said opening operation force can be transmitted from said open link (31) to said ratchet (28), and a locking position in which the transmission of said operating force from said open link (31) to said ratchet (28) is made impossible, irrespective of the operation of said open lever (30), and wherein a cover (33, 111, 151) is mounted to said casing ($\mathbf{26}_1$, $\mathbf{26}_2$, $\mathbf{26}_3$) to cover said open link (31) and said locking lever (32) said cover being provided with a guide groove (91) for guiding the operation of said open link (31).

3. A door lock device according to claim 2, further including a plurality of ribs (93) which are fixedly provided on an inner side of said guide groove (91) to come into sliding contact with opposite sides of said open link (31).

4. A door lock device according to claim 2, further including a knob lever (95, 110, $110_F$, $110_R$) which is connected to said locking lever (32) to operate said locking lever (32) between the unlocking position and the locking position, said knob lever (95, 110, $110_F$, $110_R$) being integrally provided with a shaft section (96, 122) having the same axis as a turning axis of said knob lever (95, 110, $110_F$, $110_R$), said locking lever (32) being relatively non-turnably connected to said shaft section (96, 122).

5. A door lock device according to claim 4, further including a cylinder lever (106) connected to a key cylinder lock (107) and connected to said shaft section (96, 122) for turning movement in unison with each other about the same axis as said shaft section (96, 122).

6. A door lock device according to claim 4, wherein said shaft section (96, 122) of said knob lever (95, 110, $110_F$, $110_R$) is turnably supported on said cover (33, 111, 151).

7. A door lock device according to claim 1, further including a ratchet lever (29) connected to said ratchet (28) so as to be capable of transmitting the operating force from said open link (31) to said ratchet (28), said ratchet lever (29) being disposed in a coaxially superposed manner on said ratchet (28) against turning movement relative to said ratchet (28).

8. A door lock device according to claim 7, wherein said ratchet (28) comprises a ratchet body (67) made of a metal, said ratchet body (67) being covered at most thereof with a covering member (68) made of a synthetic resin, said covering member (68) having a resilient stopper (68*a*) integrally formed thereon to protrude from said ratchet (28) in a direction parallel to the turning axis of said ratchet (28), said stopper being operable to abut against said casing ($26_1$, $26_2$, $26_3$) to define an end of turning movement of said ratchet (28) in a direction to be engaged with said latch (27).

9. A door lock device according to claim 8, wherein said resilient stopper (68*a*) is disposed on said ratchet (28) at a location in which said stopper (68*a*) is sandwiched between said casing ($26_1$, $26_2$, $26_3$) and said ratchet lever (29) when said stopper (68*a*) is in abutment against said casing ($26_1$, $26_2$).

10. A door lock device according to claim 1, wherein said locked-state switch-over means ($LC_1$, $LC_2$, $LC_F$, $LC_R$) includes at least said open link (31), and a locking lever (32) connected to the other end of said open link (31) for operation between an unlocking position in which an operating force for operating said ratchet (28) from the engaged position to the disengaged position in response to the operation of said open lever (30) following the input of said opening operation force can be transmitted from said open link (31) to said ratchet (28), and a locking position in which the transmission of said operating force from said open link (31) to said ratchet (28) is made impossible, irrespective of the operation of said open lever (30), and wherein said door lock device further includes an actuator (112) which is fixedly supported on said casing ($26_2$, $26_3$) so as to be capable of turning said locking lever (32), said actuator (112) including an output shaft (142) coaxially connected to said locking lever (32).

11. A door lock device according to claim 2, wherein said cover (111, 151) is resiliently engaged with said casing ($26_2$, $26_3$), in a manner to be attachable and detachable in an operating direction (121) parallel to the turning axes of said latch (27) and said ratchet (28); an actuator (112) being connected to said locking lever (32) and brought into resilient engagement with said cover (111, 151) from the side of said casing ($26_2$, $26_3$), so that the position thereof relative to said cover (111, 151) in a plane perpendicular to the operating direction (121) is invariable; and said casing ($26_2$, $26_3$) is provided with a limiting plate portion (78, 153) which is opposed to said actuator (112) to inhibit leaving of said actuator (112) from said cover (111, 151).

12. A door lock device according to claim 2, wherein said cover (111, 151) is mounted to said casing ($26_2$) to cover at least a knob lever (110, $110_F$, $110_R$) coaxially connected to said locking lever (32), said open link (31) and said locking lever (32), is provided with a support bore (131), and said door lock device further includes a connecting lever (124) which is disposed inwardly of said cover (111, 151), turnably carried on said cover (111, 151) and connected to said knob lever (110, $110_F$, $110_R$) to transmit to said knob lever (110, $110_F$, $110_R$) an operating force depending on the operation of a locking knob, said connecting lever(124) being integrally provided with a shaft section (125) which is inserted into said support bore (131) for turning movement about an axis of said shaft portion and which has a plurality of engage claws (132) resiliently engaged with a periphery of said support bore (131) on the side of an outer surface of said cover (111, 151), said outer surface of said cover (111, 151) being provided with a covering portion (133) which covers at least an upper portion and an outer end of said shaft section (125).

13. A door lock device according to claim 1, wherein said door is either a front side door ($D_F$) or a rear side door ($D_R$), and said internal operating-force inputting means ($PI_F$, $PI_R$) and said locked-state switch-over means ($LC_F$, $LC_R$) are formed in a different construction for said front side door ($D_F$) or said rear side door ($D_R$) in the vehicle, wherein a common unit (UC) is comprised of the casing ($26_3$) as a common casing capable of being mounted to either of the front side door ($D_F$) and rear side door ($D_R$), and a plurality of common parts (27, 28, 29, 30, 59, 73 and 75) including said latch (27), said ratchet (28) and said open lever (30) mounted to said casing as common to the front side door ($D_F$) and the rear side door ($D_R$), and wherein a (151) is formed into a shape common to the front side door ($D_F$) and the rear side door ($D_R$) and mounted to said casing (26) while covering said common unit (UC), so that any of said internal operating-force inputting means ($PI_F$) and said locked-state switch-over means ($LC_F$) for the front side door ($D_F$) and said internal operating-force inputting means ($PI_R$) and said locked-state switch-over means ($LC_R$) for the rear side door ($D_R$) can selectively be mounted to said cover (151).

14. A door lock device according to claim 1, wherein a cover (151) mounted to said casing ($26_3$) to cover said locked-state switch-over means ($LC_F$, $LC_R$) comprises a cover body (152) made of a synthetic resin and a support plate (153) coupled to said cover body (152), and said internal operating-force inputting means ($PI_F$, $PI_R$) includes an input lever (77) which is turnably supported on a support shaft (162) integrally provided on said cover body (152) with a tip end of said support shaft (162) supported on said support plate (153).

15. A door lock device according to claim 14, wherein said internal operating-force inputting means ($PI_F$) comprises an internal operating-force transmitting means for a front side door ($D_F$) which comprises a single input lever (77) turnably supported on said support shaft (162) for turning said open lever (30) in response to inputting of the door opening operation force and an internal operating-force inputting means ($PI_R$) for a rear side door ($D_R$) which includes a first input lever (165) turnably supported on said support shaft (162) so as to be capable of receiving the door opening operation force, and a second input lever (166)

connected to said open lever (30) and turnably supported on said support shaft (162), such that the connection and disconnection of said second input lever (166) to and from said first input lever (165) can be switched over from one to another; and said support shaft (162) is formed into a stepped fashion and includes a small-diameter support portion (162*b*) on which said second input lever (166) included in said internal operating-force inputting means ($PI_R$) for the rear side door ($D_R$) can be turnably supported, and a large-diameter support portion (162*a*) which is coaxially connected to said small-diameter support portion (162*b*) which turnably supports said single input lever (77) included in said internal operating-force inputting means ($PI_F$) for the front side door ($D_F$) and said first input lever (165) included in said internal operating-force inputting means ($PI_R$) for the rear side door ($D_R$).

* * * * *